US010612800B2

(12) United States Patent
Staffend et al.

(10) Patent No.: US 10,612,800 B2
(45) Date of Patent: Apr. 7, 2020

(54) HIGH EFFICIENCY HEATING AND/OR COOLING SYSTEM AND METHODS

(71) Applicant: Gilbert S. Staffend, Farmington, MI (US)

(72) Inventors: Gilbert S. Staffend, Farmington, MI (US); Nancy A. Staffend, Haslett, MI (US); Nicholas A. Staffend, Farmington, MI (US)

(73) Assignee: Gilbert S. Staffend, Farmington, MI (US)

( * ) Notice: Subject to any disclaimer, the term of this patent is extended or adjusted under 35 U.S.C. 154(b) by 27 days.

(21) Appl. No.: 15/746,640

(22) PCT Filed: Aug. 19, 2016

(86) PCT No.: PCT/US2016/047778
§ 371 (c)(1),
(2) Date: Jan. 22, 2018

(87) PCT Pub. No.: WO2017/031428
PCT Pub. Date: Feb. 23, 2017

(65) Prior Publication Data

US 2018/0223846 A1 Aug. 9, 2018

Related U.S. Application Data

(60) Provisional application No. 62/207,216, filed on Aug. 19, 2015.

(51) Int. Cl.
*F24F 5/00* (2006.01)
*F28B 9/00* (2006.01)
(Continued)

(52) U.S. Cl.
CPC ..... *F24F 5/0085* (2013.01); *F04C 23/001* (2013.01); *F04C 23/003* (2013.01);
(Continued)

(58) Field of Classification Search
CPC .... F25B 7/00; F25B 9/004; F25B 1/04; F25B 30/00; F25B 30/02; F24F 5/0085;
(Continued)

(56) References Cited

U.S. PATENT DOCUMENTS 1,725,906 A 8/1929 Gay
3,392,541 A * 7/1968 Nussbaum ..... F25B 7/00 62/175

(Continued)

FOREIGN PATENT DOCUMENTS

JP S5535823 A 3/1980

OTHER PUBLICATIONS

Domanski et al., "Properties and Cycle Performance of Refrigerant Blends Operating Near and Above the Refrigerant Critical Point", Task 2: Air Conditioner System Study Final Report, published Sep. 2002 by National Institute of Standards and Technology Building and Fire Research Laboratory, Appendix B.Summary of Test Results for R410A System, http://fire.nist.gov/bfrlpubs/build02/PDF/b02080.pdf.

(Continued)

*Primary Examiner* — Mark A Laurenzi
*Assistant Examiner* — Xiaoting Hu
(74) *Attorney, Agent, or Firm* — Endurance Law Group PLC

(57) ABSTRACT

HVAC systems and methods for delivering highly efficient heating and cooling using ambient air as the working fluid. A plenum has an upstream inlet and a downstream outlet, each in fluid communication with a target space to be heated or cooled. Ambient air is drawn into the inlet at an incoming pressure and an incoming temperature. The inlet and outlet are gated, respectively, by first and second rotary pumps. A heat exchanger in the plenum transfers heat into or out of the air, provoking a change in air volume within the plenum.

(Continued)

The systems and methods are configured to operate essentially between the working temperatures, $T_{HIGH}$ and $T_{LOW}$. This technique, called Convergent Refrigeration or counter-conditioning, provides for the reduction of excess refrigerant lift by optimization of the heat transfer temperature. Two Convergent Refrigeration systems can be arranged back-to-back through a common heat exchanger for ultra-high efficiency operation.

15 Claims, 24 Drawing Sheets

(51) Int. Cl.

| | |
|---|---|
| ***F04C 23/00*** | (2006.01) |
| ***F25B 1/04*** | (2006.01) |
| ***F04C 18/16*** | (2006.01) |
| ***F04C 18/344*** | (2006.01) |
| ***F25B 9/00*** | (2006.01) |

(52) U.S. Cl.
CPC ..... *F25B 9/004* (2013.01); *F04C 18/16* (2013.01); *F04C 18/344* (2013.01); *F25B 1/04* (2013.01)

(58) Field of Classification Search
CPC ..... F04C 2210/221; F04C 29/042; F04C 23/001; F04C 23/003; F04C 18/16; F04C 18/344; F28D 15/02
See application file for complete search history.

(56) References Cited

U.S. PATENT DOCUMENTS

| | | | | |
|---|---|---|---|---|
| 3,640,090 | A | 2/1972 | Ares | |
| 3,807,493 | A | 4/1974 | Stewart | |
| 4,017,285 | A * | 4/1977 | Edwards | F24F 5/00 418/13 |
| 4,295,342 | A | 10/1981 | Parro | |
| 4,333,517 | A | 6/1982 | Parro | |
| 4,429,661 | A | 2/1984 | McClure | |
| 4,600,050 | A | 7/1986 | Noren | |
| 4,706,739 | A | 11/1987 | Noren | |
| 5,035,281 | A | 7/1991 | Neuenfeldt et al. | |
| 5,701,750 | A | 12/1997 | Ray | |
| 5,732,560 | A * | 3/1998 | Thuresson | B64D 13/06 417/408 |
| 5,738,166 | A | 4/1998 | Chou | |
| 5,826,443 | A | 10/1998 | Ares et al. | |
| 6,968,710 | B1 * | 11/2005 | Kozinski | F25B 41/043 181/241 |
| 7,124,585 | B2 | 10/2006 | Kim et al. | |
| 7,322,401 | B2 | 1/2008 | Kim | |
| 8,424,284 | B2 * | 4/2013 | Staffend | F01C 1/3441 123/236 |
| 8,596,068 | B2 * | 12/2013 | Staffend | F01C 13/04 60/620 |
| 2006/0130508 | A1 | 6/2006 | Liu et al. | |
| 2006/0243423 | A1 | 11/2006 | Giacoma | |
| 2010/0005831 | A1 | 1/2010 | Vaisman et al. | |
| 2012/0298334 | A1 | 11/2012 | Madaffari et al. | |
| 2013/0056177 | A1 | 3/2013 | Coutu et al. | |
| 2013/0294890 | A1 | 11/2013 | Cepeda-Rizo et al. | |
| 2014/0053558 | A1 | 2/2014 | Staffend et al. | |

OTHER PUBLICATIONS

Shaobo et al., "An open Reversed Brayton cylce with Regeneration Using Moist Air for Air Conditioning Cooled by Circulating Water," Procedia Environmental Sciences 11 (2011) 733-740.

White, "Thermodynamic Analysis of the Reverse Joule-Brayton Cycle Heat Pump for Domestic Heating", Hopkinson Laboratory,Cambridge University Engineering Department, Trumpington Street, Cambridge, CB2 1PZ, UK, Preprint submitted to Elsevier Preprint Feb. 13, 2009.

W. Goetzler et.al, Navigant Consulting, Inc., Prepared for U.S. Department of Energy, Office of Energy Efficiency and Renewable Energy Building Technologies Office, "Energy Savings Potential and RD&D Opportunities for Non-Vapor-Compression HVAC Technologies" Mar. 2014.

* cited by examiner

HIGH EFFICIENCY HEATING AND/OR COOLING SYSTEM AND METHODS

CROSS REFERENCE TO RELATED APPLICATIONS

This application claims priority to Provisional Patent Application No. 61/256,559 filed Oct. 30, 2009.

BACKGROUND OF THE INVENTION

Field of the Invention

Thermodynamic systems and methods for selectively heating and/or cooling a target space, and more particularly such a thermodynamic system in which ambient air comprises the working fluid.

Description of Related Art

Heating, Ventilating, Air Conditioning and Refrigeration (HVACR) is the technology of low temperature preservation and environmental comfort within a sheltered area. Simply stated, the goal of HVACR is to provide thermal comfort within a controlled space, such as within a refrigerator/freezer, a residential structure, a hotel room, banquet and entertainment facilities, in industrial and office buildings, on board marine vessels, within land vehicles, and in air/space ships to name but a few.

A conventional HVAC system is depicted schematically on the right-hand side of FIG. 8, with a corresponding Temperature-Time graph shown on the left-hand side. The vapor compression cycle is carefully designed to control the temperature of each evaporation or condensation boiling point of the working fluid (i.e., the refrigerant) along its circuitous closed-loop. The temperature at each boiling point is controlled by the refrigerant pressure. Condenser pressure is elevated between locations 3 and 4 (as shown in FIG. 8) so the refrigerant temperature is also higher. Compression raises the temperature of the vapor well above its condensing temperature so most of the heat may be shed at temperatures above the condensing temperature. Lowering the evaporator pressure between locations 1 and 2 reduces both the refrigerant temperature and its boiling point. The evaporator will consequently accept heat when the environment presents heat at temperatures above this lower evaporation temperature. Compressing the vapor from locations 2 to 3 reduces both the evaporator pressure and temperature while simultaneously increasing both the condenser pressure and temperature. Energy spent compressing the vapor enables heat rejection at the higher temperature. Work input to the vapor compression cycle is provided exclusively by compressing the vapor. This compression must be performed exclusively in the gas phase to avoid damaging the compressor.

Every viable refrigeration system must have a heat source target space and a heat sink target space. The refrigeration task is to move heat from the target space of the heat source to the target space of the heat sink. The term "target space" refers broadly to any space that is served by a refrigerant, for heating, ventilating and/or air conditioning. Thus, broadly, the term "target space" includes both of the inside and outside ambient air environments which are served and/or used by the refrigerant.

Stepping through the vapor compression cycle depicted in FIG. 8 more precisely, heat is to be moved from the low temperature target space at $T_{LOW}$, into the higher temperature target space at $T_{HIGH}$. These two working temperatures measure the refrigeration task, the temperature difference between the heat source and the heat sink. Vapor compression is the method used by modern refrigeration and air conditioning systems to control a two-phase refrigerant (liquid and vapor) at two different boiling points. By regulating the pressure in two separate zones it is possible for the refrigerant to deliver both a low temperature boiling point where latent heat is acquired by evaporation and a higher temperature boiling point where latent heat is rejected in condensation. By raising the pressure of the condensing region above the pressure of the evaporator, heat can be removed from ambient air of the first target region, $T_{LOW}$, and rejected into the ambient air of the second target region at a higher temperature, $T_{HIGH}$. To satisfy nature's requirement that heat can flow only to a lower temperature, the refrigerant evaporator temperature, $T_{evap}$, must be established below $T_{LOW}$. As vapor compression raises refrigerant pressure and temperature adiabatically, compression correspondingly also raises the refrigerant's condensation temperature. This higher second boiling point provides for the rejection of the latent heat of fusion when the vapor condenses. The refrigerant condensing temperature, $T_{cond}$, is necessarily set above the second target temperature, $T_{HIGH}$, to enable the rejection of heat from $T_{cond}$ into what is then the relatively lower temperature of $T_{HIGH}$.

In order to measure this work and its results, various industry associations and standards bodies around the world define Rating Points. Rating Point protocols standardize the measurement of refrigerants including parameters for the mechanical systems within which they circulate. Outdoor temperatures range from 27° C.-55° C. while indoor temperatures range from 20° C.-27° C. Only the currently mandated replacement refrigerant, R410A, will be discussed here. FIG. 8 shows an example in which the outside air temperature is $T_{HIGH}$=35° C., and the inside air temperature is $T_{LOW}$=23° C. Note: the inside air temperature, $T_{LOW}$, represents the ambient room temperature within the heat source target space which is to be refrigerated, in this case being cooled. In the US, this outside temperature, 35° C., defines the 95° F. Rating Point. Inside air is separated from outside air by a partition such as a wall dividing the inside target space from an external or exterior region. The refrigeration task is $T_{HIGH}-T_{LOW}$=35° C.−23° C.=12° C. The refrigeration task itself is small compared to the temperature difference required between the evaporator and condenser, called the refrigerant lift. This refrigerant lift, $T_{cond}-T_{evap}$=55° C.−3° C.=52° C. as shown in the example of FIG. 8, is 4.3 times larger than the refrigeration task ($T_{HIGH}-T_{LOW}$) at the 95° F. Rating Point.

Heat can be perceived as always flowing downhill, that is from a higher temperature to a lower temperature. The amount of excess refrigerant lift needed is determined by the needed approach air temperature differential on both sides of the refrigeration task. Because this Approaching Temperature is more specifically the difference between the temperature of approaching air and the refrigerant temperature it will be identified in the following as the approaching Air to Refrigerant Temperature Differential or A-RTD. Refrigerant alone creates the needed temperature differential because the approaching ambient air temperature does not change until it comes in contact with the different temperature of the refrigerant, through the heat exchanger. Refrigerant alone creates the needed temperature differential by moving evaporator and condenser temperatures outward beyond the refrigeration task ($T_{HIGH}-T_{LOW}$). $T_{evap}$ is necessarily always lower than $T_{LOW}$. $T_{cond}$ is necessarily always higher than $T_{HIGH}$. The size of this approaching A-RTD controls the rate of heat transfer with the heat exchanger to and from environmental air. The excess refrigerant lift is set to transfer heat into the air flows of the target environment at speeds near the system capacity, so the air vs. refrigerant temperature differential is optimally about 20° C. for present technology. The total A-RTD on both sides then presents a total excess refrigerant lift of 40° C. beyond the refrigeration task at whatever temperatures $T_{HIGH}$ and $T_{LOW}$ happen to occupy at the time.

In practice, room temperature is usually determined by the preference of the room's occupants. The occupants express their choice for personal comfort by setting the thermostat, $T_{LOW}$ as shown in FIG. 8, at the desired level. Hundreds of years before air conditioning, Room Temperature was defined by European convention at 20° C., which coincided with the generally accepted ideal drinking temperature for red wine. However, changing social norms for clothing and human comfort around the world now recognize a Room Temperature of 23° C.

It may be helpful at this stage to define the terms "sensible heat" and "latent heat." When changes in heat content cause changes in temperature, the heat is called sensible heat. When the addition or removal of heat does not change the measured temperature but instead contributes to a change of state, the change in heat content is called latent heat. A pound of liquid water changes temperature from 32° F. (its freezing point) to 212° F. (its boiling point) with the addition of a mere 180 Btu/lbm of (sensible) heat. No surprise, since the British thermal unit is actually defined by the amount of heat required to change the temperature of one pound of water by one degree Fahrenheit. Moving that same pound of water at 212° F. from the liquid state to the vapor state still at the same temperature of 212° F. however, requires an additional 970 Btu/lbm of (latent) heat. Only after 100% of the liquid water molecules have been vaporized will the temperature of the water vapor then begin to rise above 212° F. In other words, in transition to the vapor state, each molecule of water will store 5.39 times more heat than is needed to move that same molecule from 32° F. to 212° F., from freezing to boiling, and it stores all this latent heat without changing temperature.

In the USA, the internationally recognized standard room temperature of 23° C. would be stated in Fahrenheit as 73.4° F. But the internationally recognized standard room temperature is not recognized as room temperature in the USA. Commercial interests in the USA have re-defined room temperature to circumvent regulations at the expense of human comfort. The American Society of Heating, Refrigerating, and Air-Conditioning Engineers (ASHRAE) raised the "industry accepted" definition of Room Temperature to 80° F. as the industry response to (regulated) consumer demand for increased efficiency. By turning thermostats up 7° F., ASHRAE could report a sensible heat capacity improvement while leaving everything in the mechanical performance of the equipment they sold entirely unchanged. This sleight of hand allowed the HVAC industry to raise $T_{evap}$, without cutting the Approaching Temperature. The industry's claim of energy improvement was delivered in appearance only and not in fact. The same inside Approaching Temperature differential of 20° C. was maintained by turning up the heat on people, human occupants, in order to reduce the excess refrigerant lift. Instead of cooling the occupants as before, they warmed things up to cut the energy needed to cool the evaporator as well. The industry gets to look good no matter how much the occupants feel bad. Of course the occupants can still turn their thermostats down where they want them. That does not translate into any adverse consequences for the industry.

This change in the Room Temperature standard created a significant new problem where individuals choose to comply with the industry's energy stipulation of the higher thermostat setting now at 80° F. Raising the evaporator temperature also cuts the amount of humidity removed. In other words, the higher $T_{evap}$ increases relative humidity in the inside target space, i.e., the controlled space occupied by people. Stated as the Sensible Heat Ratio, the fraction of total cooling capacity delivered as sensible heat was thereby increased without cost or technical advancement. Raising $T_{evap}$ directly cut the amount of condensation. Smaller amounts of total cooling capacity literally ran down the drain as cold water. But higher levels of temperature and humidity have supported epidemic increases in mold, fungus, and dust mites, sick building syndrome, and even Legionnaire's Disease. Yet ASHRAE continues to advertise and rate systems based on sensible heat capacity alone.

ASHRAE also stipulates that the energy expended in moving the inside air mass is not to be included in reports of system performance. Regardless of the fact that inside mass air flow must be reported and maintained, ASHRAE Standard 27-2009 stipulates that the energy needed to move this mass flow of air is not to be recorded. Refusal to account for the cost of this inside air movement data is claimed to be justified by the wide range of home ducting air resistance. Omitting the energy cost of moving the entire mass flow of inside air makes it possible to substantially overstate the performance of all units on sale in the USA.

As shown in FIG. 8 for the 95° F./35° C. Rating Point, the outside Approaching A-RTD is $T_{cond}-T_{HIGH}$=55° C.−35° C.=20° C. This 20° C. outside Approaching A-RTD mirrors the inside Approaching A-RTD as well.

The inside operating costs, which include the resistance to moving air through the unpredictable routing of building ducts, is difficult to assess with any degree of confidence. In contrast, the outside or "air side" operating cost can be more consistently estimated. Because the outside fan is more nearly comparable to blowing air through a hole in the wall after it draws the air through a fin-and-tube heat exchanger whose design is integral to the unit being rated, the cost of moving a chosen mass flow of air through the fins of the outside heat exchanger is normally included when measuring the rated performance of a residential split system at the 95° F. Rating Point. Total efficiency may be increased up to a maximum by increasing the mass flow of air, when refrigerant side mass flow is held constant.

Increasing the Approaching A-RTD, will also increase the rate of heat transfer. In the best of all possible worlds, nature provides the desired cooler outside temperatures. In any real world where air conditioning is needed both the inside and the outside ambient temperatures are given by conditions outside the control of the refrigeration engineer. The only means of increasing the Approaching A-RTD is to change the refrigerant temperature, increasing the excess refrigerant lift. The losses of increasing excess refrigerant lift (pressure ratio) always overwhelm the gains, but it is a necessary evil up to a point. The two mass air flow rates, the two Approaching Temperatures, and the pressure ratios are inter-dependent and the incremental benefits related to each are not linear.

In order to optimize the design of air-side operating efficiency, it would be necessary to manage the trade-offs among three separate subsystems: heat exchanger, refrigerant compressor, and external air blower. Observe that all three subsystems (heat exchanger, refrigerant compressor, and external air blower) are mirrored by similar components which exist in both the inside target setting and in the outside target setting as well. Optimization would further necessitate the inclusion of a real time controller to adapt as conditions change. Compressor and blower efficiencies appear to have plateaued in recent decades. The size of the heat exchanger is sometimes increased to reduce operating costs. This raises the purchase price and justifies the report of increased operating efficiency, but adding fins and tubes does not improve the underlying technology. As was the case with ASHRAE's surreptitious re-setting of the room temperature datum to a higher value, the industry claims to have increased efficiency in spite of the fact that the technology and its performance remain unimproved.

The preceding description thus reviews the basic tenants of vapor compression technology accompanied by the mandatory approach air temperature differentials required to sustain heat transfers on both sides of a closed loop system like that depicted in FIG. 8. The dependence on excess refrigerant lift in vapor compression (and indeed in all known refrigeration technologies) supports the identification of all known refrigeration systems as "divergent" refrigeration systems. They are divergent because they secure heat transfer by moving the refrigerant temperature some distance outside the range of the refrigeration task. Because the laws of Carnot physics consequently dictate that the refrigerant must be lifted from $T_{evap}$ to $T_{cond}$, an amount substantially greater than the difference between the two working temperatures, $T_{LOW}$ and $T_{HIGH}$, the refrigerant lift temperatures, $T_{evap}$ to $T_{cond}$, are said to diverge. Indeed, the Approaching Air to Refrigerant Temperature Differential will always diverge from $T_{HIGH}$ and $T_{LOW}$, because the temperature of the approaching air will not change before it comes in contact with the refrigerant. This is the necessary condition for heat transfer and hence for refrigeration to occur.

All such divergent refrigeration systems lift the temperature of the refrigerant from the lowest refrigerant temperature (defined to be below $T_{LOW}$) by an amount equal to the chosen Approaching A-RTD. In vapor compression systems, this temperature differential is created by setting the temperature of the refrigerant in the evaporator, $T_{evap}$, below $T_{LOW}$ by an amount equal to the engineered Approaching A-RTD. The refrigerant must then be lifted to the highest refrigerant temperature, $T_{cond}$, correspondingly above $T_{HIGH}$ by an amount also equal to the Approaching A-RTD. In vapor compression systems $T_{cond}$ is the temperature of the refrigerant boiling point in the condenser. For residential and commercial air conditioning, ASHRAE standards set the Approaching Air-Refrigerant Temperature Differentials near 20° C. beyond both sides of the working temperatures. The working temperatures themselves are commonly separated by less than 20° C. in most climates so the total refrigerant lift exceeds three times (3×) the difference between the working temperatures. Thermodynamically, the consequences are far more severe as mathematically demonstrated below. (NOTE: Evaporator and Condenser temperatures must be translated from Celsius into the absolute temperature Kelvin scale, where Kelvin=Celsius+273.)

The limiting value of the Coefficient of Performance (COP) is defined thermodynamically by the following equation:

$$COP=T_{LOW}/(T_{HIGH}-T_{LOW})$$

Using the numbers previously established by ASHRAE (and certified by NIST) for the 95° F. Rating Point, the best possible COP attainable between the two working temperatures can be calculated as:

$$COP=296/(308-296)=24.6$$

But after accounting for the stated excess refrigerant lift, where the condenser temperature is 55° C. and the evaporator temperature is 3° C. (FIG. 8), the best attainable COP drops dramatically:

$$COP=276/(328-276)=5.3$$

In the late 1990s, the EU threatened a complete ban on CFC/HCFC refrigerants. About the same time, Normalair Garrett Limited of Yeovil, Somerset, England, now a wholly owned subsidiary of Honeywell International Inc., launched a commercial closed loop air cycle refrigeration system demonstrating life cycle costs competitive with vapor compression. Still in use on some German bullet trains, this closed loop air cycle system has not enjoyed further commercial adoptions. Because the turbine pumping losses characteristic of all "reverse Brayton Cycle" refrigeration systems are substantially higher than the vane and piston pump losses used in vapor compression, air cycle operating costs are typically considered unacceptably high among those of skill in the HVAC community. The academic community uniformly describes the pumping losses in such systems as excessive.

In contrast, the open air cycle systems have some attractive attributes. Of course, harmful refrigerants are avoided when ambient air is used as the refrigerant. An open air cycle offers the possibility for eliminating excess refrigerant lift on one side of the cycle. By using ambient air as the refrigerant, the open air cycle is already in possession of all the heat at its ambient working temperature so it requires no excess refrigerant lift at the working temperature where it originates. Half of the excess refrigerant lift with its attendant penalty is thereby avoided. The air temperature must nonetheless be lifted beyond the opposite working temperature by the needed excess refrigerant lift. To accomplish this, open loop air cycle systems nonetheless routinely require pressure ratios of about 2.5 or above, in spite of the fact that they inherently cut the excess refrigerant lift in half.

Despite the favorable attributes of the open loop air cycle, the routinely high pressure ratios (about 2.5 or above) necessarily incur unacceptably high operating losses. All devices heretofore proposed for open air cycle applications have been characterized by these prohibitively high pumping losses. A variety of alternative mechanisms have been proposed for open loop systems. But just like the turbines used in the closed cycle system of Normalair Garrett, the same problems with pumping losses have kept all proposed mechanisms from approaching commercial viability. All devices heretofore proposed for open air cycle refrigeration, as expected, fall within the category of divergent refrigeration as defined above so they necessarily all pay the same penalties for excess refrigerant lift. For example, U.S. Pat. No. 5,732,560 to Thuresson, granted Mar. 31, 1998, proposes to overcome friction with a rotary screw machine apparently made to function at pressure ratios near 2.5. In another example, U.S. Pat. No. 4,429,661 to McClure, granted Feb. 7, 1984, proposes a divergent refrigeration system that rejects heat into elevated temperatures using a single compressor. U.S. Pat. No. 6,381,973 to Bhatti, granted May 7, 2002, forthrightly relies on the production of what the Bhatti patent calls "very cold air" by turbines. Because Bhatti's ambient air is heated to a temperature well above the automobile engine compartment, as is needed to reject heat there, the exit temperature is substantially below freezing. The divergent refrigeration pressure ratio here is necessarily at or above 3.

U.S. Pat. No. 3,686,893 to Edwards, granted Aug. 29, 1972, describes yet another divergent refrigeration system based on an open air cycle. Edwards' pressure ratios correspondingly range from 2.5 to 4 and higher. Importantly, Edwards has published engineering results corresponding to his patented system (Analysis of Mechanical Friction in Rotary Vane Machines, Purdue e-Pubs, 1972). This publication acknowledged a measured COP of 0.45 with what Edwards calls a "volume ratio" of 2.5. Research indicates that after decades of development, the inventor of the aforementioned U.S. Pat. No. 3,686,893 (Edwards) shifted attention from the automotive open air cycle system (pressure ratio 2.5), toward more promising use in compressing standard refrigerants (e.g., R114) at pressure ratios near 4 and above. (The Controlled Rotary Vane Gas-Handling Machine, Purdue ePubs, 1988.) Edwards succeeded in reducing pumping losses for his device only at these higher pressure ratios. Subsequently, the published literature suggests that Edwards abandoned the open loop air cycle altogether in favor of conventional closed loop vapor compression split residential systems, a strong indicator that the open air cycle concepts embodied in U.S. Pat. No. 3,686,893 could not be successfully commercialized.

Another example is US2013/0294890 by Cepeda-Rizo, published Nov. 7, 2013. (The Applicant does not admit that Cepeda-Rizo is prior art to subject matter disclosed herein which rightfully claims the benefit of an earlier filing date.) The Cepeda-Rizo reference offers a fundamentally fresh approach to overcoming the well-defined set of deficiencies associated with open air cycle divergent refrigeration systems. Previous open air cycle divergent refrigeration systems proposed either high speed turbines characterized by leakage at low pressure ratios or multiple-vane pumps characterized by high friction loads. Cepeda-Rizo offers an adaptation of the legendary Tesla Turbine (concept, never successfully reduced to practice) asserting that its operating problems can be overcome at the pressure ratio of 2.5. If ultimately successful in overcoming the additional new challenges that Cepeda-Rizo will demand from the Tesla Turbine, Cepeda-Rizo acknowledges the best case theoretical COP of 1.5 and only an abysmal 0.4 COP overall.

The COP also provides a theoretical best case standard for comparison to actual equipment. COP, which is dimensionless, may be computed as the quotient of a relative temperature difference or as heat moved divided by work performed, heat and work being interchangeable in this context. In addition to test conditions already defined at the 95° F. Rating Point, the Energy Efficiency Ratio (EER) adds a standard for coping with differences in relative humidity. That being said, the EER is always proportional to the COP. Expressed mathematically, EER=COP*3.41. The Seasonal Energy Efficiency Ratio (SEER) applies a profile of temperature and humidity to match a range of climatological expectations. Nonetheless, it all comes back to COP which can thus be used to baseline comparisons between present known technology and proposed new solutions.

The National Institute of Standards and Technology (NIST) published a comparison of performance for refrigerants R410A and R22 across a range of temperatures. Compared to the best theoretical performance for lifting the refrigerant from 3° C. in the evaporator to 55° C. in the condenser, best case COP=5.3, NIST observed COPs as low as 3.93 ("*Properties and Cycle Performance of Refrigerant Blends Operating Near and Above the Refrigerant Critical Point*", Task 2: Air Conditioner System Study Final Report by Piotr A. Domanski and W. Vance Payne, published September 2002 by National Institute of Standards and Technology Building and Fire Research Laboratory, APPENDIX B. SUMMARY OF TEST RESULTS FOR R410A SYSTEM.), dropping to 1.06 at an outside temperature of 68° C. This is the consequence of the compressor having to work harder to increase condenser pressure, hence system pressure ratios, as required to maintain the needed excess refrigerant lift for temperatures at or near the critical point of R410A or whatever refrigerant is being used. At temperatures above the critical point, a refrigerant will no longer condense. Maintaining the same Approaching Air to Refrigerant Temperature Differential as outside temperatures rise is crucial because the presumed benefits of latent heat progressively disappear as temperatures approach the R410A refrigerant critical temperature.

The contribution of latent heat disappears altogether above the critical point. For R410A the critical point is 161.83° F. or 72.13° C. Above this point the vapor will not condense. A benchmark of latent heat contribution at the 95° F. Rating Point provides an informative reference. Enthalpy numbers for the Pressure vs. Enthalpy graph of FIG. 9 are provided by DuPont in R410A bulletin: T-410A-ENG. The compressor entry temperature of 57.64° F. is published by NIST, Domanski and Payne, 2002 (Id.). The Net Refrigeration Effect of R410A is 54.0 Btu/lbm at the 95° F. Rating Point. For reference, the latent heat of 54 Btu/lbm is 5% of the 970 Btu/lbm latent heat of water, rather modest by comparison. The enthusiasm for using latent heat might well be adjusted accordingly. The latent heat delivered in the condenser is only 53.6 Btu/lbm, which is 0.4 Btu/lbm less than the Net Refrigeration Effect in the evaporator. Consequently, there is no net contribution of latent heat at the 95° F. rating point. It may surprise some that the entire refrigeration task is performed exclusively in the gas phase with all the attendant annoyances of maintaining two boiling points and liquids. Stated again for emphasis, FIG. 9 graphically shows that all net refrigeration of the presently mandated refrigerant is delivered exclusively in the vapor phase when outside temperatures exceed 95° F.

The Pressure vs. Enthalpy graph of FIG. 9 fails to show the elevated temperatures that enable more than half of the total Heat of Rejection (HOR) to be shed at temperatures significantly above the condenser temperature. Called "Superheat", this principle working capability of vapor-compression systems is in the vapor phase only. Superheat is acknowledged as a fundamental heat transfer advantage in the vapor-compression systems because of the very large approach air temperature differential. The substantial increases in Approaching Air to Refrigerant Temperature Differentials are never identified in the meticulously detailed "degree by degree" refrigerant performance tables. Nor is Superheat properly scaled on the Reverse Rankine Cycle T-s diagrams, as shown by the example in FIG. 10. Actual superheat is represented by the rising dotted line in FIG. 10 as it transits the Pressure Ratio of 3.93 (marked by vertical reference line). The entire refrigerant lift and all of the added work are handled exclusively as a gas, in the vapor phase. Importantly, as the condenser temperature approaches the critical temperature, the contribution of latent heat goes to zero. Above the critical temperature, all of the heat is rejected in the vapor phase at temperatures far above the nominal condenser temperature. Without this high temperature gas-only heat rejection, vapor compression refrigeration would be useless even in temperate climates. Without going to the Arabian desert, prevailing summer temperatures in the USA from southern states like Florida, Texas, New Mexico, Arizona, and southern California all drive vapor compression technology well beyond any contribution that may be offered by the latest two-phase refrigerants. Their continued use is driven only by the passionate and irrational beliefs of their advocates and commercial adherents. The unarguable truth is that refrigeration in warmer regions has been for decades already a vapor only, in other words a "gas phase only" refrigeration, reality.

The compressor discharge temperature shown in FIG. 9, 151.7° C.=305.0° F., delivers a dramatic increase in the refrigerant lift which is neither measured nor even reported in refrigeration tables. The ascending dotted line in FIG. 10 shows the increase in compressor discharge temperatures as condenser pressure is increased to 495.5 psia (FIG. 9), required at the 95° F. Rating Point. The corresponding Pressure Ratio of 3.93 at that point is discussed below. Obviously both pressures and discharge temperatures continue to increase sharply as outside temperatures rise above 95° F.

The descending dashed line in FIG. 10 traces the cooling opportunity that could be recovered from an expanding gas, an opportunity foregone by the behavior of the two phase refrigerant. No energy is recovered from the expanding gas in the evaporator. The opportunity to enjoy the exceedingly beneficial refrigerant lift (refrigerant temperature reduction) that mirrors high temperature discharge from the compressor (superheat) is lost as well.

These measures fail to include the cost of moving the entire heat load into and out from the target environments with fans. Fans (or blowers) deliver the entire mass flow of air needed to move this heat twice, once on either side of the refrigerant loop. The energy cost of operating fans and blowers to provide the mass flow of air required on both the heat source (supplying) and heat sink (supplied) sides of the vapor compression heat exchangers is not reported in the conventional published cycle charts. The conventions of thermodynamics simply define these costs to be outside the definition of their system. Correspondingly, the numbers reported in FIG. 9 reflect the cost and operating values within the refrigerant loop exclusively—excluding external fans and blowers.

By restating the refrigeration problem with a wider boundary, recognizing the participation of target space air movement across the evaporator and condenser, it is possible to acknowledge the impact of several unavoidable problems. Being outside the thermodynamic boundaries of a closed loop refrigeration system, the latent heat regime is neither challenged nor charged commercially with the penalties that necessarily accrue. Correctly accounting for these inherent and unavoidable penalties can be focused into four problems: specific heat, pressure, pressure ratios, and humidity.

First problem, specific heat. Because R410A operates at or near the critical point, the contribution of latent heat is sharply reduced while contributions from sensible heat increase to take over completely as the refrigerant approaches "vapor phase only" temperatures in the condenser. The specific heat for R410A in the evaporator is less than 0.1953 Btu/lbm. The specific heat of air is 0.240 Btu/lbm. Air has a 23% higher specific heat than R410A, providing an attractive alternative to any refrigerant that fails to supply substantial contributions from latent heat.

Second problem, pressure. The higher operating pressures of R410A have troubled its introduction, compelling the replacement of the R22 systems equipment in total, rather than merely replacing their refrigerant. The R410A systems cost more and are more expensive to maintain. Indeed, far more expensive refrigerants accompanied by far more demanding mechanical systems are being introduced with barely incremental performance gains, if any at all.

Third problem, pressure ratios. Higher pressure ratios are defined by increased compression work and necessarily higher energy costs as pressure ratios increase. The relatively high Pressure Ratio for operating R410A refrigerant loops is increasingly problematic from the energy consumption point of view. At the chosen Rating Point (95° F.=35° C.) the resulting Pressure Ratio is 3.93 rising quickly above 4 with warmer outside temperatures as shown in FIG. 10. Pressure ratio may be stated mathematically by the equation:

$$P_{comp}/P_{evap}=(495.5\text{ psia})/(126.07\text{ psia})=3.93$$

To establish a reference for compression work needed in the R410A refrigerant loop, FIG. 11 shows the work components and resultant net work with COP for a Brayton Cycle across a broad set of pressure ratios. As noted previously, the work input to a vapor compression process is performed exclusively on the vapor; strictly a gas phase compression which shows as the thin upper line. Because the refrigerant returns as a liquid, there is no gas phase expansion work to offset the compression work performed on the R410A refrigerant. Consequently, the work of expansion cannot be extracted mechanically and subtracted from the work of compression. Because there is no expansion work to be subtracted from the compression work, the compression-only work necessarily increases much more rapidly as pressure ratios rise. No work is extracted as the liquid is returned to the lower pressure. And no work is extracted during the change of phase back to vapor. Instead additional work is needed to provide "suction" from the compressor in order to maintain the low pressure of the evaporator as the newly evaporated gas expands. The mechanics of vapor compression have more than just sacrificed the opportunity to extract expansion work from vaporization. The Reverse Rankine Cycle "steam engine" potential is lost to free expansion.

Fourth problem, humidity. As humidity rises, performance drops precipitously due to the previously acknowledged high latent heat of water. The process of cooling air often results in cooling the air below its dew point, precipitating water which is discarded as waste, typically consuming 20%-35% of total cooling capacity. This was discussed in some detail above in relation to the inside approach air temperature. The Rating Point model calls for raising the temperature of recirculated inside air by about 10° C., a sensible heat of 18 Btu/lbm. This strategy avoids a considerable cost for removing humidity. Condensing water vapor consumes the full 970 Btu/lbm, 970/18=53.9 times more than the cost of cooling dry air by 10° C. There is no cooled air to show for this considerable expenditure of energy. Quite the opposite. The entire cooling load of condensation runs down the drain as chilled water, after having released the full 970 Btu/lbm heat of fusion directly into the air stream that is intended to be cooled.

Once the approach air differential is established, the fans on either side of the refrigerant loop become final controls for all heat transfer, limiting or enhancing efficiency. Yet fans and blowers generally operate well below half of their own announced efficiency. FIG. 12 shows the relationship between a fan's theoretical "free air flow" operating performance and its capability once air flow resistance is encountered. Even slight resistance cuts nominal fan efficiency in half or more. FIG. 12 could be typical for the outside unit of a split air conditioning system like that diagrammed in FIG. 8. It should be stressed again that only this outside air movement cost is recognized in the manufacturer's published performance statements.

Fan and blower driven systems raise pressures measured only in inches of water, as shown in FIG. 12. The typical range of fan operating pressures is well below 1 inch of water (0.036 psia) which would be a gauge pressure ratio of 0.036/14.7=0.002, only two thousandths. Blowers in large building systems are powered by many horsepower, yet they seldom reach pressure ratios above 1.1. When compared to FIG. 12 it can be seen that their efficiency should be very high if they were designed and configured as pumps, i.e. compressors at the same ratio moving the same mass flow.

The cost of moving "inside" air is not even recorded, much less acknowledged in commercial statements of operating performance. Estimating the inside (target space) fan or blower resistance of duct work is difficult because it is said that the length and routing of ducts cannot be anticipated or averaged for a residence size matched to the unit capacity. This consideration has been used by the association and manufacturers to justify why the inside air movement cost is omitted from system performance measures. The industry's resistance to acknowledging inside air movement costs stands to fend off regulation in spite of the fact that the industry's sales engineers and jobbers must undeniably size every purchase and installation using estimates from recognized rules of thumb which are universally applied.

Unlike advertising claims which typically emphasize favorable facts and downplay or omit unfavorable details, typical energy requirements for fans and blowers can be found in repair and training manuals. These sometimes more reliable sources of information separate compressor data and air movement costs which are often otherwise unreported. Relevant factors which can be gleaned from these ancillary sources of data include a recognition that air movement energy is reliably proportional to system heating and cooling energy. No one will be surprised to learn that mass flow matches system capacity. Consequently, so-called rules of thumb appear to be reliable and widely accepted. Such rules of thumb, or benchmarks, include the following:

A) Inside mass air flow of 400 CFM is required for a ton of cooling capacity.

B) Energy usage is 1.1 kW/ton at the Department of Energy mandated COP of 3.2.

C) The outside fan uses 10% of reported energy consumption. The compressor alone draws 90%, 0.99 kW/ton. Use 1 kW/ton.

D) Inside air movement energy costs about 2.5 times the outside unit with wide variability, use 0.25 kW/ton.

E) Sensible Heat Ratios are 65 to 80 leaving latent heat losses of 20%-35%. Use 0.30 kW/ton.

Taking all of these things together, state-of-the-art entrenched beliefs favoring two-phase refrigeration solutions fail to recognize the following truths.

1) Latent heat makes no contribution to refrigeration whatsoever above the 95° F. Rating Point.

2) Consequently, all heat rejection at and above the 95° F. Rating Point is provided in the vapor phase.

3) The specific heat of air in the vapor phase is higher than refrigerants in the vapor phase.

4) All heat rejection is delivered at pressure ratios at or above 4.

5) Until recently, vapor compression had been delivered by a primitive single vane pump. Newer refrigerants have mandated a return to multiple piston devices, needed to meet their higher pressure requirements.

6) Compression of air as an alternative to environmentally unfriendly refrigerants has been largely dismissed because: a) it is assumed that the heat capacity of air cannot match the heat capacity of two-phase refrigerants and, b) the pumping losses would be too high to do it anyway.

7) Incredible improvements in COP are available as pressure ratios drop below 2, and to astonishing levels, literally skyrocketing (see FIG. 11) when the pressure ratios drop below 1.4.

8) Commonplace pump designs ranging from 100-year-old vacuum cleaners to 150-year-old Roots Blowers will achieve adequate pumping efficiencies at pressure ratios in ranges near 1.1.

Accordingly, it will be appreciated that there exist substantial opportunities to improve the operating efficiencies of HVACR systems by the recognition and better exploitation of these factors in systems and methods that circulate ambient air from a target space across a heat exchanger and then return that same air back to the target space at a higher or lower temperature.

BRIEF SUMMARY OF THE INVENTION

According to a one aspect of this invention, a system and method is provided for transferring heat between a heat exchanger and a gaseous medium in a thermodynamic system, while implementing a technique referred to as Convergent Refrigeration. A plenum is provided for a gaseous heat transfer medium. The plenum is inlet gated at an upstream location with a first rotary pump. The gaseous medium has an incoming pressure and temperature entering the first rotary pump. The plenum is outlet gated at a downstream location with a second rotary pump. A heat exchanger is operatively located within the plenum in-between the first and second rotary pumps. Heat is transferred into or out of the gaseous medium with the heat exchanger. The heat exchanger has a Heat Exchanger Temperature, and the gaseous medium in the plenum upstream of the heat exchanger has an Approaching Temperature. A particular attribute of this aspect of the invention relates to the step of counter-conditioning the Approaching Temperature by reducing the Approaching Temperature below the Heat Exchanger Temperature when heat is transferred into the gaseous medium from the heat exchanger and elevating the Approaching Temperature above the Heat Exchanger Temperature when heat is transferred out of the gaseous medium to the heat exchanger. The gaseous medium is returned to the incoming pressure within the second rotary pump, and work is harvested directly from at least one of the first rotary pump and the second rotary pump in the process.

This first aspect of the present invention implements the novel technique of counter-conditioning to improve overall efficiency of the system. Counter-conditioning intentionally manipulates the Approaching Temperature, moving the air temperature toward the opposite working temperature rather than away from it as occurs in prior art (i.e., Divergent) systems. By changing the ambient air stream temperature, the Air to Refrigerant Temperature Differential (A-RTD) is increased thereby improving heat transfer with respect to the heat exchanger. The Approaching Temperature is reduced below the Heat Exchanger Temperature when heat is to be transferred into the air from the heat exchanger, and conversely the Approaching Temperature is elevated above the Heat Exchanger Temperature when heat is to be transferred out of the air to the heat exchanger.

According to another aspect of this invention, a system and method is provided for transferring heat from a heat source to a heat sink in a thermodynamic system. In this case, a supply-side sub-system is in thermal communication with ambient air in a heat source, and a delivery-side sub-system is in thermal communication with ambient air in a heat sink. A heat transfer sub-system is operatively disposed between the supply-side sub-system and the delivery-side sub-system for moving heat from the supply-side sub-system to the delivery-side sub-system. Each of the supply-side and delivery-side sub-systems, respectively, provide a plenum having an upstream air inlet and a downstream air outlet. The respective plenums are inlet gated at an upstream location with a first rotary pump. The air to each plenum has an incoming pressure and temperature as it enters the first rotary pump. The respective plenums are outlet gated at a downstream location with a second rotary pump. A heat exchanger is operatively located within the plenum in-between the first and second rotary pumps. Air is moved air across each respective heat exchanger within the plenum, and as a consequence heat is transferred into or out of the air by the heat exchanger. This transfer of heat naturally provokes a change in the volume of the air within each respective plenum. In each sub-system, the first rotary pump is asynchronously operated relative to the second rotary pump so that air exiting the respective outlet is approximately equal to the incoming pressure. And work is harvested directly from at least one of the first and second rotary pumps in response to changes in the volume of the air in the plenum.

This second aspect of the present invention implements a novel dual paired, or back-to-back, arrangement in which two independent sub-systems are located on opposite sides of a shared heat exchanger. Profoundly innovative and unexpected efficiencies are revealed when two such refrigerated air flow sub-systems are arranged back-to-back, to feed and receive heat through a common (passive or active) heat exchanger, thereby dramatically increasing COP (Coefficient of Performance) at all operating temperatures.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
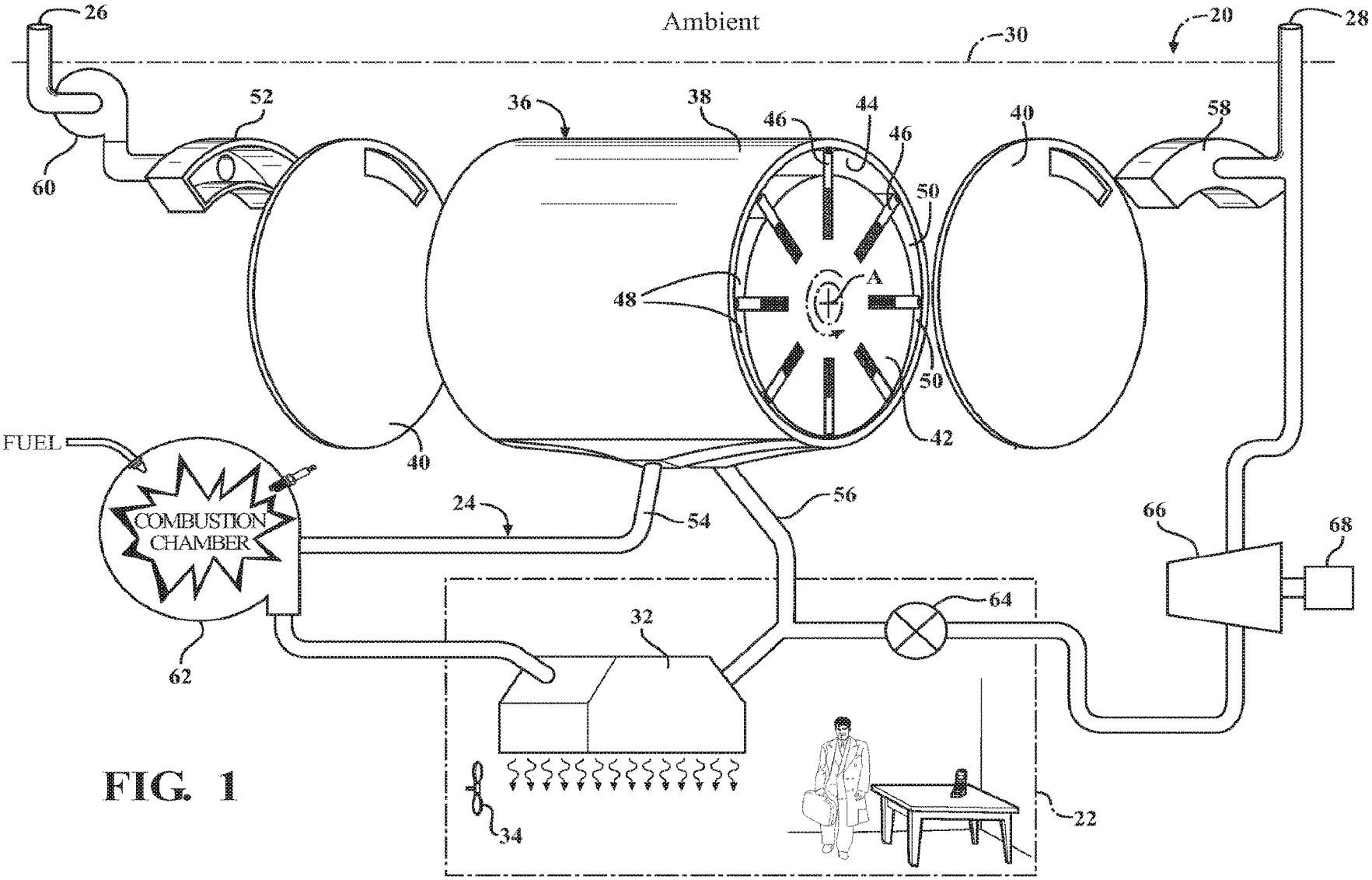
FIG. 1 is a view showing an air aspirated hybrid heat pump and heat engine system according to an embodiment of this invention.

Referring to the Figures, wherein like numerals indicate corresponding parts throughout the several views, one embodiment of the invention is shown in FIG. 1 as an open loop air aspirated hybrid heat pump and heat engine system 20 for selectively heating and cooling a target space 22. The target space 22 can be an interior room in a building, the passenger compartment of an automobile, a computer enclosure, or any other localized space to be heated and/or cooled. The working fluid of the system 20 in this embodiment is most preferably air, however in general the principles of this invention will permit other substances to be used for the working fluid including multi-phase refrigerants in suitable closed-loop configurations.

The hybrid heat pump and heat engine system 20 includes a working fluid (e.g., air) flow path 24, generally indicated in FIG. 1, extending from an inlet 26 to an outlet 28. The inlet 26 receives working fluid (air in this example) from an ambient source 30, while the outlet 28 discharges air from the system 20 back to the ambient environment 30. Preferably, the inlet 26 and outlet 28 are both disposed outside of the target space 22 and in the atmosphere 30 when atmospheric air is used as the working fluid.

A heat exchanger 32 is disposed in the flow path 24 between the inlet 26 and the outlet 28. In the exemplary embodiment of FIG. 1, the heat exchanger 32 is disposed in the target space 22 for transferring heat between the target space 22 and the working fluid in the flow path 24. In a standard heating/cooling mode of operation, the system 20 is configured to either transfer heat from the working fluid to the target space 22 to heat the target space 22 or alternatively to transfer heat from the target space 22 to the working fluid to cool the target space 22. The heat exchanger 32 is preferably a high efficiency heat exchanger 32 having a large surface area, such as by plurality of fins, for convectively transferring heat between air in the target space 22 and the working fluid in the flow path 24. Preferably, a fan 34 or a blower is disposed adjacent to the heat exchanger 32 for propelling the air in the target space 22 through the heat exchanger 32 to assist in the heat exchange between the air in the target space 22 and the air in the heat exchanger 32. Of course, conductive methods of heat transfer can also be used instead of or in addition to convective methods suggested by the fan 34 in the target space 22 in FIG. 1.

In the exemplary embodiment of FIG. 1, a positive displacement rotating vane-type device 36 is disposed in the flow path 24 for simultaneously compressing and expanding the air. The vane-type device 36 includes a generally cylindrical stator housing 38 longitudinally between spaced and opposite ends 40. A rotor 42 is disposed within the stator housing 38 and establishes an interstitial space 22 between the rotor 42 and the inner wall 44 of the stator housing 38. A plurality of vanes 46 are operatively disposed between the rotor 42 and the stator housing 38 for dividing the interstitial space 22 into intermittent compression and expansion chambers 48, 50. The vanes 46 are spring loaded to slidably engage the inner wall 44 of the stator housing 38. Accordingly, the plurality of compression 48 and expansion 50 chambers are each defined by a space between two adjacent vanes 46. As the rotor 42 rotates relative to the stator housing 38, the chambers 48, 50 defined between adjacent vanes 46 sequentially and progressively transition between compression and expansion stages in a continuum so that the working fluid is simultaneously compressed in compression chambers and expanded in expansion chambers. That is to say, at any time during rotation of the rotor 42, working fluid is being compressed in one portion of the device 36 and expanded in another portion of the device 36.

Two arcuately spaced transition points correspond with maximum compression and maximum expansion of the working fluid. In the particular embodiment illustrated in FIG. 1, these transition points occur at the 12 o'clock and 6 o'clock positions of the stator housing 38, with the 12 o'clock position being the point of maximum expansion and the 6 o'clock position being the point of maximum compression. In alternative configurations of the rotary device 36, there may be only one transition point corresponding to either maximum compression or maximum expansion, such as in systems like that shown in FIG. 5 were the compression and expansion functions are carried out in separate devices. Or, there may be three or more transition points where a rotary device incorporates multiple lobes as shown for example in U.S. Pat. No. 7,556,015 to Staffend, issued Jul. 7, 2009, the entire disclosure of which is hereby incorporated by reference. In any case, therefore, the transition points may be defined as the rotary positions where the chambers 48, 50 between adjacent vanes 46 transition between the compression and expansion stages, respectively.

Working fluid ports are provided to move the working fluid into and out of the device 36. In the embodiment illustrated in FIG. 1, the ports include a compression chamber inlet 52, a compression chamber outlet 54, an expansion chamber inlet 56, and an expansion chamber outlet 58. The compression chamber inlet 52 and expansion chamber outlet 58 are located adjacent to the 12 o'clock position transition point corresponding to maximum expansion. By contrast, the expansion chamber inlet 56 and compression chamber outlet 54 are located adjacent to the 6 o'clock position transition point corresponding to maximum expansion. The compression chamber inlet 52 is in fluid communication with the inlet 26 for receiving the atmospheric air, and the expansion chamber outlet 58 is in fluid communication with the outlet 28 for discharging the air out of the flow path 24 to the atmosphere 30. The heat exchanger 32 is in fluid communication with the vane-type device 36 through the compression chamber outlet 54 and the expansion chamber inlet 56.

The compression chamber inlet 52 and the expansion chamber outlet 58 are generally longitudinally aligned with one another relative to the stator housing 38 for simultaneously communicating with the same chamber 48, 50. In other words, the compression chamber inlet 52 and the expansion chamber outlet 58 may be located on opposite longitudinal ends of the stator housing 38 so as to communicate simultaneously with a common chamber or chambers 48, 50. Thus a compression chamber port (inlet 52 in this example) and an expansion chamber port (outlet 58 in this example) are continuously in communication with at least one common chamber at or near a transition point. A pump 60 may be disposed in the flow path 24 between inlet 26 and the compression chamber inlet 52 for propelling the working fluid into the stator housing 38 through the compression chamber inlet 52.

The rotor 42 is rotatably disposed within the stator housing 38 for rotating in a first direction. While the rotor 42 is rotating, the vanes 46 slide along the inner wall 44 of the stator housing 38 and simultaneously reduce the volume of the compression chambers 48 and increase the volume of the expansion chambers 50. In the exemplary embodiment, vane-type device 36 accomplishes the simultaneous compression and expansion because the cross-section of the inner wall 44 of the stator housing 38 is circular and the rotor 42 rotates about an axis A that is off-set from the center of the circular inner wall 44. Alternatively, the stator housing 38 could be elliptically shaped and the rotor 42 could rotate about the center of the elliptical stator housing 38. Other configurations are of course possible, including those described in U.S. Pat. No. 7,556,015 as well as those described in priority document U.S. Provisional Application Ser. No. 61/256,559 filed Oct. 30, 2009, the entire disclosure of which is hereby incorporated by reference and relied upon.

The embodiment of FIG. 1 can operate in a standard heating/cooling mode or in an optional high heating mode. In the standard heating/cooling mode, the pump 60 propels atmospheric air into the vane-type device 36 through the compression chamber inlet 52. The temperature and pressure of the air both increase as the air is compressed in the compression chambers 48 before exiting the device 36 through the compression chamber outlet 54. The pressurized and warmed air flows passively through a dormant combustion chamber 62 and then to the heat exchanger 32 where it dispenses heat to warm the target space 22. Exiting the heat exchanger 32, the cooled by still pressurized air then flows back to the device 36 and enters the stator housing 38 via the expansion chamber inlet 56 at or near the 12 o'clock transition point. The air is directed into the next available expansion chamber 50 where is carried and swept in an expanding volume to depressurize, preferably back to the atmospheric pressure. Available pressure energy in the working fluid is thus released from the working fluid to act on the rotor 42 as a torque and thereby directly offset the energy required on the compression side of the rotor 42 working to simultaneously compress the working fluid in chambers 48.

Next, the air is pushed out of the vane-type device 36 through the expansion chamber outlet 58 by the air entering the vane-type device 36 through the compression chamber inlet 52. Finally, the air is discharged to the atmosphere 30 through the outlet 28. The difference in the pressure of the air entering the expansion chambers 50 and the atmospheric pressure represents potential energy. The expansion chambers 50 of the vane-type device 36 harness that potential energy and use it to provide power to the rotor 42.

The system includes a combustion chamber 62 in the flow path 24 between the compression chamber outlet 54 of the vane-type device 36 and the heat exchanger 32. During the standard heating/cooling mode, described above, the combustion chamber 62 remains dormant. However, during an optional high heating mode, a fuel introduced into the combustion chamber 62 is combusted, or burned, in the working fluid to greatly increase both its temperature and pressure within the flow path 24. The fuel may be any suitable type including for examples natural gas, propane, gasoline, methanol, grains, particulates or other combustible materials.

The compression chambers 48 of the vane-type device 36 compress the air by a first predetermined ratio, and the expansion chambers 50 of the vane-type device 36 expand the air by a second predetermined ratio. In the FIG. 1 embodiment, the first and second predetermined ratios are approximately equal to one another. When accounting for heat transfers and losses, the equal expansion/compression ratios are adequate to extract all available work energy from the fluid during the standard heating/cooling modes of operation. However, following the combustion of air in the combustion chamber 62 during the high heating mode, the pressure of the air in the flow path 24 is substantially elevated such that the vane-type device 36 cannot be expected to fully (or nearly fully) depressurize all of the air in the flow path 24 back to the atmospheric pressure. Therefore, a valve 64 is disposed in the flow path 24 between the heat exchanger 32 and the expansion chamber inlet 56. During the standard heating/cooling mode, the valve 64 directs all of the working fluid in the flow path 24 from the heat exchanger 32 to the expansion chamber inlet 56. During the high heating mode, the valve 64 is manipulated to direct a portion of the working fluid from the heat exchanger 32 to a secondary expander 66 with the remaining portion of the working fluid traveling back to the expansion chamber inlet 56 as before. Thus, in order to improve the energy efficiency of the system, it is advantageous to redirect at least some of the pressurized air from the heat exchanger 32 to the secondary expander 66, which is mechanically connected to an energy receiving device, here an electric generator 68, and reclaimed. The vane-type device 36 and the electric generator 68 work together to capture and convert any residual pressure energy remaining in the working fluid before it is discharged to ambient 30.

In operation, during the high heating mode, the pump 60 propels atmospheric air into the vane-type device 36 through the compression chamber inlet 52. The temperature and pressure of the air both increase as the air is compressed in the compression chambers 48. The pressurized and warmed air then exits the vane-type device 36 through the compression chamber outlet 54 and flows into the combustion chamber 62. In the combustion chamber 62, the fuel is mixed with the air and combusted to greatly increase the pressure and temperature of the air. The air then flows through the heat exchanger 32 where it dispenses heat to warm the target space 22. Next, the valve 64 directs a predetermined amount of the air to the expansion chamber inlet 56 of the vane-type device 36 and the remaining air to the secondary expander 66. In the vane-type device 36, the pressurized air is expanded, preferably to or nearly to the atmospheric pressure, before it is discharged out of the flow path 24 and to the atmosphere 30 through the outlet 28. The air in the secondary expander 66 is also expanded, preferably to or nearly to atmospheric pressure, while powering the generator 68 to produce electricity. After the air is expanded by the secondary expander 66, it is also directed to the outlet 28 to be discharged to the atmosphere 30.

Through reconfiguration, the embodiment of FIG. 1 can also work in a cooling capacity in its standard heating/cooling mode. There are many ways to reconfigure the system. One way to switch the system to the cooling operating mode is to rotate the vane-type device 36 by one hundred and eighty degrees (180°). In another technique, the rotor 42 could be moved in a radially upward direction (i.e., shifted upward) while the stator housing 38 remains stationary. Both of these reconfiguration methods effectively transform the compression chambers 48 into the expansion chambers 50 and vice versa. When operating in the cooling operating mode, the pump 60 first propels the atmospheric air into the expansion chambers 50 of the vane-type device 36 to reduce the pressure and temperature of the air. The combustion chamber 62 is dormant. The cooled air receives heat from the heat exchanger 32 to cool the target space 22. The air is then re-pressurized in the compression chambers 48 of the vane-type device 36, preferably to atmospheric pressure, before being dispensed to the atmosphere 30 through the outlet 28.

Figure 2:
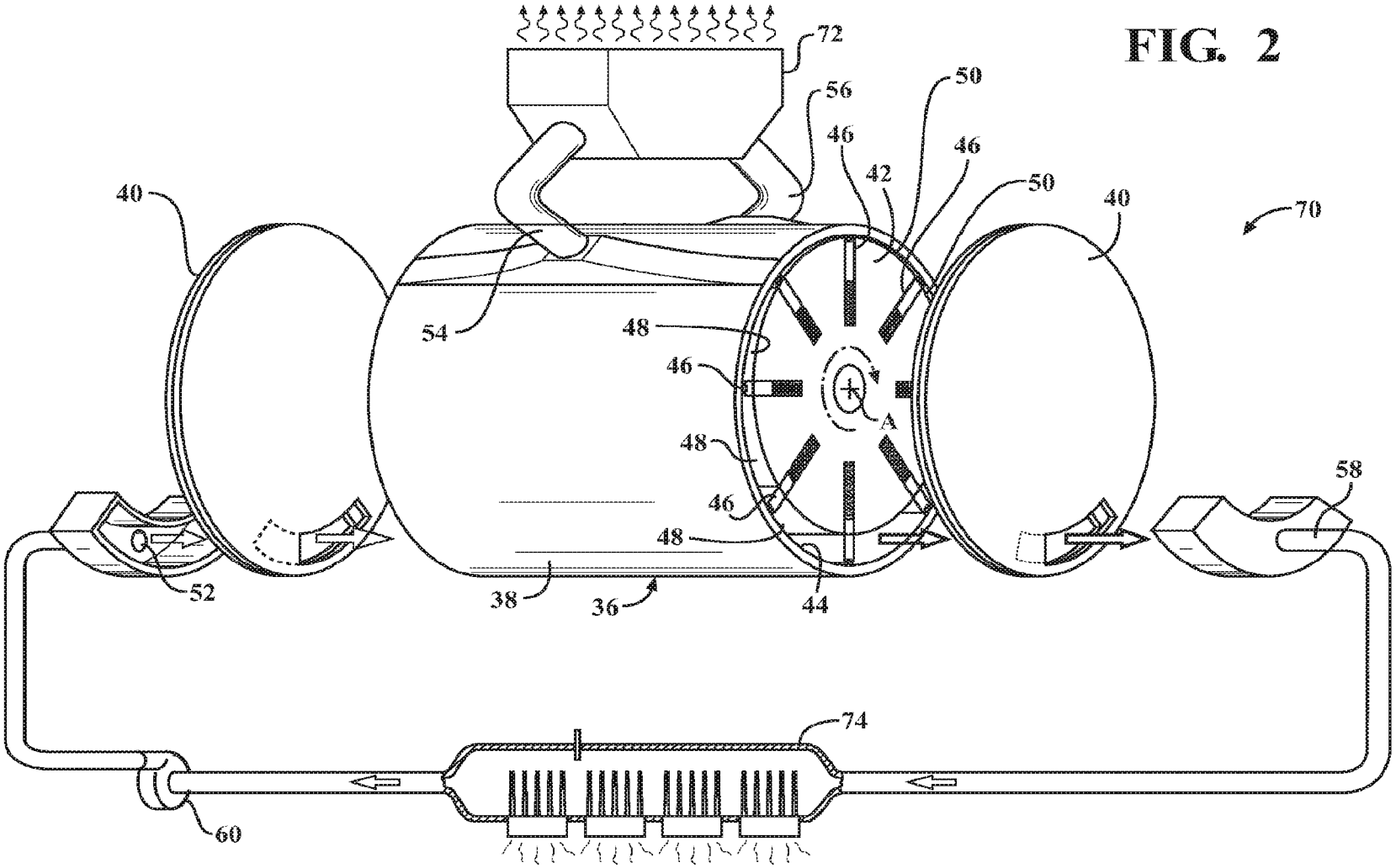
FIG. 2 is a simplified, partially exploded view of a positive displacement rotating vane-type device as in FIG. 1 but configured in a closed-loop arrangement.

The vane-type device 36 can also work in a closed loop system 70, as generally shown in FIG. 2. In the closed loop system 70, the working fluid may be air or a refrigerant. Like the open-loop system of FIG. 1, the compression chamber inlet 52 and expansion chamber outlet 58 are generally longitudinally aligned with one another for simultaneously communicating with the same chamber 48, 50. A high-pressure side heat exchanger 72 is fluidly connected to the vane-type device 36 through the compression chamber outlet 54 and the expansion chamber inlet 56. A low-pressure side heat exchanger 74 is fluidly connected to the vane-type device 36 through the expansion chamber outlet 58 and the compression chamber inlet 52.

The closed loop system 70 FIG. 2 has two operating modes: a first operating mode and a second operating mode. Either the high pressure side heat exchanger 72 or the low-pressure side heat exchanger 74 may be disposed in a target space 22 to be selectively heated or cooled or outside of the target space 22 in the atmosphere 30.

In the first operating mode, the rotor 42 rotates in a first direction, causing the pressure and temperature of the working fluid in the compression chambers 48 to increase as the volume of those compression chambers 48 decreases. That working fluid then flows into the high-pressure side heat exchanger 72 where it dissipates heat to either the target space 22 or the atmosphere 30. The pressurized and cooled working fluid then flows into the expansion chambers 50 through the expansion chamber inlet 56. In the expansion chambers 50, the temperature and the pressure of the working fluid decrease as the volume of the expansion chambers 50 increases. The working fluid leaves the expansion chambers 50 through the expansion chamber outlet 58 and flows to the low-pressure side heat exchanger 74. In the low-pressure side heat exchanger 74, the working fluid receives heat from either the target space 22 or the atmosphere 30 before flowing back into the compression chambers 48.

Similar to the open loop embodiment of FIG. 1, the vane-type device 36 of FIG. 2 can be switched to the second operating mode through reconfiguring. Specifically, the vane-type device 36 can be rotated by one hundred and eighty degrees (180°), or the rotor 42 could be moved radially within the stator housing 38. This reconfiguring effectively reverses the functionality of the high-pressure side heat exchanger 72 and the low-pressure side heat exchanger 74. In other words, the low-pressure side heat exchanger 74 becomes the high-pressure side heat exchanger 72 and dissipates heat, and the high-pressure side heat exchanger 32, 72 becomes the low-pressure side heat exchanger 74 and receives heat.

Figure 3:
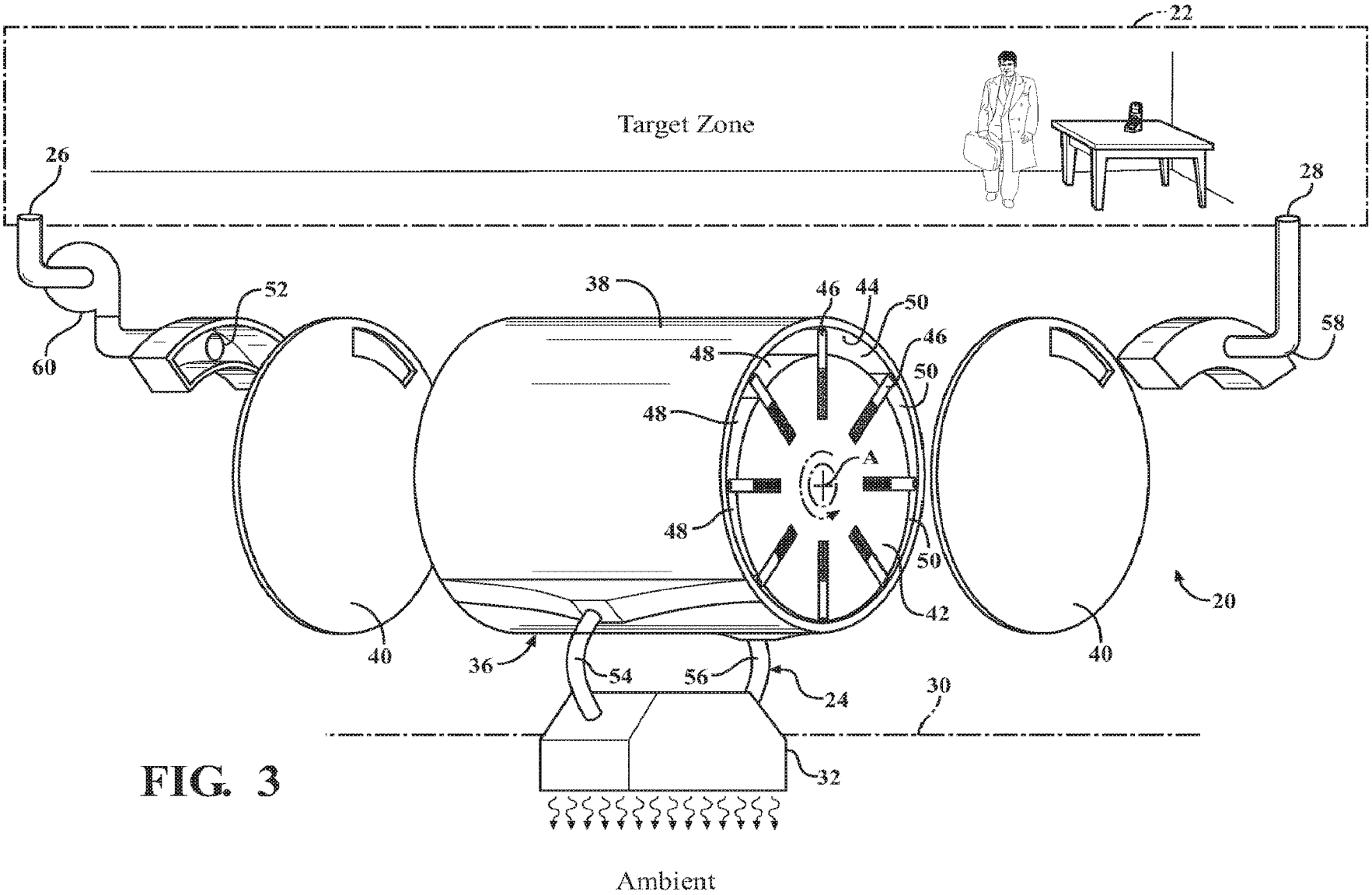
FIG. 3 shows an alternative embodiment of the invention wherein the positive displacement rotating vane-type device of FIG. 1 is configured in a cooling mode.

FIG. 3 shows the vane-type device 36 in a cooling open-loop system. Similar to the embodiment of FIG. 1, air is used as the working fluid in the embodiment of FIG. 3. Unlike the embodiment of FIG. 1, the inlet 26 and the outlet 28 are disposed in the target space 22 for using air from the target space 22 as the working fluid. In the embodiment of FIG. 3, the compression chamber inlet 52 of the stator housing 38 is generally longitudinally aligned with the expansion chamber outlet 58 of the stator housing 38. A heat exchanger 32 disposed in the atmosphere 30 is fluidly connected to the vane-type device 36 through the compression chamber outlet 54 and the expansion chamber inlet 56. In operation, the air in the target space 22 enters the flow path 24 through the inlet 26, and the blower propels the air into the vane-type device 36 through the compression chamber inlet 52. The pressure and temperature of the air increase as the volume of the compression chambers 48 decreases. The air leaves the vane-type device 36 through the compression chamber outlet 54 and flows to the heat exchanger 32. In the heat exchanger 32, the warmed and pressurized air dispenses heat to the atmosphere 30 before flowing back into the vane-type device 36 through the expansion chamber inlet 56. In the vane-type device 36, the pressure and temperature of the air decrease as the volume of the expansion chambers 50 increases. The air entering the vane-type device 36 then pushes the cooled and depressurized air out of the vane-type device 36 through the expansion chamber outlet 58. The air then exits the flow path 24 through the outlet 28 at a cooler temperature than it was when entering the flow path 24, thereby cooling the target space 22.

Figure 4:
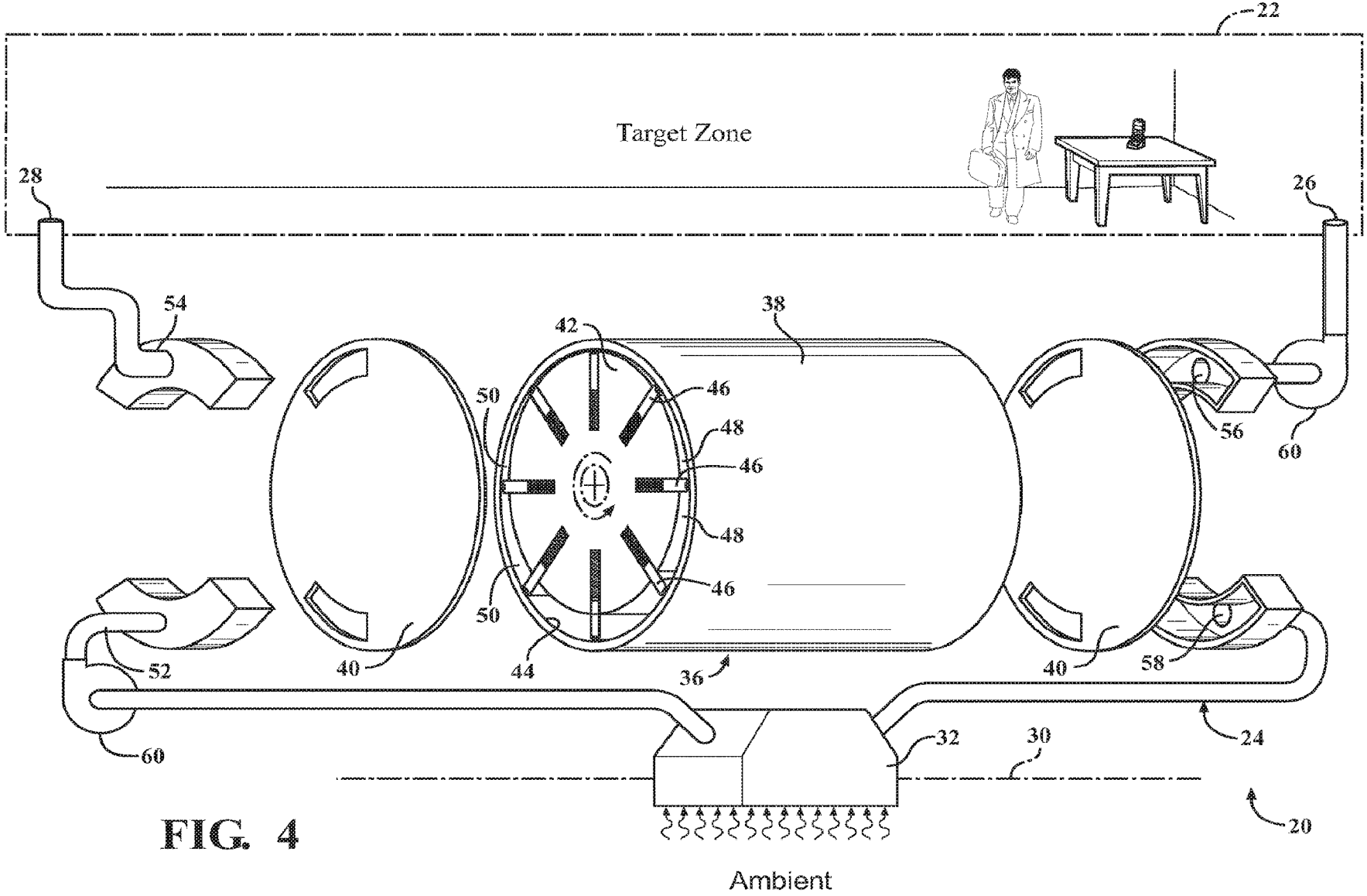
FIG. 4 is a view as in FIG. 3 but where the device is configured in a heating mode.

FIG. 4 shows the vane-type device 36 in a heating open loop system. Similar to the embodiment of FIG. 3, the inlet 26 and the outlet 28 are disposed in the target space 22 for using the air in the target space 22 as the working fluid. In the embodiment of FIG. 4, the expansion chamber inlet 56 of the stator housing 38 is generally longitudinally aligned with the compression chamber outlet 54 of the stator housing 38, and the compression chamber inlet 52 of the stator housing 38 is generally longitudinally aligned with the expansion chamber outlet 58 of the stator housing 38. A heat exchanger 32 disposed in the atmosphere 30 is fluidly connected to the expansion chamber outlet 58 and the compression chamber inlet 52. In operation, the air of the target space 22 enters the flow path 24 through the inlet 26, and the blower propels the air into the vane-type device 36 through the expansion chamber inlet 56. The pressure and temperature of the air decrease as the volume of the expansion chambers 50 increases. The air leaves the vane-type device 36 through the expansion chamber outlet 58 and flows to the heat exchanger 32. In the heat exchanger 32, the cooled and depressurized air receives heat from the atmosphere 30 before being propelled back into the vane-type device 36 through the compression chamber inlet 52 by another pump 60. The warmed and still depressurized air entering the vane-type device 36 through the compression chamber inlet 52 also pushes the cooled and depressurized air out of the vane-type device 36 through the expansion chamber outlet 58. In the vane-type device 36, the pressure and temperature of the air increase as the volume of the compression chambers 48 decreases. The air entering the vane-type device 36 through the expansion chamber inlet 56 then pushes the warmed and re-pressurized air out of the vane-type device 36 through the compression chamber outlet 54. The air then exits the flow path 24 through the outlet 28 at a warmer temperature than it was when entering the flow path 24, thereby warming the target space 22.

Figure 5:
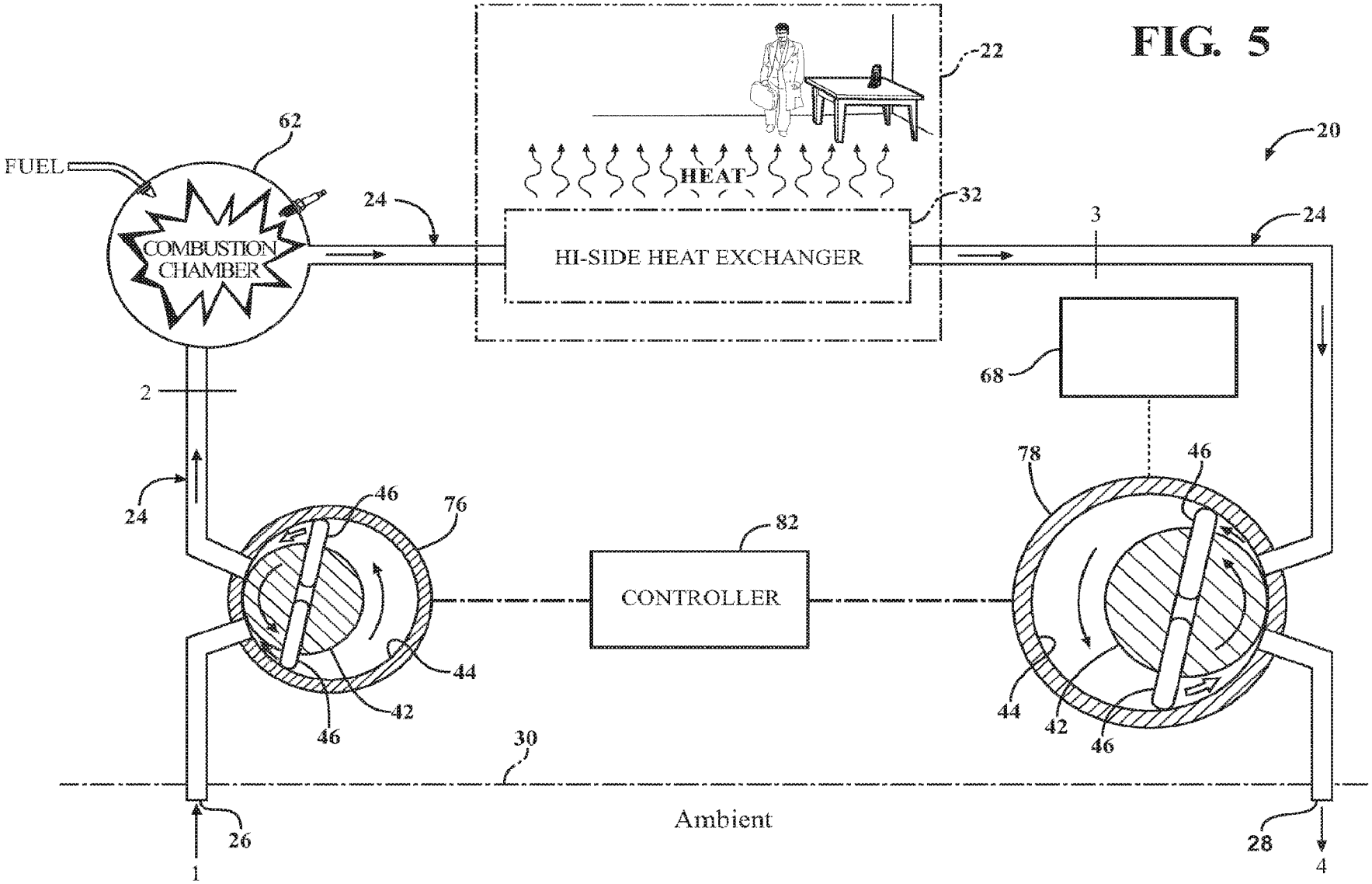
FIG. 5 is yet another alternative embodiment of the air aspirated hybrid heat pump and heat engine system utilizing independent compressor and expander devices to achieve either a fixed or variable asymmetric compression/expansion ratio.

An open-loop air aspirated hybrid heat pump and heat engine system 20 having a compressor 76 separated from the expander 78 is generally shown in FIG. 5. Similar to the embodiment of FIG. 1, atmospheric air is used as the working fluid in the embodiment of FIG. 5. In the embodiment of FIG. 5, the heat exchanger 32 is disposed in the target space 22 for transferring heat between the air in the flow path 24 and the target space 22, and the inlet 26 and the outlet 28 are disposed outside of the target space 22 in the atmosphere 30. A compressor 76 is disposed in the flow path 24 between the inlet 26 and the heat exchanger 32 for compressing and delivering the air from the inlet 26 to the heat exchanger 32. An expander 78 is disposed in the flow path 24 between the heat exchanger 32 and the outlet 28 for expanding (i.e. depressurizing) and delivering the air from the heat exchanger 32 to the outlet 28. In the exemplary embodiment, the compressor 76 and expander 78 are both vane-type pumps 60 having a cylindrically shaped stator 80 and a rotor 42 rotatably disposed within the stator 80. A plurality of spring-loaded vanes 46 project outwardly from the rotor 42 to slidably engage the inner wall 44 of the stator 80. However, it should be appreciated that the compressor 76 and the expander 78 could be any type of pumps 60.

An energy receiving device is mechanically connected to the expander 78 for harnessing potential energy from the air in the flow path 24 as will be discussed in further detail below. In the exemplary embodiment, the energy receiving device is a generator 68 for generating electricity. The electricity can then be used immediately, stored in batteries or inserted into the power grid. Alternatively, or additionally, the energy receiving device could be a mechanical connection between the expander 78 and the compressor 76 for powering the compressor 76 with the energy reclaimed from the air in the flow path 24. The energy receiving device could also be any other device for harnessing the energy produced by the expander 78.

A controller 82 is in communication with the compressor 76 and the expander 78 for controlling the hybrid heat pump and heat engine system 20. The controller 82 manipulates or switches the system 20 between different operating modes: a standard heating/cooling mode (in which the target space 22 can be either heated or cooled), and a high heating mode (in which the target space 22 is heated). The operating mode may be selected by a person, or the controller 82 can be coupled to a thermostat for automatically keeping the target space 22 at a desired temperature.

In reference to FIG. 5, the working fluid (e.g., air) travels through the flow path 24 in a clockwise direction. In the standard cooling operating mode, the controller 82 directs the compressor 76 to operate at a low speed and the expander 78 to operate at a higher speed. What follows is that the compressor 76 functions similarly to a valve separating the air downstream of the compressor 76 from the air at the inlet 26 of the flow path 24. The expander 78 then pulls the air along the flow path 24 by reducing the pressure of the air from the compressor 76 to the expander 78. Persons skilled in the art will appreciate that the temperature of the air leaving the compressor 76 will decrease as the pressure decreases. In other words, both the pressure and temperature of the air on the downstream side of the compressor 76 are reduced when compared to the pressure and temperature of the air at the inlet. The depressurized and cooled air then flows through the heat exchanger 32, which transfers heat from the target space 22 to the air in the flow path 24 to cool the target space 22. After leaving the heat exchanger 32, the expander 78 propels the air out of the flow path 24 through the outlet 28. Alternatively, the direction of the air may be reversed to flow in a counter-clockwise direction if this makes better use of the devices chosen with the final engineering targets in mind. In the cooling operating mode, the energy receiving device may be mechanically connected to the compressor 76 for harnessing the potential pressure energy from the air flowing through the compressor 76.

In the standard heating mode, the controller 82 directs the compressor 76 to compress the air from the inlet to increase the pressure and the temperature of the air, as will be understood by those skilled in the art. The pressurized and warmed air then flows through the flow path 24 to the heat exchanger 32. The heat exchanger 32 dispenses heat to the target space 22 to warm the target space 22. Although the air in the flow path 24 is cooled by the heat exchanger 32, the air remains pressurized when compared to the air entering the flow path 24. This difference in pressure represents potential energy, which can be harnessed. The generator 68, which is coupled to the expander 78, harnesses this potential energy while the expander 78 expands the pressurized air to reduce the pressure of the air. Preferably, the air is expanded back to the same pressure at which it entered the flow path 24. Following the expansion, the air is discharged from the flow path 24 through the outlet 28.

In the high heating mode, the compressor 76 receives air aspirated from the inlet 26 and then compresses the air to increase its pressure and also its temperature (in compliance with relevant thermodynamic gas laws). The pressurized and high temperature air then flows through the flow path 24 to the combustion chamber 62, which mixes a suitable fuel with the air and then combusts the mixture. The combustion of the fuel and air mixture further increases both the pressure and the temperature of the air in the flow path 24. The pressurized and heated air then flows through the heat exchanger 32 and dispenses heat to the target space 22. Air leaving the heat exchanger 32 in the high heating mode remains substantially highly pressurized relative to the ambient air pressure, and therefore represents a valuable amount of potential energy. The generator 68 maybe of any suitable type that is effective to convert this potential energy into another form, such as electricity and/or mechanical energy. This potential energy may be harnessed while the expander 78 expands the air to reduce the pressure of the air, or accumulated for conversion at a later time. In other words, any residual pressure energy put into the air through the initial compression and combustion processed is subsequently re-claimed by the generator 68. Once the potential energy has been reclaimed, the low pressure air is then discharged from the flow path 24 through the outlet 28 back into the environment 30.

Among the several embodiments presented herein, the invention may be defined in one sense as a system and method for circulating ambient air from a target space across a heat exchanger and back to the target space at a higher or lower temperature. According to still other aspects, the present invention may be defined as a system and method for transferring heat to or from a heat exchanger to a gaseous medium within the subject thermodynamic system. Before advancing further in the detailed description, it will be helpful to re-state the main components and primary elements of the invention, from which these several aspects can be better understood to accomplish the various objectives of this invention.

Within and among these various aspects, the above-described flow path 24 comprises a plenum for a gaseous heat transfer medium, which in the preferred embodiments comprises air. However, in some embodiments it is contemplated that the gaseous heat transfer medium could be a refrigerant gas other than air. The plenum 24 has an upstream inlet 26 in fluid communication with the target space 22 and a downstream outlet 28 in fluid communication with the target space 22.

Ambient air is drawn from the target space 22 into the inlet 26 of the plenum 24 at an incoming pressure and an incoming temperature. As stated above, the target space 22 may be either the inside or outside ambient air zone, depending upon which is the subject of focus with respect to the refrigerant being considered. The drawing step may include positioning a filter device at or near the inlet 26 to filter particulate from the incoming air. The plenum 24 is inlet gated at an upstream location with a first pump 76 which may comprise a rotary device like that shown in FIGS. 5 and 6. By describing the first pump 76 as an inlet gate, it will be understood that the first pump 76 is configured to prevent backflow of substantially all of the air entering the plenum 24. This backflow prevention can be enabled as a natural attribute of the pump, as in the embodiments illustrated in FIGS. 5 and 6, or as valves 84 like those described below in connection with the embodiment of FIG. 7. In some embodiments, the first pump 76 may include pistons such as a swash plate pump or utilize mating scrolls to name a few of the many possible alternatives. Nevertheless, as pumps adaptable to all contemplated aspects of this invention utilize rotary motions, the following descriptions will continue references to the first pump 76 as a rotary type device as a matter of convenience and continuity but without intending to establish an unnecessarily limiting definition for this element.

Figure 11:
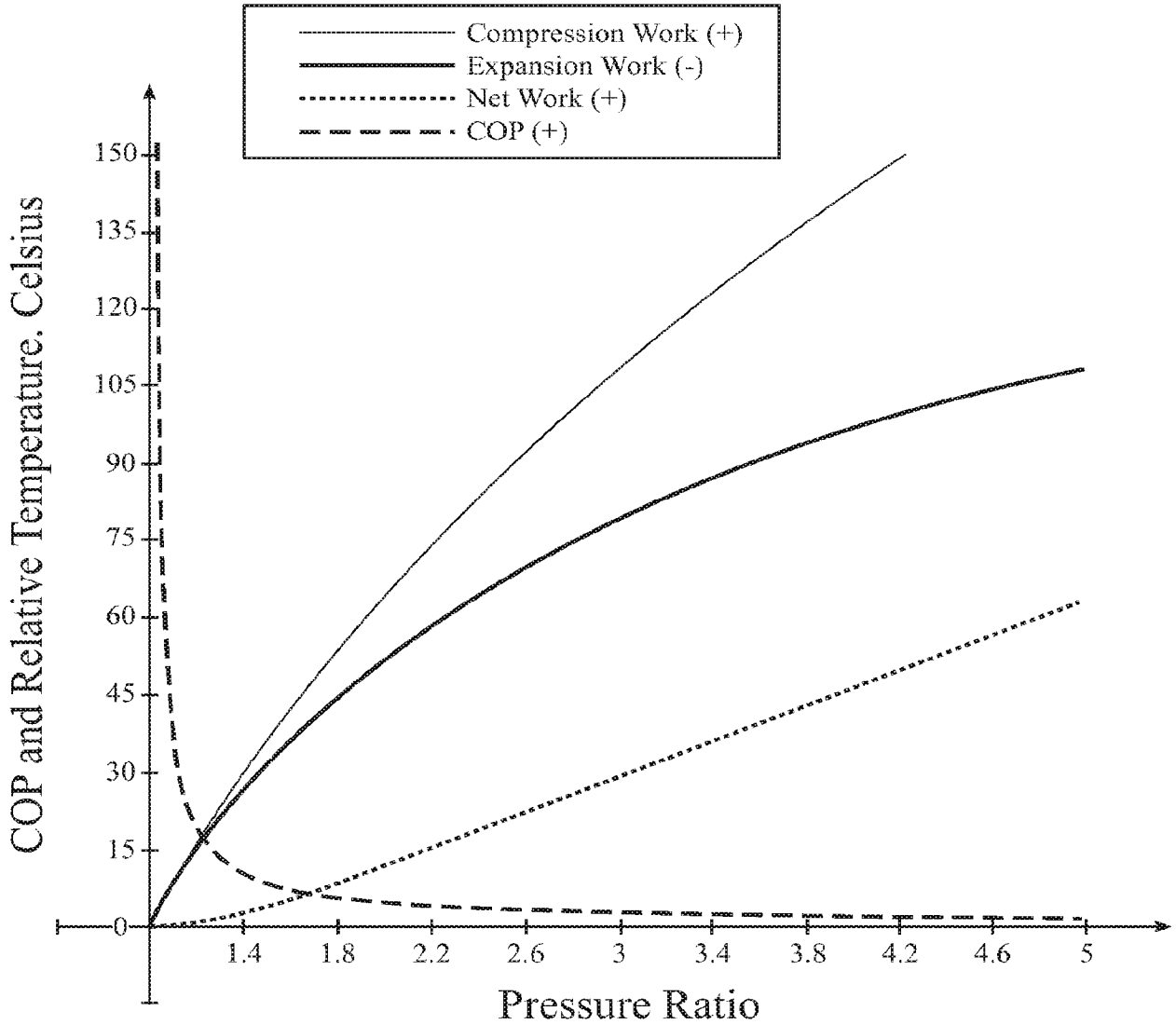
FIG. 11 is a graph showing the work components and resultant net work with COP for a Brayton Cycle across a broad set of pressure ratios.
Figure 12:
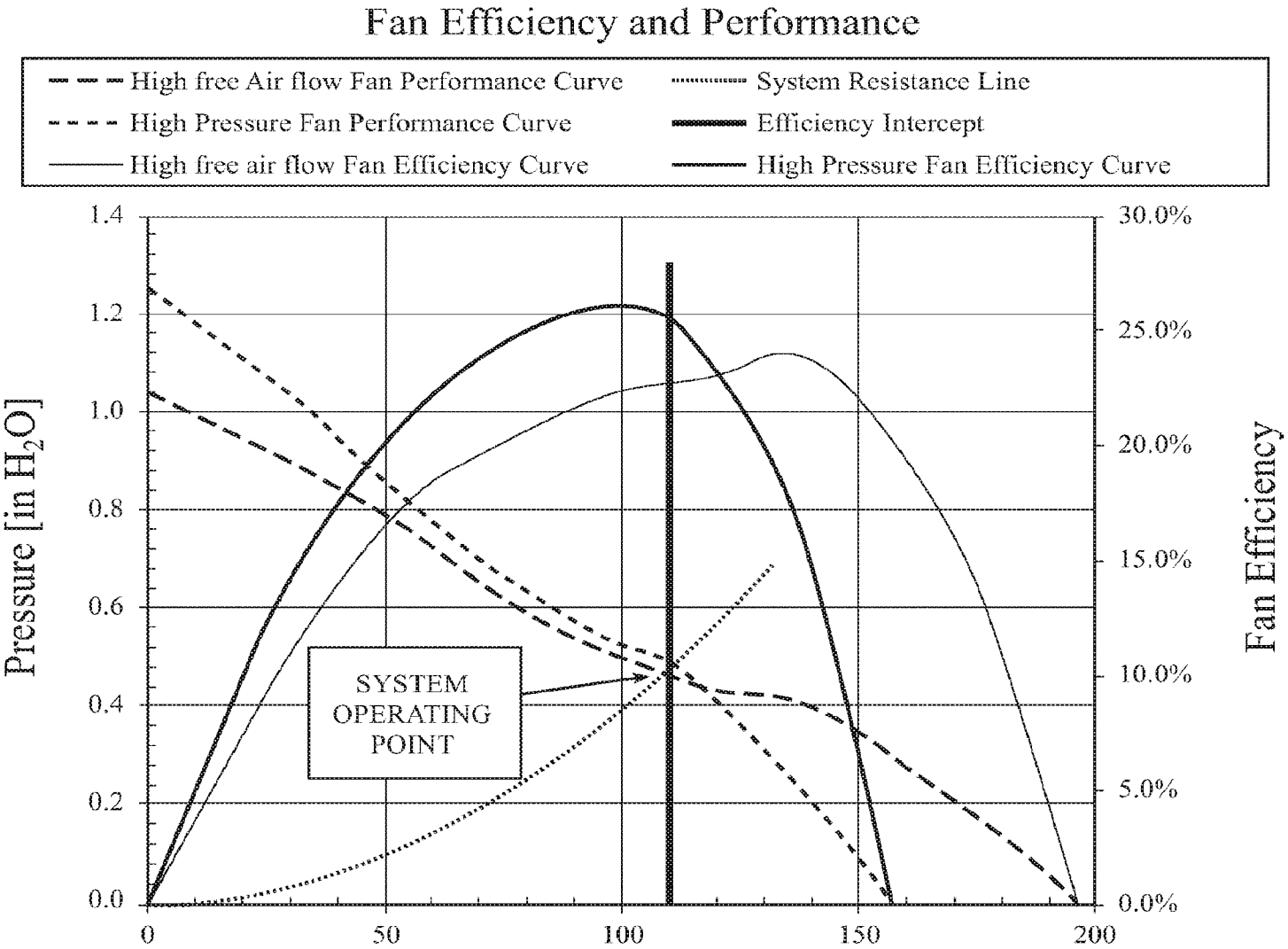
FIG. 12 is a graph showing the relationship between a fan's theoretical "free air flow" operating performance and its capability once air flow resistance is encountered.

In some embodiments, air is taken into the first rotary pump 76 using substantially atmospheric pressure from the target space 22. That is to say, the first rotary pump 76 may be configured to allow its expansion chamber 50 to fill with air using atmospheric pressure, such as by remaining open and exposed to air from the target space 22, as in FIG. 6, for a sufficiently long enough period time. This may be accomplished naturally if the rotational speed of the first rotary pump 76 is sufficiently slow and the intake into the expansion chamber is sufficiently accessible. In some embodiments, the rotational speed of the rotor 42 within the first rotary pump 76 is controlled so as to move or pump the air in a downstream direction along the plenum 24 without changing the pressure of the air greater than about 20% (i.e., without increasing it more than about 1.2 times the incoming pressure). More preferably still, first rotary pump 76 is controlled so as to pump the air downstream along the plenum 24 without changing the pressure of the air greater than about 10% relative to the incoming pressure, and more preferably as close to 0% as realistically possible. As will be described subsequently, surprising benefits and advantages can be realized in some embodiments where the first rotary pump 76 is controlled so as to move the air downstream along the plenum 24 without directly increasing its pressure by more than about 0-10% relative to the incoming pressure. Pressure ranges in the 0-10% category may be deemed ultra-low ranges when compared with prior art air cycle systems all operating in ranges above 250% (i.e., 2.5 and above). FIG. 11 shows the astonishing increases in COP for these pressure ratios which Convergent Refrigeration will deliver at the most common temperatures. Even at the higher temperatures characteristic of deserts and the most adverse working environments, Convergent Refrigeration opens to profitable use an unprecedented range of operating efficiencies by enabling the practical exploitation of ultra-low pressure ratios heretofore not even deemed worthy of exploration.

Figure 6:
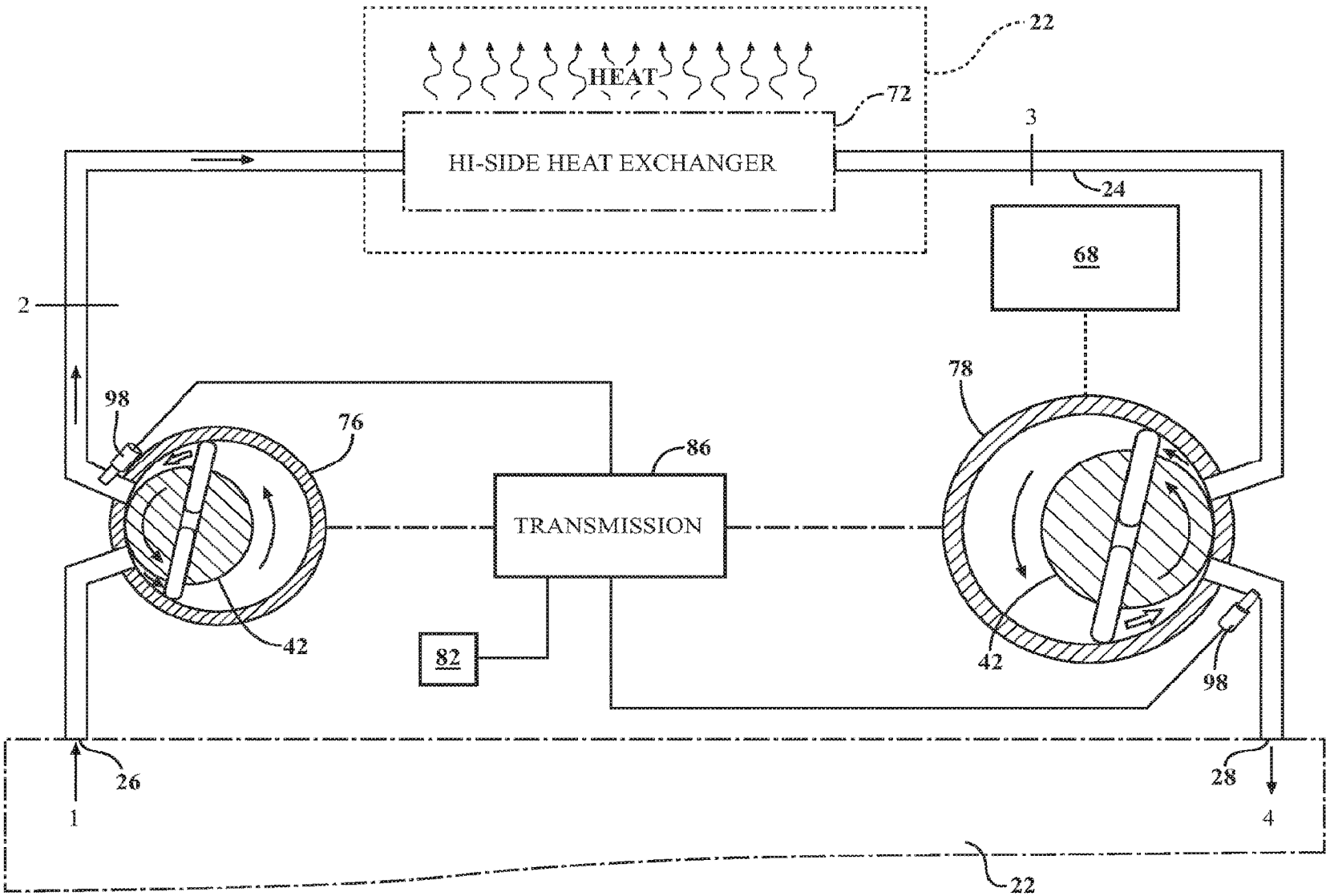
FIG. 6 is a highly simplified view showing a thermodynamic, open-loop system in which two rotary pumps operate in concert through an intervening transmission.

The plenum 24 is outlet gated at a downstream location with a second rotary pump 78, as shown in FIGS. 5-6. The second rotary pump may be integrated with the first rotary pump in some embodiments, like those depicted in FIGS. 1-4 and 7 utilizing a unitary rotary device 36. The second rotary pump 78, like the first pump 76, also prevents backflow of substantially all of the air exiting the plenum 24. Also like the first pump 76, the second rotary pump 78 may include pistons or mating scrolls or take other alternative forms suitable to accomplish the objectives of this invention. The portion of the plenum between the first 76 and second 78 rotary pumps comprises a controlled pressure zone. The controlled pressure zone establishes a continuously bounded volume of air-in-transit flowing through the plenum 24. In other words, the column of air between the first and second rotary pumps and moving continuously through the plenum 24 comprises the controlled pressure zone.

A heat exchanger 72 is operatively located within the controlled pressure zone of the plenum 24, i.e., in-between the first 76 and second 78 rotary pumps. By concurrently rotating the first 76 and second 78 rotary pumps, air traveling through the plenum 24 is moved across the heat exchanger 72. The heat exchanger 72 may be viewed as always possessing an instantaneous Heat Exchanger Temperature. And the air in the plenum 24 that is upstream of the heat exchanger 72 will always have an Approaching Temperature that may be different (higher or lower) from the Heat Exchanger Temperature. When the air interacts with the heat exchanger 72, such as by flowing through fins, heat is transferred either into or out of the air. That is to say, if the Heat Exchanger Temperature is higher than the Approaching Temperature, heat will flow into the air from the heat exchanger 72. But if the Heat Exchanger Temperature is lower than the Approaching Temperature, heat will flow out of the air and into the heat exchanger 72.

Because the second rotary pump 78 gates the downstream end of the plenum 24 and prevents backflow, rotation of the second rotary pump 78 is required to discharge the air from the outlet 28 of the plenum 24. Accordingly, whenever heat is transferred, air will be discharged from the outlet 28 at a differentiated temperature relative to the incoming temperature.

Whenever the Heat Exchanger Temperature is different from the Approaching temperature, the temperature of the air within the plenum 24 downstream of the heat exchanger 72 is altered by the transfer of heat to or from the heat exchanger 72. This transferring of heat provokes a change in the volume of the air within the plenum 24. As is well-documented and generally known to those of skill in the art, because air is a gaseous medium, a temperature increase in the air will cause the volume of the air to increase when constant pressure is maintained. That is, the air expands when it is heated. And conversely, the volume of the air decreases in proportion to decreases in its temperature. Cooling air contracts. Therefore, when heat is transferred into the airstream by the heat exchanger 72, the volume of the air within the plenum 24 will increase by a mathematically determinable amount. And when heat is transferred into the heat exchanger 72 from the flowing air within the plenum 24, the volume of the air within the plenum 24 will decrease by a mathematically determinable amount.

In some embodiments of the present invention, a generally constant pressure of the air transiting the plenum 24 is maintained at the aforementioned ultra-low range notwithstanding the temperature-induced volume changes therein. Maintaining a generally constant, ultra-low pressure within the plenum 24 may be accomplished by proportionally varying the rotation speed of the first rotary pump 76 relative to the second rotary pump 78. This exercise is particularly beneficial when combined with the afore-mentioned option of controlling the first rotary pump 76 so as not to directly increase or decrease air pressure greater than about 10-20% (and most preferably in the ultra-low range of 0-10%) relative to the incoming pressure. In fact, a variety of beneficial results are to be gained when maintaining this constant low pressure, which benefits will be discussed later. FIG. 11 shows us by inspection that these pressure ratios define the sweetest of all sweet spots on the COP curve. But there are no precedents in refrigeration for utilizing pressure ratios even two and three times these negligible operating pressures opened for investigation and exploitation by Convergent Refrigeration. As will be described in detail below, the system can be used with great effect to replace a traditional prior art blower-operated air delivery system like that described in conjunction with FIGS. 8-12. For this reason, the technique of using the systems of this invention to maintain a generally constant (preferably ultra-low) pressure within plenum 24, while accounting for transfers of heat to/from the air flow in any forced air convection HVACR setting, is referred to hereinafter as the concept of Fan Replacement because a compelling argument can and will be made that traditional fans/blowers should be made obsolete in such settings by the present invention.

In some alternative embodiments of the present invention, a counter-conditioning step is performed to improve overall efficiency of the system. Counter-conditioning refers to an intentional manipulation of the Approaching Temperature to deliver Convergent Refrigeration, which by definition will not fall within the scope of the Fan Replacement technique. That is to say, a system configured according to the principles of this invention can be operated to achieve both Fan Replacement and Convergent Refrigeration, however not concurrently. In particular, counter-conditioning occurs when the Approaching Temperature is manipulated to increase the Air to Refrigerant Temperature Differential (A-RTD).

Conventional (prior art) refrigeration was categorized above as Divergent Refrigeration. Divergent Refrigeration offers no option for improving heat transfer except by increasing excess refrigerant lift. Refrigerant lift is increased only by moving the refrigerant temperature farther away from the working temperatures which define the refrigeration task. The prior art open air cycle methods and systems, discussed previously, all require that when using air as the refrigerant its refrigerant temperature must be changed substantially beyond the opposite working temperature. Only by providing this excess refrigerant lift is it possible for Divergent Refrigeration methods and systems to induce the requisite flow of heat. Divergence is defined by excess refrigerant lift on the opposite side of the companion working temperature.

Convergent Refrigeration delivers exponentially greater efficiencies while utilizing much smaller pressure ratios. In other words, it is not the employment of an open air cycle that defines Convergent Refrigeration; rather it is the unprecedented capability to move a comparable amount of heat with a significantly smaller amount of work.

In Divergent Refrigeration, the Approaching Temperature of the ambient air stream is always defined by one of the working temperatures $T_{HIGH}$ or $T_{LOW}$. Convergent Refrigeration changes the Approaching Temperature of the ambient air stream just prior to the heat exchanger even when the heat exchanger is of the type used by a traditional Divergent Refrigeration system. Because the temperature of the ambient air stream is otherwise defined by one of the working temperatures, Convergent Refrigeration is said to counter-condition the air stream, moving its temperature toward the opposite working temperature rather than away from it as would be required in every Divergent Refrigeration system or contrivance. Correspondingly, some embodiments of Convergent Refrigeration will be seen to be augmenting or supplementing Divergent Refrigeration systems. By changing the ambient working temperature, in other words counter-conditioning the Approaching Temperature convergently, the A-RTD is increased thereby improving heat transfer with a conventional heat exchanger. The Approaching Temperature is reduced below the Heat Exchanger Temperature when heat is to be transferred into the air from the heat exchanger 72, and conversely the Approaching Temperature is elevated above the Heat Exchanger Temperature when heat is to be transferred out of the air to the heat exchanger 72. Convergent Refrigeration can operate essentially between the working temperatures, $T_{HIGH}$ and $T_{LOW}$, rather than beyond these temperatures. No known prior art refrigeration system is capable of operate essentially between the working temperatures, $T_{HIGH}$ and $T_{LOW}$. Divergent Refrigeration can only operate outside and beyond the working temperatures, $T_{HIGH}$ and $T_{LOW}$. Moreover, even then Convergent Refrigeration provides for the reduction of excess refrigerant lift by optimization of the heat transfer temperature which cannot be practiced in any other type of open air cycle known.

Specific details pertaining to this counter-conditioning step used to deliver Convergent Refrigeration are provided below, along with supporting mathematical proofs. At this point in the description it may be valuable to note that the counter-conditioning step includes manipulating the first rotary pump 76 relative to the second rotary pump 78 to change the pressure of the air (or other gaseous medium) in the plenum 24. That is to say, the manipulating step includes reducing the pressure of the air relative to the incoming pressure when the heat exchanger 72 transfers heat into the air, and increasing the pressure of the air relative to the incoming pressure when the heat exchanger 72 transfers heat out of the air. In one embodiment, a controller, such as controller 82 in FIG. 5, may be implemented to affect the counter-conditional technique. The controller 82 may be used in conjunction with independently controlled motor/generators 68 coupled to the respective pumps 76, 78.

Counter-conditioning changes the Approaching Temperature of the air stream within the plenum 24, increasing its temperature differential with respect to the Heat Exchanger Temperature. Counter-conditioning increases the rate of heat transfer to or from the air within the plenum 24. Fan Replacement, on the other hand, may leave the Approaching Temperature unchanged and in that case would not affect the rate of heat transfer except perhaps by increasing or decreasing the mass flow rate. Thus, a contrast between the concepts of Fan Replacement and Convergent Refrigeration can be clearly seen: Fan Replacement seeks to maintain a generally constant (preferably ultra-low) pressure within plenum 24, whereas Convergent Refrigeration (or counter-conditioning) seeks to intentionally manipulate the pressure within the plenum 24 to facilitate heat transfers between the air and the heat exchanger 72. The present invention makes use of substantially the same physical equipment to accomplish both Fan Replacement and Convergent Refrigeration, however both techniques are practiced mutually exclusively. The controller 82 thus regulates the system to operate either in Fan Replacement mode or in Convergent Refrigeration mode.

Accordingly, the techniques of Fan Replacement and counter-conditioning (i.e. Convergent Refrigeration) may be implemented independently from one another. That is to say, the present invention can be configured to accomplish Fan Replacement exclusively, or counter-conditioning exclusively, or both. Nevertheless, in all scenarios the air (or other gaseous medium) is returned to the incoming pressure within the second rotary pump 78 prior to discharge. Said another way, the system and methods of this invention always seek to exhaust air from the outlet 28 of the plenum 24 at very close to the incoming pressure. By this means, the invention aims to harvest work directly from at least one of the first 76 and second 78 rotary pumps in response to changes in the volume of the air in the plenum 24 due to heat transfers under constant pressure. Rather than expelling energy in the form of pressurized or de-pressurized air from the plenum 24, back into the atmosphere where it undergoes free (i.e., wasted) expansion, in all forms of this invention the work potential of volume change due to heat transfer is captured and harvested to the extent possible. Importantly, in every case, the energy spent increasing or reducing pressure in the plenum 24 is directly recovered so there are little to no energy losses due to adiabatic heating or cooling per se.

Figure 13:
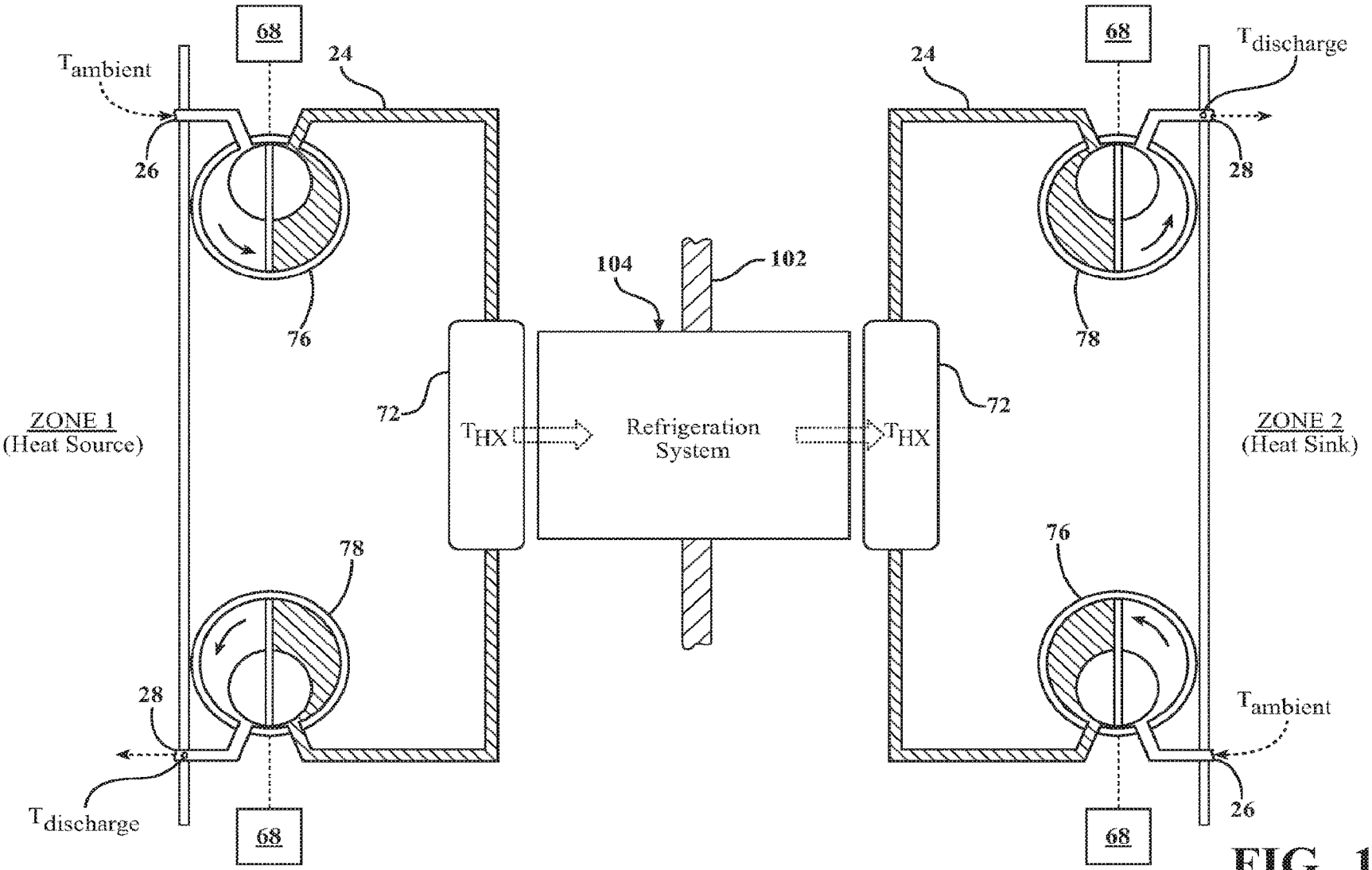
FIG. 13 is a schematic representation showing how a conventional refrigeration system can be supplemented by Convergent Refrigeration on both sides, counter-conditioning the target ambient mass air flows according to one embodiment of the present invention.
Figure 16:
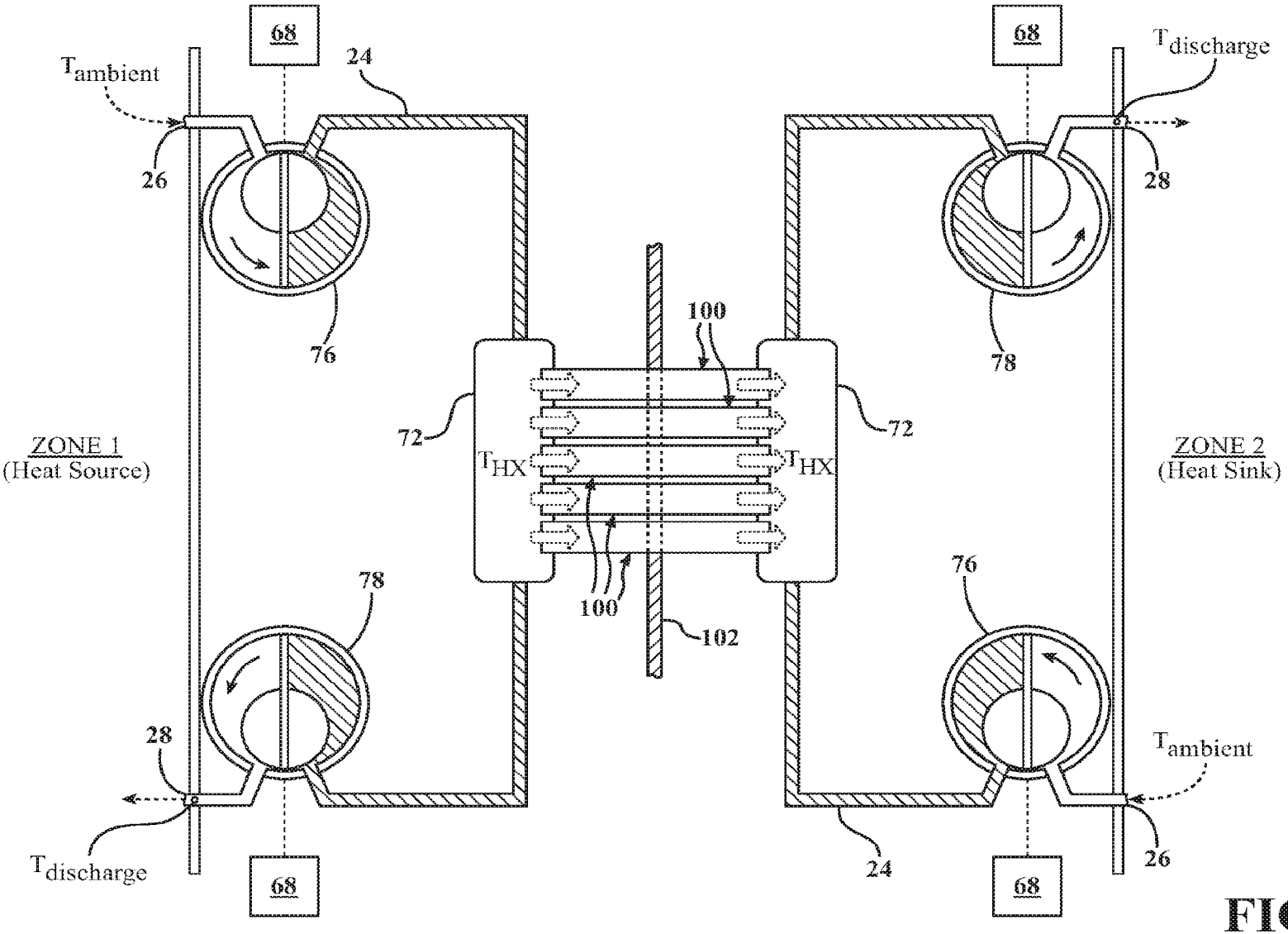
FIG. 16 is a 2-sided Convergent Refrigeration flow schematic like FIG. 13, but showing the Refrigeration System of FIG. 13 replaced with heat exchangers, which may optionally be in the form of an array of heat pipes like those of FIG. 15, and which form a shared heat exchanger.

One possible way to harvest the energy is depicted in FIG. 5, where a generator 68 is coupled to the second rotary pump 78. Another possible way to harvest the energy is depicted in FIGS. 1-4 and 6-7 in which first 76 and second 78 rotary pumps are connected through some sort of common shaft or transmission 86, such that the harvested energy is directly used to offset the input energy requirements otherwise required to rotate the pumps 76, 78. Yet another way to harvest energy is depicted in the examples of FIGS. 13 and 16 were independent motor/generators 68 are associated with each pump 76, 78. Recognizing the capability of many modern motor/generators 68, the most likely embodiments will integrate an electronic control system capable of allocating the two roles of motor and/or generator to either pump 76, 78 with agility. (Although control systems are not explicitly shown in FIGS. 13 and 16 on the premise that same are integrated features in the motor/generators 68 and/or the master software controls therefore, it will be readily understood by those of skill in the art that controllers 82 like those shown in the preceding Figures can be incorporated into the systems exemplified in FIGS. 13 and 16 without undue experimentation.) Indeed, other power and energy harvesting techniques may be employed; the goal being to recapture the greatest share of the energy invested while creating the temperature differentials (Approaching temperature vs. Heat Exchanger Temperature), rotating the pumps 76, 78 and/or manipulating the pressure of the air within the plenum 24.

The most powerful iterations of Fan Replacement and counter-conditioning (i.e., Convergent Refrigeration) are embodied within a dual paired, or back-to-back, arrangement in which two independent systems are located on opposite sides of a shared heat exchanger 72, like those examples depicted in FIGS. 13, 16 and 18-23. In these thermodynamic systems, it may be possible to configure one sub-system (on the supply-side, heat source) in a counter-conditioning mode, and to configure the other sub-system (on the delivery-side, heat sink) in a Fan Replacement mode. Thermodynamically speaking, the greatest gains are delivered when both subsystems counter-condition the ambient air, moving the temperature of the counter-conditioned air just across the midpoint between the working temperatures, inside and outside ambient air temperatures or $T_{HIGH}$ and $T_{LOW}$ as needed to secure heat transfer through an air-to-air heat exchanger 72. Heat transfer temperatures other than the midpoint between $T_{HIGH}$ and $T_{LOW}$ may be preferred based on mechanical and other performance considerations. The heat transfer temperature may even be set outside the working temperatures while still enjoying the distinct performance advantages of Convergent Refrigeration. The distinct methods of counter-conditioning and Fan Replacement will eliminate any confusion with Divergent Refrigeration even when a heat transfer temperature is set outside the working temperatures.

The following descriptions detail the various embodiments of FIGS. 6, 7 and 13-23 which, together with the preceding examples of FIGS. 1-5, exhibit and illustrate the several aspects of the invention as defined by the claims. Turning first to FIG. 6, a pair of positive displacement rotary-type devices 76, 78 are operatively coupled through a transmission 86 which is configured to vary the ratio between the volumetric compression and volumetric expansion of the working fluid in the respective compressor 76 and expander 78 sections. In this highly simplified example, the transmission 86 may be used to control the rotational speeds of the respective first 76 and/or second 78 rotary pumps. The scale of the expansion-side rotary device 76 may be different than the compressor-side device 78 to facilitate non-symmetrical compression/expansion ratios as the air expands and contracts due to variations in heat transferred. The state point numbers (1 through 4) correspond to the state points described above in connection with FIG. 8. FIG. 6 thus shows a case where the heat exchanger 72 is located in the outside target space 22. The system uses atmospheric air as the refrigerant. For air conditioning purposes the smaller volume device 76 will feed the heat exchanger 72. Once exit air pressure is returned to atmospheric level, it can be released as exhaust into the inside target space 22.

It must be emphasized that direction of flow could be reversible and pump sizes do not govern the outcome when rotation speeds can be sufficiently controlled by the controller 82. The controller 82/transmission 86 apparatus or electronics will raise or lower the pressure in the plenum 24 electively, regardless of flow direction and pump size. For example, FIG. 6 also shows all devices and plumbing in the right position to provide heat by simply reversing the flow of air refrigerant through the fixed system as installed. In this case the larger volume device 78 heats the intake air by compression. Heat is released in the heat exchanger 72 and its density increases such that the smaller volume device 76 may extract available work as it expands to atmospheric pressure on the way out. The devices 76, 78 may be advantageously powered by respective electric motors as in FIG. 13. It can be shown that a heat pump is significantly more effective in producing heat from electricity by comparison with a tungsten element space heater. For a resistive heating element, the COP ($Q_{out}/W_{in}$) is 1, whereas for a heat pump the COP can be easily above 10. COP's in much higher ranges may be expected by the methods of this invention.

Although not shown in FIG. 6, a combustion chamber 62 like that in FIG. 5 could be introduced into the same plumbing that otherwise already supports a heat pump/air-conditioner. In this position an auxiliary furnace transforms the hybrid heat pump configuration into a heat engine. The output of a high efficiency furnace may be dramatically increased while at the same time powering an auxiliary generator like that shown at 68 in FIG. 5.

Figure 7:
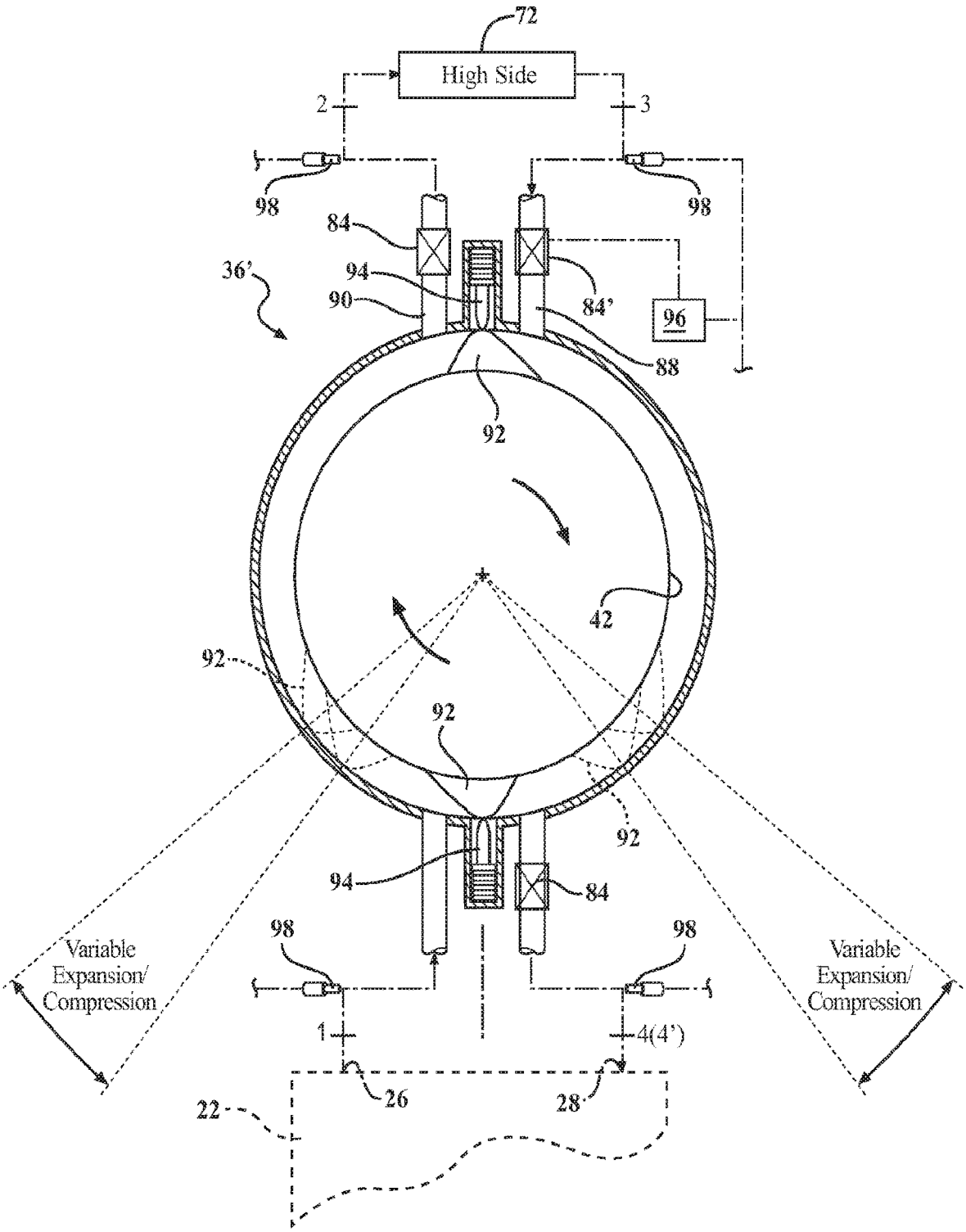
FIG. 7 is a simplified cross-sectional view of an air cycle refrigeration system including an optional two-lobed rotary pump device.

Turning now to FIG. 7, the system is shown utilizing a unitary rotary vane-type positive displacement device 36' operating with a thermodynamic system in which the plumbing has been rearranged, thus illustrating the versatility of this particular construction. In this design, the left side of the rotary device 36' functions as the compressor and the right half as the expander. A high-pressure side heat exchanger 72 is operatively disposed at the top (considering the schematic presentation in FIG. 7) of the device 36' between an outlet 90 from the compression chamber and an inlet 88 to the expansion chamber. A target space 22 is located between an outlet 28 from the expansion chamber and an inlet 26 to the compression chamber. The thermodynamic system configured according the schematic representation of FIG. 7 can operate within three modes. The high-pressure side heat exchanger 72, which functions as a heat rejecter (heat source), represents any high pressure, high temperature zone relative the ambient temperature of the target space 22 in an open loop arrangement, thereby providing an air cycle heating system. In this arrangement also, a valve 84 controls the flow of working fluid through the compressor outlet 90, and another valve 84' controls the flow of working fluid through the expander inlet 88. (Careful notice must be asserted that the use of the term "valve" here is merely illustrative for a class of devices. In practice and quite importantly for much larger scale devices employing the principles shown in FIG. 7. Any appropriate gate keeping device may be selected from a wide range of positive closures and flappers to a variety of more open flow limiting devices such as a Venturi, a sonic nozzle, and regulated variable flow versions of these and similar devices capable of stabilizing the plenum pressure between 84 and 84' at any chosen increased or reduced pressure. It must be understood and acknowledged that the device shown as 36' in FIG. 7 is capable of both heating and cooling the heat exchanger 72 as drawn utilizing alternative control schemes. Just as the air in High Side heat exchanger 72 is heated by increasing the stabilized target pressure, the target pressure may be reduced and stabilized at a lower temperature for cooling at the same position, heat exchanger 72, which is accordingly to be recognized as a "low side" pressure value. Labels shown in drawings are meant to correspond to scenarios elaborated in detail but without limiting the capability of the device to any particular scenario used in teaching.)

For the sake of this illustration, therefore, the thermodynamic system in FIG. 7 is configured as an open air cycle heating system. Assuming air inlet pressure through the compressor inlet 26 is taken at 1.0 ATM, an exemplary cycle may proceed as follows. The valve 84 on the compressor outlet 90 is configured as a check-valve having a fixed or adjustable cracking pressure which coincides with the desired working fluid pressure for the high-pressure side heat exchanger 72. If, for the sake of example, that high-pressure side heat exchanger 72 is intended to operate at 1.2 ATM, then the cracking pressure for the valve 84 may be set at 1.2 ATM. Thus, as the lobe 92 which is positioned at the 6 o'clock in FIG. 7 sweeps past the compression chamber inlet, it traps a fixed quantity of a working fluid (i.e., air in this example) in the compression chamber between the leading face of that particular lobe 92 and the retractable valve 94 located in the 12 o'clock position and the closed check-valve 84. Rotation of the rotor 42 in the clockwise direction thus compresses the working fluid until such time as the pressure in the compression chamber reaches the cracking pressure of the valve 84. When the pressure of the working fluid in the compression chamber reaches 1.2 ATM in this example, the valve 84 opens thereby emitting working fluid at the differentiated pressure into the high side heat exchanger 72. This emission of working fluid at the elevated pressure into the high side heat exchanger 72 continues until the lobe 92 crosses the compression chamber inlet 90. All the while, atmospheric air at 1.0 ATM is being drawn into the compression side of the rotary device 36' on the trailing edge of that same lobe 92.

Turning now to the expansion side of the thermodynamic system in the preceding example, working fluid upstream of the valve 84' is maintained at 1.2 ATM. The valve 84' is controlled by a regulator 96 or control system so that it remains open long enough to admit a volume of working fluid into the expansion side of the rotary device 36' so as to achieve the desired operating conditions. The regulator 96 may be configured so as to maintain constant operating pressures, specified volumetric flow rates of the working fluid and/or desired temperature rejections from the high side heat exchanger 72. Alternatively, the regulator 96 may be coupled to rotation of the rotor 42 so that it closes the valve 84' when the rotor 42 reaches a specified angular position. The opening and the closing of valve 84' by the regulator 96 is based, ideally, on the amount of heat moved (in this example via the high side heat exchanger 72). Thus, considering a lobe 92 crossing the inlet 88, the retractable vane 94 will be closed against the outer surface of the rotor 42 with working fluid at the differentiated pressure (1.2 ATM) filling behind the lobe 92. This lobe 92 will be allowed to rotate sufficiently with the valve 84' in an open condition until the desired volume of working fluid is contained in the expansion chamber.

At this point, which may correspond to one of the phantom representations of a lobe 92 in the 4-5 o'clock positions of FIG. 7, the regulator 96 will cause the valve 84' to close, thereby expanding the working fluid in the expansion chamber. The regulator 96 will time the closing of the valve 84' at the appropriate instance so that continued rotation of the lobe 92 will cause the working fluid to be returned to the inlet pressure (1.0 ATM in this example) entirely within the expansion chamber. In most instances, the closing of valve 84' will occur at such a rotary location so that by the time the low trailing edge of the lobe 92 reaches the expansion chamber outlet 28, the pressure of the working fluid in the expansion chamber will be exactly equal to the inlet pressure which, in this example, is atmospheric pressure. The displacement volume of the expansion chamber is thereby adjusted (via regulator 96) relative to the compression chamber as a function of the amount of heat moved through the heat exchanger 72.

In some cases, it may be desirable to over-expand the working fluid to effect additional cooling, but the working fluid will be returned again to the inlet pressure prior to discharge through the outlet 28. To deliver over-expansion, outlet 28 would be equipped with a check valve identical to 84 but set to release exhaust at the outlet pressure, in this case 1.0 ATM. Over-expansion would result from exactly the same normal process with the single exception that the inlet valve 84' would be closed sooner. Because a smaller mass of air is admitted behind the rotating lobe 92, its pressure would be reduced below the exit pressure by the time rotating lobe 92 reaches the exit port leading to outlet 28. Therefore, the check valve set to 1.0 ATM will remain closed. In the following cycle, the lobe 92 leaving TDC will perform compression on the lower pressure over-expanded gas which was just established on its leading edge by the previous sweep of the chamber. As this lobe 92 sweeps clockwise it will perform an ordinary compression sweep. As soon as the gas is re-compressed to its exit pressure, check valve (installed on exit port leading to outlet 28) will crack open and release the gas as exhaust. This over-expansion technique returns the working fluid to the inlet pressure. Over-expansion is employed either to quick cool (self-cool) the inner walls of a chamber or to provide a pneumatic flywheel mechanism to temporarily store and balance rotating energy.

In another example of the system of FIG. 7, not shown but readily understood, it is possible to operate the rotary device 36' as an air cycle cooling system by inverting the positions of the heat exchanger 72 and the target space 22. The heat exchanger 72 in this example is configured to extract heat from the working fluid, much like the A-coil of a refrigeration system. Considering this example from the point at which atmospheric air is taken in through the compression chamber inlet port 88 (now leading directly from the target space), it is assumed that the valve 84' is held open by the regulator 96 until such time as the expansion chamber on the trailing side of a lobe 92 has drawn a sufficient volume of working fluid there behind. Of course, the retractable vane 94 at the 12 o'clock position closes one end of the expansion chamber by riding against the outer surface of the rotor 42. When the lobe 92 reaches a sufficient rotated position like those shown in phantom in the 4-5 o'clock position of FIG. 7, the regulator 96 closes the valve 84' thus trapping a fixed quantity of working fluid in the expansion chamber, which upon continued rotation forcibly reduces the pressure of the working fluid and creates a pressure differential below atmospheric. In this example, it will be assumed that the differentiated pressure reaches a minimum of 0.8 ATM.

When the trailing side of a lobe 92 crosses the expansion chamber outlet, working fluid at the differentiated pressure (0.8 ATM) is emitted to the low side heat exchanger 72, where it absorbs heat in the counter-conditioning manner described above. Upon reentering the rotary device 36' through the compression chamber inlet, the working fluid now has a higher temperature, but remains at or near the differentiated pressure of 0.8 ATM. The valve 84 associated with the compression chamber outlet 90 is again, in this example, configured as a check valve whose cracking pressure is equivalent to the pressure of the high side heat exchanger 72 which, in this example, is 1.0 ATM or ambient conditions. Thus, the working fluid in the compression chamber (i.e., on the leading edge of lobe 92) re-compresses from differentiated pressure (0.8 ATM) to the inlet pressure (1.0 ATM) until such time as the valve 84 automatically opens. Thereafter, working fluid in the compression chamber is expelled to the atmosphere in the target space 22 which is at the inlet pressure. Appropriate temperature sensors and/or pressure sensors 98 monitor the amount of heat being moved through the heat exchanger 72 and provide feedback to make appropriate corrections to close the valve 84' at the precise moment so that heat is moved with the minimum theoretical application of work. These operations occur without decreasing the volumetric efficiency of either the compression or expansion chambers. In fact, the full volume of all chambers is fully utilized at maximum efficiency at all times.

Of course, the device illustrated in FIG. 7, like the devices of FIGS. 1-5, and others, is well-suited to dual use in that the leading and trailing edge of the movable elements (i.e., vanes 34" and/or lobes 102) could readily change function vis-à-vis the compression/expansion and intake/exhaust modes if the rotary direction of the rotor 42 is reversed. Likewise, these elective reversals in compression and expansion operating behavior can be delivered in the same flow direction upon command, simply by changing the relative speed of the pumps in FIG. 5 and FIG. 6 or the valve cracking pressures and corresponding control timing as previously described for FIG. 7.

Another novel feature of this device 36' is that the working fluid moves through the four modes of intake, expansion, compression and exhaust modes without a change in lobe 92 direction. That is, the lobes 92 continue rotating with the rotor 42 without requiring a reversal of direction as is characteristic of piston and cylinder devices. Furthermore, it is well known that in the typical piston and cylinder device, peak and minimum pressures are generated when the piston is in its Top Dead Center and Bottom Dead Center positions which usually means that both ends of the connecting rod are aligned with crank shaft center line. In most piston/cylinder configurations, whenever both ends of the connecting rod align with crank shaft center line, the component of force able to produce or receive torque is zero. Only for those brief instants when then crank arm is offset 90 degrees is the leverage maximized so that the component of force able to produce or receive torque is at its peak value. By contrast to the typical prior art piston/cylinder arrangement, the device 36' presents a configuration in which the peak power can be sustained for a longer percentage of the cycle. In other words, the working fluid (e.g., air) either receives mechanical energy from or imparts mechanical energy to the lobes 92 at maximum leverage for a corresponding larger portion of the rotation of the rotor 42. This results in a more efficient, powerful and smoother performance, as compared with a comparable piston/cylinder device. When operated as a combustion engine, it also invites the opportunity to function with a reduced size or weight flywheel, if indeed a flywheel is even needed. The mention of combustion in connection to the device of FIG. 7 invites recognition of the "heat engine effect" in Convergent Refrigeration. As described previously, the highest thermodynamic efficiency is obtained when the mass air flows of any two working temperatures are counter-conditioned around the midpoint between these same two working temperatures, but this heat transfer temperature may be chosen electively based on many practical considerations other than maximum thermodynamic efficiency per se. For simplicity of illustration two devices 36' may be affixed back-to-back on the same axel with the first device counter-conditioning $T_{LOW}$, the heat source, to raise its temperature toward $T_{HIGH}$, the heat sink. The companion counter-conditioning of $T_{HIGH}$ is established to provide the optimum overlap through a heat pipe as will be described in more detail in later sections. The heat exchanger 72 would be replaced by a heat pipe affixed to accept heat rejected from the heat source, $T_{LOW}$. Its boiling point can be set with considerable flexibility to establish the heat transfer temperature anywhere between the two working temperatures.

In these preceding examples associated with FIG. 7, as well as in a closed loop system which is not described but will be readily understood by one of ordinary skill in the field, a device and method operating in this fashion is effective to move heat with a minimum theoretical application of work. That is, the subject method is effective to extract all of the mechanical energy invested into the working fluid, save frictional and/or heat losses consistent with the second law of thermodynamics. This may be augmented by adjusting the displacement volume of the expansion chamber relative to the compression chamber on an informed basis without decreasing the volumetric efficiency of the compression or expansion chamber as is described for example in U.S. Pat. No. 8,424,284 to Staffend, issued Apr. 23, 2013. It should be recognized that U.S. Pat. No. 8,424,284 is not prior art to the earliest priority application (U.S. Ser. No. 61/256,559) of this present invention, which priority application shares a common filing date and all of the technical disclosure of U.S. Pat. No. 8,424,284. As a result, the subject invention is capable of operating in a highly efficient manner, recovering or reclaiming all available work that has been put into creating a pressure differential in the working fluid while accounting for inevitable losses due to friction, heat transfer and the like.

Moving now to FIG. 13 and following, the foundational conclusion reached in connection with FIGS. 8-12 must be acknowledged. At or above the 95° F. Rating Point, the vapor phase operating task of compressing R410A vapor is identically equal to the compressing air operating task incurred in the reverse Brayton Cycle. Both systems lift the (air/vapor) refrigerant to temperatures well beyond the working temperatures. It will be detailed below that in fact the vapor of any vapor compression system behaves exactly as any reverse Brayton system on the vapor side of the loop. Indeed, in any closed loop refrigeration system, the excess lift penalty will have to be paid on both sides of the closed loop refrigeration system in order to acquire heat at $T_{LOW}$ and then to reject heat into $T_{HIGH}$, the equivalent of moving the refrigerant from $T_{evap}$ to $T_{cond}$ by any definition. There is no closed loop refrigeration option for reducing excess refrigerant lift.

As described in U.S. Pat. No. 8,424,284, the mechanisms and methods define themselves within a refrigeration paradigm which requires excess refrigerant lift. Any such practice, method, or mechanical technology requiring the temperature of the refrigerant to be lifted by the amount of Approaching Temperatures, in addition to the difference between the working temperatures, $T_{LOW}$ and $T_{HIGH}$, is to be labeled Divergent Refrigeration.

U.S. Pat. No. 8,424,284 has outlined the use of compression or expansion to raise or lower the temperature on one side of a heat exchanger 72 by means of using the ambient air as the working fluid refrigerant. This pump-based procedure uses adiabatic compression for cooling. The temperature of ambient air is raised from $T_{LOW}$ to $T_{HIGH}$, the difference between the two working temperatures. And in addition, the temperature is further raised by an amount above $T_{HIGH}$ equal to the outside approach air temperature differential. (See FIG. 8.) This temporarily heated inside ambient air flow can then be cooled by rejecting heat at the needed Approaching Temperature differential above $T_{HIGH}$. U.S. Pat. No. 8,424,284 also describes the reverse operation for acquiring heat by temporarily lowering the ambient air temperature.

The previously described FIG. 6 is a variation of what appears in U.S. Pat. No. 8,424,284. First, without modification, this apparatus may be used in to simply move air across the heat exchanger with ultra-low pressure change (in Fan Replacement mode) in a manner that captures an ~40% energy rebate of changing volumes. Second, without modification, this apparatus may use compression or expansion to raise or lower the temperature on one side of a heat exchanger 72 in the previously mentioned manner of counter-conditioning. The ambient air from the target space 22 is used as the working fluid refrigerant. When the approaching air-to-heat exchanger temperature differential is increased even slightly, the exchange of heat with the moving air stream is improved in a manner described as Convergent Refrigeration. Profoundly efficient increases in heat transfer will result when these approaching air-to-heat exchanger temperature differentials can be improved within the energy budget of the fans they replace and even when the cost of Convergent Refrigeration is used to augment conventional technology. Third, without modification, a pair of such Convergent Refrigeration devices may be set back-to-back with profoundly innovative and unexpected efficiencies to be revealed below. These three new uses are unprecedented in the art and can be readily distinguished from conventional examples of Divergent Refrigeration.

Recognizing that the cost of moving air alone commonly exceeds 30% of conventional air conditioning costs, it is attractive to consider simply replacing fans with pumps. Fans and blowers are notoriously inefficient. In addition to electric motor losses which range typically from 10%-25%, the fans themselves frequently waste as much as 85% of applied energy. These are the worst sorts of pumping losses. When viewed as air moving devices, pumps inherently develop the negligible pressure needed to propel a static column of air. Pumps move air as a relatively cost free byproduct that fans and blowers produce only wastefully. By simply reallocating the wasted energy of fans to very minor compression/expansion tasks it is possible to "refrigerate" many air streams without additional cost overall. These air streams already deliver the entire mass flow of air needed to perform all HVACR tasks.

The previously mentioned technique of Fan Replacement identifies the opportunity to reclaim losses from free expansion. When heat is exchanged with air inside the plenum 24, the volume of the air changes. This volume change is even defined into the coefficient of specific heat for heat transfer at constant pressure. For air at atmospheric pressure the work potential of changing volume is equal to 40% of the heat transferred. Instead of using fans, air can be moved by well-established commercial pumps proven to deliver efficiency above 95% at needed pressure ratios. At present such pumps are more expensive than fans, but lower cost options and operating cost offsets will be described.

The prevailing latent heat argument asserts that air does not provide sufficient heat capacity for refrigeration. This widely held belief falls categorically before the indisputable fact that all latent heat (vapor compression) refrigeration necessarily requires a mass flow of air sufficient to carry all the heat into and out from every vapor compression system—twice in fact. Air alone carries the entire heat load of vapor compression on both sides of every vapor compression system. This fact confirms that air possess adequate heat capacity. Furthermore, at higher temperatures as explained below, there is no contribution from latent heat in the vapor compression cycle anyway. The reality is that a vapor phase refrigerant with a lower specific heat than air can do and does do the entire refrigeration job without latent heat, and contrary to popular beliefs it does so even inside what is identified as a vapor compression refrigeration system.

According to one aspect of the present invention, referred to as the Fan Replacement technique, traditional fan blowers are replaced with pumps 76, 78 located at opposites ends of a gated plenum 24 so as to capture lost energy of free expansion during heat transfers. The bonus is a direct work dividend equal to 40% of all the heat moved. Convergent Refrigeration systems radically increase efficiency by eliminating excess refrigerant lift across the heat exchanger 72 from the nominal values of $T_{evap}$ and $T_{cond}$, but the identified excess refrigerant lift barely hints at the unacknowledged and extreme energy waste of high pressure ratios, the temperature swings of superheat which are actually required to do the job of vapor compression refrigeration. Convergent refrigeration accomplishes the task with counter-conditioning as previously outlined, using a heat transfer temperature (the midpoint of any appropriate air-to-air heat exchanger or heat pipe) nominally set between the two working temperatures. The distinctive advantage of Convergent Refrigeration is improved efficiency with a reduction in total refrigerant lift for operation between any two working temperatures. The entire energy cost of running compressors to supply the extreme pressures of vapor compression refrigeration loops is zeroed out by any suitable air-to-air heat exchanger 72. This yields particular benefits when placed between two counter-conditioned Convergent Refrigeration air flows as described below.

Figure 15:
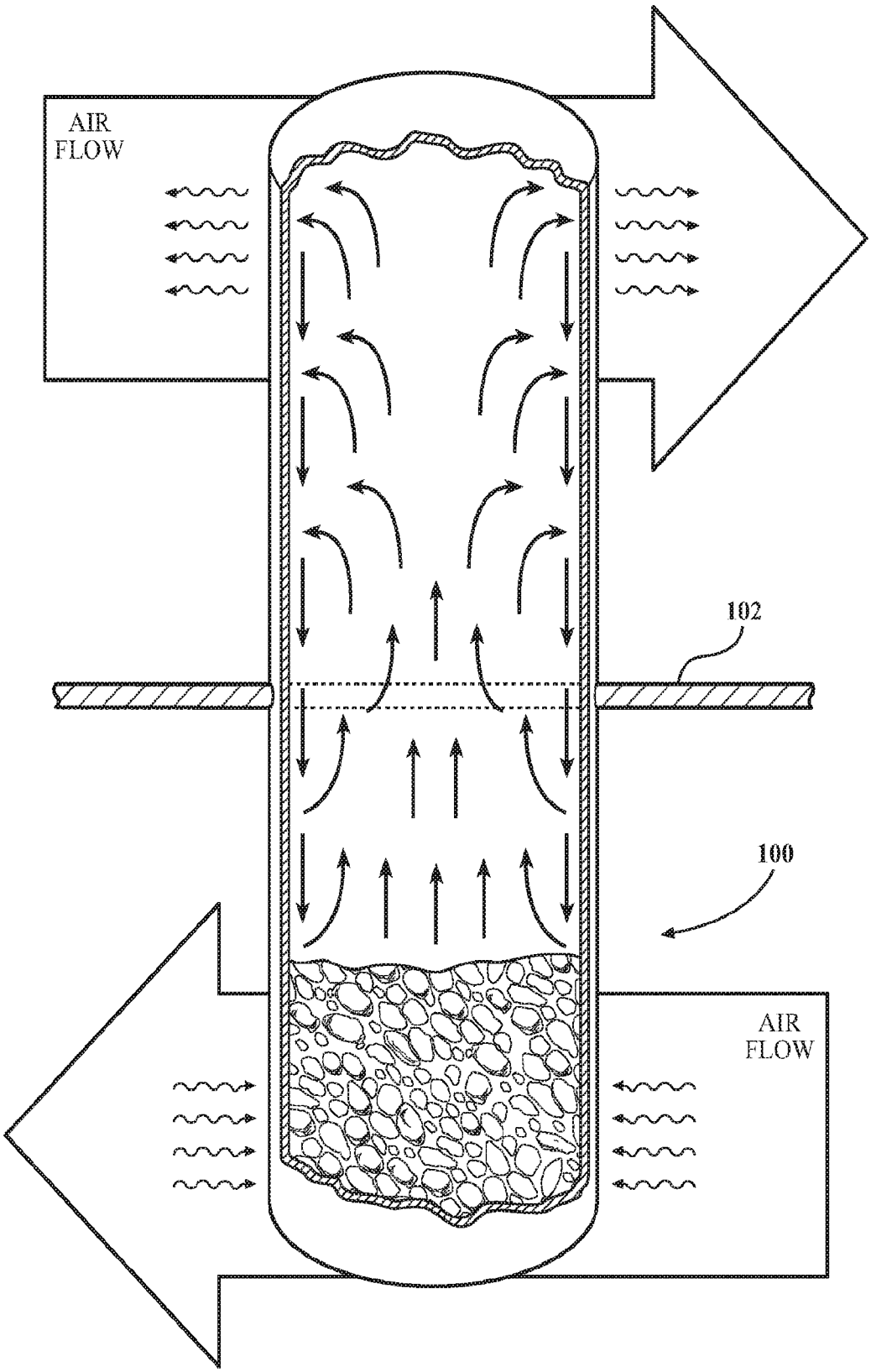
FIG. 15 is a simplified illustration of a heat pipe, it being understood that a heat pipe of this configuration represents but one example of the many different types and configurations of air-to-air heat exchangers applicable to the teaching of this invention.

FIG. 15 presents a simplified illustration of a heat pipe 100. In testament to the effectiveness of heat pipes 100, ASHRAE concluded in its "Examination of the Role of Heat Pipes in Dedicated Outside Air Systems (DOAS)" (25 May 2012) that heat pipes provide "the most energy efficient and economical systems available, bar none!" In the example immediately above, the air-to-air heat exchanger 72 may be in the form of such a heat pipe 100, given that a heat pipe 100 is notably superior with optimum temperature differential as low as 5° C. The refrigerant hermetically trapped inside a heat pipe 100 circulates from evaporation to condensation moving heat physically from one end to the other. The heat pipe 100 uses only the energy from the latent heat that is being moved. The shape of the heat pipe 100 can be a network of tubes, even flattened to work on the back of a compact cell phone. Evaporation takes place at the heat source. The vapor travels naturally to the cooler sink where the vapor rejects heat, dropping off its stow-away (i.e., accumulated) latent heat. With latent heat, fewer molecules are needed because each one carries so much stow-away heat.

The cooled vapor will condense and return to the liquid state. The cooled liquid then flows back to the hot end for another load of heat. This natural heat conveyor runs naturally, i.e., without requiring any additional input power. Only a single boiling point is involved and the pressure is unchanged throughout this closed two-phase refrigerant system. As is well understood for such refrigerants, the boiling point may be regulated by simply moderating the heat pipe system pressure. All the power for transporting and eliminating unwanted heat is supplied by the energy of the heat to be eliminated.

Air flows are separated in this illustration by a partition 102 which prevents mixing of the heat flows or air streams. In practice the hot and cold ends of the heat tube 100 may be some distance apart. The hot end may be in direct conductive contact with a heat source such as a component inside a computer enclosure (e.g., computer chip), a CPU cooler, any heat-emitting electronics enclosure or cell phone processing chip as mentioned previously. The liquid boiling point may be set to match precisely the temperature of the heat input by changing the pressure on the liquid (refrigerant) inside the heat pipe 100. Indeed, the liquid refrigerant may even be pumped for some distance and to new elevations at low cost because no change in pressure is required.

Those of skill in the art will understand that the specific configuration of a heat pipe 100 as illustrated in FIG. 15 is meant to represent the much wider array of heat pipes and other air-to-air heat exchangers available on the market. Indeed, conventional fin-and-tube heat pipe heat exchangers, such as those supplied by Advanced Cooling Technologies, Inc., Heat Pipe Technology, Inc. and others which utilize a single-pressure, single boiling point, two-phase refrigerant that may be gravity fed or pumped as a liquid, will provide satisfactory results in the context of this present invention. These kinds of heat pipes 100 are of the same form factor (i.e. size, dimensions, and air flow characteristics) as vapor-compression fin-and-tube heat exchangers, and they are believed to demonstrate very much better performance as heat exchangers than comparable vapor compression heat exchangers of the same dimensions. Furthermore, these latter types of heat pipes 100 eliminate the cost of compression because they do not require pressure changes (compression).

One may ask, "What is the least costly way to change the temperature of the air in the room?". It has always been known and always understood that, whether heating or cooling, the needed mass of air must be passed over a heat exchanger. Air has the needed heat capacity. It has long been known that heat transfers into the air faster when the approaching air temperature is farther away from the temperature of the heat exchanger. However, it is not well understood that 40% of the heat is lost in free expansion when gasses expand and contract (due to temperature changes) without harnessing the potential work available within the context of those volume changes. Heretofore, no recognition has been given to the fact that the cost of changing the air temperature before it interacts with the heat exchanger can be much less than the cost of changing the heat exchanger temperature by the same amount. The present invention explains how this behavior can be realized with significant advantages in commercial HVACR.

The present invention proposes better ways to heat and cool air, through the techniques of Fan Replacement and Convergent Refrigeration (i.e., counter-conditioning), which will be described in even greater detail below. By placing the heat exchanger 72 within a plenum 24 gated between two pumps 76, 78, it is possible to capture a 40% energy rebate provided by nature every time heat is transferred into air, which is the basis of the Fan Replacement concept. This same 40% guaranteed energy rebate is also provided in counter-conditioned air flows wherein the pressure is increased, i.e. heat source air streams intended to reject heat from $T_{LOW}$. (The mechanics of reducing air pressure between two pumps unfortunately requires the initial reduction of pressure in the plenum 24 as well as its maintenance, so the opportunity to capture work from volume change exists only in positive pressure mechanical systems. This provides an argument for counter-conditioning only the heat source air stream and utilizing Fan Replacement exclusively on the heat sink side to reclaim all the benefits of work due to volume change throughout. The best theoretical heat transfer temperature is thermodynamically nonetheless still clearly the midpoint between the two working temperatures. It remains to be seen how practical mechanical considerations may influence improvements in real world settings.) To secure the most favorable temperature gradient between air and any convective heat source or sink, it costs less to change the temperature of the air (i.e., counter-condition) than to change the temperature of the heat exchanger 72 by divergent refrigeration means. This is Convergent Refrigeration.

Figure 17:
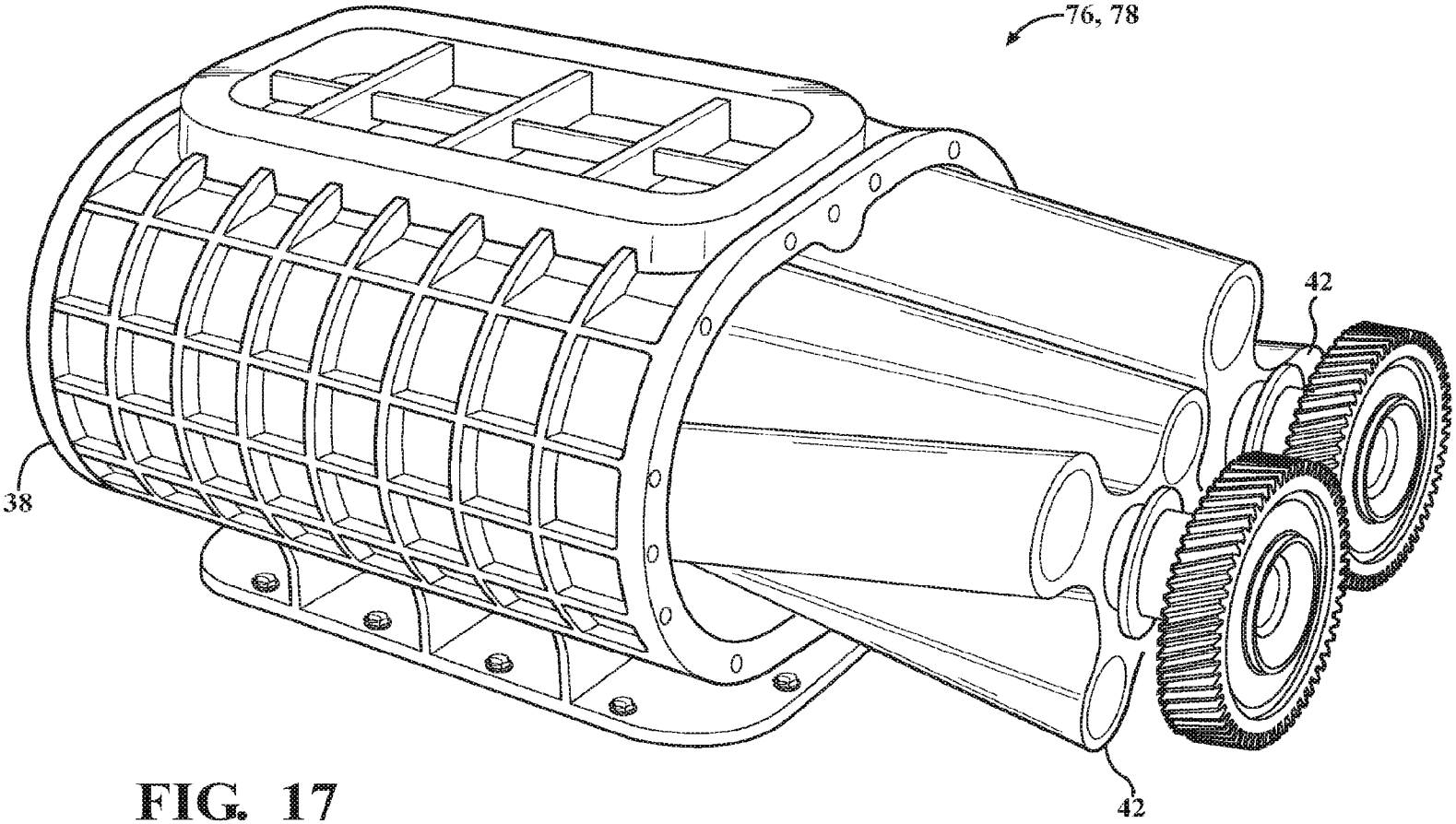
FIG. 17 is a perspective view of a Roots® type blower which may be used to form one or both of the first and second pumps of this invention.

The following analysis separates the cost of moving air with pumps from the cost of compression mirrored by a complimentary expansion in the same air stream by using a pair of Dresser Roots® Blowers. As illustratively depicted in FIG. 17 for the rotary pumps 76, 78, a Roots® type blower is characterized by a pair of lobed rotors supported in close parallel contactless proximity to one another for counter-rotation within a common housing. The two rotors are entwined together such that their respective lobes harmoniously mesh much like gear teeth, but in this case, ideally without touching. (Please note that FIG. 17 offers but one possible expression of a rotary pump, and indeed even only one possible form of a Roots® type blower. The depicted Roots® type blower is shown in FIG. 17 having four lobes per rotor; whereas in FIGS. 18-19 the depicted Roots® type blowers 76, 78 have three lobes per rotor. Some Roots® type blowers are configured with two lobes per rotor, and some may even have more than four lobes.) This analysis will identify the energy costs attributable to compression, separating them from the cost of moving air through the positive displacement system. It will be shown that once the compression energy (offset by expansion and work capture during heat transfer) is subtracted from total work input, the cost of moving air through the dual pump 76, 78 system is well below the cost of moving the same mass flow of air with traditional blowers or fans.

Dresser URAI® blower performance is specified for the whole family of blowers in the available literature. (Dresser, Universal RAI and Roots are registered trademarks of Dresser, Inc. Data provided in URAI Spec Sheet S-12K84 rev. 0608 provides the basis for conclusions which follow.) Mass flows are suitable as stated because air flows in refrigeration systems are normally driven by fans. The desired changes in pressure (temperature) maintain the same mass flow. Dresser URAI® specifies inlet pressure of 14.7 psia at 68° F., specific gravity 1.0. Vacuum discharge is 30" Hg as well as all relevant performance data for commercial purchase. It can be seen in the published literature that at 1 psig and 6 psig, the energy cost to both move and compress a cubic foot of air increases roughly linearly across the range of flows and pressures regardless of the device actually chosen. Because the proposed air flows of convergent refrigeration systems will operate primarily near atmospheric pressure ±10%, rarely exceeding 20% differences, only the published data associated with 1 psi governs the relevant conclusions. Others provide confirming data beyond this range.

Rather than simply moving the air, the objective of the counter-conditioning utilized by Convergent Refrigeration is to move a comparable mass flow of ambient air through a pressure differential sufficient to change its Approaching Temperature to a desired level in relation to the heat exchanger 72. In conventional systems, the ambient (target environmental) mass flow is passively fed across a heat exchanger 72 whose temperature is separately engineered to provide the desired rate and direction of heat flow. Contrast this to Convergent Refrigeration systems of this present invention where the ambient (target environmental) mass flow is used as the refrigerant. The temperature of CR mass flows is engineered to provide the desired rate and direction of heat flow now being exchanged with a passive heat exchanger 72 whose source or sink is thermodynamically considered to be outside the thermodynamic system under consideration.

Correspondingly, in order to compare the energy that would otherwise be required simply to move the air, it is necessary to identify the cost of compressing the air and subtract that compression cost from the reported cost of compressing and moving the air. The reported cost of compressing air as reported inherently includes the cost of moving the air, so the thermodynamic work assignable to compression alone is easily computed and subtracted from the reported total to reveal the cost of moving air alone in these Roots Blowers.

For the case where no heat is transferred following compression, a follow-on expansion process might recover the entire energy cost of compression directly by complimentary mechanical means. The Roots® Blower offers such a mechanism, as one example of a suitable mechanism implementing the pumps 76 and 78. Other types of rotary pumps 76, 78 are also possible as described herein. Notably this energy recovery mode during expansion is different from both the compression operation and the vacuum pump for which data is available. But a free-wheeling exit pump 78 would not sustain the plenum 24 pressure as needed for heat transfer under constant pressure. An electrical load would be provided to the motor/generator 68 (FIG. 13) governing the speed of the exit pump 78, making it act in a manner effectively identical to the entry pump 76. So the cost of compression would be exactly offset by expansion, accepting of course that there are losses to be recognized on both sides.

For the case where heat is acquired within the plenum 24 (i.e., heat is moved from a higher temperature heat exchanger 72 into lower Approaching Temperature air flowing through the plenum 24), the resulting increase in volume of the air in the plenum 24 will directly increase the energy recovered at exit, in the fashion of a heat engine. Thermodynamically, the addition of heat yields work. The introduction of heat between the two pumps 76, 78, as in FIG. 5, may be considered somewhat analogous to a jet aircraft engine, producing a direct energy yield (expansion of gas at constant pressure) due to the introduction of heat. Indeed, as defined by the coefficient of specific heat under constant pressure, nature provides an energy bonus equal to 40% of the heat acquired, a volume increase which can produce electricity to offset the power used in compression. Whether in the mode of Fan Replacement or the Convergent Refrigeration, any such configuration does indeed generate "air power" in refrigeration. Moreover, Fan Replacement must be recognized for returning a 40% harvest from the heat energy that has just been transferred.

For the case where heat is rejected within the plenum 24 (i.e., heat is moved from the higher temperature air flowing through the plenum 24 into a lower temperature heat exchanger 72) the resulting decrease in volume will directly decrease the energy recovered at exit. In this case the departure of heat from the air mass within the plenum 24 reduces the volume of the air (but not its mass) by 40%. Strikingly, this reduction of volume also affects the system and its net energy consumption in a manner analogous to the heat engine behavior described above because work can be extracted from the larger volume of air entering the plenum. Because the plenum 24 pressure must be maintained in Fan Replacement, the exit pump 78 energy expenditure is offset by the greater volume of air drawn through the entry and energy is recovered there.

When all is accounted for, the transfer of heat makes a 40% contribution to offset the losses related to compressing and expanding the air within the plenum 24. This net contribution may substantially offset pumping losses depending on the capability of the pumps 76, 78 as well as on the compression ratios and the heat finally transferred. Because this exercise is limited to published pump performance at a pressure of 1 psig, a pressure ratio of 1.068, it can be confidently assumed that compression costs will be offset by expansion gains and vice-versa. Looking at the operating energy requirements reported by Dresser®, the full value of compression/expansion energy may be subtracted from the operating energy cost, leaving all losses chargeable to air movement alone.

Any pump actually designed and developed for these low pressure ratios may be expected to meet or exceed all currently reported performance specification. Because the Roots® Blower was intended for much higher pressure ratios, it is reasonable to benchmark compression performance at 90%, knowing that the entire cost of compression and expansion will be directly offset, i.e. zeroed out. For example, Dresser® Frame #718 delivers 1590/0.81 CFM/BHP total or 2628 CFM/Kw for air movement alone, after the cost of compression has been removed. Compared to residential HVAC air flows (2,000 CFM/Kw inside and 4,000 CFM/Kw outside), any such 2628 CFM/Kw unit will deliver heating and cooling comfortably within the energy budget of present fan systems alone.

The analysis has identified several factors which control the energy needed to change the pressure of a mass flow of air within a gated plenum 24 between two pumps 76, 78. Whether the temperature between the pumps 76, 78 is changed or not, and whether heat is transferred or not, the complimentary compression/expansion energy can be definitively identified. Subtracting this fully recovered compression/expansion energy component from the total pumping energy reveals the cost of moving air through the system, nominally through the connected system where the follow-on pressure is measured only in inches of water. The cost of moving air through the dual pump system is well below the cost of moving the same mass flow of air with fans. This simple reality confirms that the two-pump and plenum air moving system can confidently be accurately labeled as Fan Replacement.

The common Roots® Blower was initially developed more than a century ago for high compression applications. It is machined from cast metals. Even when adapted for supercharging high performance automotive vehicles, the lighter weight versions of the Roots® Blower still rely on machined castings. In U.S. Pat. No. 7,621,167 to Staffend, issued Nov. 24, 2009, a method is taught for replacing such castings with light weight roll-formed products that inexpensively deliver three orders of magnitude better surface finish than the best attainable machined casting. The results displayed above can be mass produced with dramatic cost reductions. Much more importantly, the combination of inexpensive mass production with the disruptive market opportunity presented by Convergent Refrigeration invites a vast new wave of innovation for related HVAC products as well as many other pumps and engines throughout the Pressure v. Volume product space.

All traditional fans waste the work component of $c_p$, the coefficient of specific heat under constant pressure. This is the energy saving opportunity that is currently unrecognized, even denied, in academic and industry teachings on heat transfer. The present invention identifies and takes advantage of this phenomenon, resulting in the equivalent of a 40% instant energy rebate.

Using a pair of Roots® Blowers for the two rotary pumps 76, 78 operating at pressure ratios within 20% of atmospheric, and more preferably within 10%, the efficiency of each blower or positive displacement pump is near 0.9. Combined efficiency is thus characterized as 0.9*0.9=0.81. Utilizing a typical 3-ton household air flow of 1250 CFM through the HPT heat exchanger 72 HRM 3040 calls for the following power.

kW=CFM/(11674*Motor Eff*Fan Eff)

kW=1250/(11675*(0.9*(0.9*0.9)))=0.147 kW

As expected, using a pair of positive displacement pumps 76, 78 will move air more efficiently than the traditional fan they replace. When heat is exchanged with the transient air column moving through the plenum 24, the bonus harvest of ~40% of the heat exchanged will be reduced by pumping losses. Nonetheless, Fan Replacement at or near the ultra-low pressure ratio of 1.0 still yields a net gain quite close to this goal.

The Fan Replacement technique of this present invention corrects for the widespread, perhaps universal failure to comprehend the work lost as free expansion in common situations involving $c_p$. The premier academic authority (incorrectly) defines convection with the stipulation that the density of the gas does not change during heat transfer. In spite of the fact that the amount of heat exhausted by both automotive and jet aircraft engines is correctly computed with $c_p$, textbooks uniformly fail to mention that the work component of heat engine exhaust is necessarily never captured in convective heat transfer in the same manner as it is in combustion contexts. The work component of $c_p$ is wasted as free expansion in the exhaust of every heat engine. The same failure to recognize the work component of $c_p$ is pervasive throughout the literature on refrigeration as well.

Fan Replacement means quite literally to replace the traditional fans in forced air convection systems with a plenum 24 gated at each end with a rotary pump 76, 78. Traditional fans will blow the same mass flow of air into heat exchangers regardless of changing heat demands, mindlessly intent on driving out the air that was previously heated. In contrast, the Fan Replacement technique meters in fresh ambient air at the full value of its Approaching Temperature as needed to attain the greatest efficiency in managing optimum mass air flow and temperature differential in contact with the heat exchanger 72. As costly as it may be to run two rotary pumps 76, 78 in a forced air convection system, the benefit in accelerating heat transfer has justified the expense. Traditional fans are energy inefficient; the opportunity to claim an instant energy rebate of 40% is presently wasted as free expansion whenever traditional fans are used. Fan Replacement collects the 40% guaranteed energy rebate by simply enclosing the heat exchanger 72 in a plenum 24 gated by two pumps 76, 78.

Consider a simple prior art space-heater, such as a 1000 Watt tungsten space heater equipped with a built-in 100 Watt fan. In this example, the 1000 Watt tungsten heating element corresponds to the heat exchanger. The 100 Watt fan moves a definable mass flow of air. Using principles of this invention, the same mass air flow can be moved across the tungsten filament using a pair of pumps 76, 78, consuming the same 100 Watts that would otherwise run the fan. An honest 400 Watt rebate is achieved on the Kilowatt space-heater when the principles of Fan Replacement are applied. The Kilowatt of heat costs a net 600 Watts. Of course the same price must be paid for moving the same air over the same heat exchanger. This example illustrates a simplified case of the Fan Replacement technique, in which the heating element (i.e., the heat exchanger 72) is located within a plenum 24, and the built-in blower fan is replaced with the pumps 76, 78 gating opposite ends of the plenum. Beyond the suggested repackaging of any tungsten filament space heater, Fan Replacement will harvest otherwise wasted energy from a myriad of similar devices and circumstances. Consider, for example, the notorious cost of running (cooling) computers especially in computer centers. Instead of paying twice (once for the cost of running the computer and once again for the refrigeration to cool it) Fan Replacement can cut the cost of running the computer by 40% while cooling it at the same time. The operating costs for the average Data Center are cut by 70% with Fan Replacement.

The configuration, processes, and uses of the Fan Replacement technique will next be described in relation to the heating and cooling requirements of a target space 22 in which the heat exchanger 72 is supplied by water. For heating only, water-supplied room heat exchangers have been prominent in buildings as well as in homes. The oldest configurations utilize hot water or steam for heating. Updates have transformed the old fashioned radiator into stylish baseboard units. Modern building systems integrate cooling water and heating water into the same circulated water systems. Modern building systems are supplied by cooling towers as well as boilers. In the most energy efficient of all new configurations, the year around water supply will utilize geothermal water sourcing. Because the Approaching Temperatures presented by cooling towers are so much smaller than the Approaching Temperatures presented by water heated in boilers or steam, fans will be present in all cases where cooling is to be incorporated. Fans are needed to accelerate heat transfer in cooling, due to the much smaller Approaching Temperatures supplied by either cooling towers or geothermal sources.

The potential for replacing fans in other configurations where air is blown over a heat exchanger supplied by other refrigerant types, in particular air, CO2, CFC's, HCFC's, etc., are as varied as are the other refrigerant types and the circumstances in which they are used. Different configurations, processes, and uses, can be engineered to each refrigerant type.

A first purpose of this Fan Replacement configuration, as described above, is simply to capture the work otherwise lost in free expansion. By replacing the traditional fan as the air moving device with a pair of pumps 76, 78 gating opposite ends of a plenum 24, it becomes possible to contain the heat exchanger 72 in the plenum 24 wherein the pressure may be maintained as a constant while heat is transferred to or from the moving column of air. Because any heat exchange necessarily provokes a change in the volume of the air inside the plenum 24, the very process of maintaining a relatively constant pressure (ultra-low differential) assures that the work associated with free expansion will be recovered. To reiterate, the pressure inside the plenum 24 is maintained generally constant by controlling the relative speeds of the rotary pumps 76, 78 via their respective motor/generator units 68 (FIGS. 13 and 16) or via a shared transmission 86 (FIG. 6) or by any other suitable means. By speeding one rotary pump 76, 78 relative to the other, the pressure inside the plenum 24 can be manipulated. For example, in a case where heat is being transferred into the transient air column within the plenum 24 from the heat exchanger 72, the second rotary pump 78 may be allowed to rotate faster so that the expanding volume of the air inside the plenum 24 does not result in a pressure increase—or at least not a pressure increase greater than about 20% and more preferably in the ultra-low range between 0-10%. In this example, which may then be likened to a heat engine, the motor/generator unit 68 associated with the second rotary pump 78 is used to capture the energy in the heat-induced expansion of the air inside the plenum, which energy rebate has the effect of offsetting the overall energy requirement to drive air through the plenum 24 by about 40%. Another way to view the energy capture phenomenon in this heating mode of operation is to simply slow the rotating speed of the first rotary pump 76 thereby reducing its energy consumption.

In another example, heat is being transferred into the heat exchanger 72 from the transient air column within the plenum 24, in an air-conditioning mode of operation. In this case, the volume of air inside the plenum 24 will be induced to shrink, such that the pumps 76, 78 must be controlled to maintain a generally constant static pressure inside the plenum 24 (i.e., less than 20% relative to ambient atmospheric pressure, and more preferably within the ultra-low 0-10% range). In this case, the motor/generator unit 68 associated with the second rotary pump 78 may be used to slow the rotating speed of the second rotary pump 78 (relative to the first pump 76) thereby reducing the net energy consumption required to move air through the plenum 24. The energy reduction in this case is also calculated to be about 40%.

Acceptable performance from commercially available Roots® Blowers has been validated for pressure ratios up to 1.06. At a pressure ratio between 1 and 1.2, and even more preferably between 1 and 1.1, these devices may move a mass flow of air more efficiently than common fans. At a pressure ratio between 1 and 1.2, and even more preferably between 1 and 1.1, these devices can move the same mass flow of air within the energy budget of the fans they replace and at the same time capture the energy otherwise lost through free expansion. Note that in this case the energy rebate of about 40% has been captured only in relation to the transfer of heat for which the subject HVAC system is already specifically in service to achieve. That is to say, the HVAC is being operated—at cost—to change the temperature of ambient air. Rather than neglecting the energy inherent in the free expansion of the air due to its changing temperature, the concept of Fan Replacement will supplement even established HVAC systems by harvesting a 40% energy rebate (otherwise lost to free expansion) wherever forced air convection is now used. The full value of the so-called rebate is thus captured here. Nonetheless, once the heated (or cooled) ambient air exits the Fan Replacement system, that air will return to room temperature within the target space 22 under circumstances of free expansion, i.e. without yielding work.

The advantage of replacing fans in every forced air convection application is clear, depending only on the relative offset cost of the replacement pumps 76, 78 and plenum 24 arrangement. In perhaps every configuration where traditional fans blow air over heat exchangers, those fans can be replaced to advantage using the techniques of Fan Replacement. Recognizing that well over 30% of conventional (prior art) air conditioning energy goes to moving the air through heat exchangers, it is attractive to consider the replacement of fans with pumps 76, 78 configured within a gated plenum 24 as described herein. Fans and blowers are notoriously inefficient, commonly wasting as much as 85% of applied energy. These losses result primarily from the wasteful way that fans and blowers attempt to propel air into the resistance of a static column of air. The technique of Fan Replacement capitalizes on the opportunity to reclaim ~40% of the heat energy exchanged while moving air with well-established commercial pumps 76, 78 proven to deliver efficiency above 95% at the needed pressure ratios of between 1 and 1.2, and more preferably in the ultra-low range between 1 and 1.1.

The core concept of a plenum 24 gated on each end with a rotary pump 76, 78 used to implement the Fan Replacement configuration described above, can be further modified to improve the Approaching Temperature relative to the refrigerant. The efficiency of forced air convection depends on both the speed of air flow and the Approaching Temperature differential. The Approaching Temperature differential can be defined as the difference between the approaching air temperature and the refrigerant temperature. Fan Replacement naturally provides for speed control of the mass air flow entering the heat exchanger 72 by increasing or decreasing the rotating speeds of the first 76 and second 78 pumps. However, in a completely novel fashion the aforementioned system used to implement the Fan Replacement concept has the inherent capability to actively/intentionally alter the Approaching Temperature, thereby refrigerating the transient air flow within the plenum 24. This novel application of the core concept of a plenum 24 gated on each end with a rotary pump 76, 78 provides the mechanism and the procedure to implement an entirely new refrigeration practice which can be differentiated authentically from conventional refrigeration practices. The modification of Fan Replacement as described is necessarily the activity which Convergent Refrigeration defines to be counter-conditioning. In other words, the same apparatus may be used to replace fans by simply admitting ambient air at its unaltered Approaching Temperature, Fan Replacement, or the entering air stream may be counter conditioned, which is then Convergent Refrigeration.

All known refrigeration techniques documented in thermodynamic and HVAC industry literature are readily and consistently classed as Divergent Refrigeration. As stated above in connection with FIG. 8, Divergent Refrigeration, moves the refrigerant temperatures outside and beyond the range of the two working temperatures, $T_{HIGH}$ and $T_{LOW}$. In thermodynamic authorities, the refrigeration task is always to move heat from a lower temperature, $T_{LOW}$, to a higher temperature, $T_{HIGH}$, by the application of work. Thermodynamic authorities underscore that heat travels only downhill, from a higher temperature to a lower temperature. There is no possibility, according to thermodynamic authorities defining the present prevailing practice of Divergent Refrigeration, except to move the temperature of the refrigerant, $T_{evap}$, to a temperature below $T_{LOW}$. This is the only means by which the refrigerant can acquire heat from $T_{LOW}$. In order to absorb heat from $T_{LOW}$, $T_{evap}=T_{LOW}-\Delta T_{Refrigerant}$. In common commercial cooling systems, $\Delta T_{Refrigerant}$ is generally in the neighborhood of 20° C. Likewise in order to reject heat from the refrigerant into $T_{HIGH}$, the refrigerant must be raised to a temperature above $T_{HIGH}$, thus $T_{cond}=T_{HIGH}\ \Delta T_{Refrigerant}$. The work required to deliver just the excess refrigerant lift is 40° C., 20° C. in both directions beyond the span of the two working temperatures ($T_{LOW}$ and $T_{HIGH}$), even though the refrigeration task is only the amount of work it takes to move heat from $T_{LOW}$ to $T_{HIGH}$. Refrigeration task work is by definition no more than the difference between the two working temperatures ($T_{HIGH}-T_{LOW}$). All proposed solutions must necessarily be measured against the refrigeration task as their figure of merit. For example, when the working temperatures ($T_{LOW}$ and $T_{HIGH}$) are 20° C. and 40° C., the actual work required is to move the refrigerant from $T_{evap}$ to $T_{cond}$ is fully 60° C., i.e., from 0° C. and 60° C. This movement is 40° C. in excess of the difference between working temperatures $T_{LOW}$ and $T_{HIGH}$. The best attainable theoretical performance is thus understood to be: COP=273/(333−273)=4.55

Convergent Refrigeration uses counter-conditioning to dramatically reduce the needed refrigerant lift, raising thermodynamic efficiency to unprecedented levels in common refrigeration tasks. Counter-conditioning alters Approaching air flow Temperatures. Convergent Refrigeration mechanisms can substantially alter the economics of whatever is going on "on the other side" of the heat exchanger 72. In that sense, Convergent Refrigeration can be said to "reach through" the heat exchanger 72.

For example, in systems where the heat exchanger 72 is fed by water (for either heating or cooling), building energy professionals agree that for every degree they can reduce the energy spent changing the temperature of the refrigerant supply water they can cut the cost of delivering that refrigerant water temperature by 1.5%. In other words, for every degree of improvement in the Approaching Temperature (convergently reducing the excess refrigerant lift), the operating cost of the underlying HVAC plant is reduced by 1.5%. These are far greater cost reductions and energy efficiency gains than are delivered just by the acceleration of convection in local heat transfer. By temporarily (convergently) raising $T_{LOW}$, the low temperature ambient air stream, toward its opposite working temperature, by even a degree or two, significant savings can be realized. The same relationships are commonly found when Convergent Refrigeration is used to (convergently) lower $T_{HIGH}$, the high temperature ambient air stream, toward its opposite working temperature. More notably, large gains can be delivered in refrigeration efficiency as measured by the COP. A single degree of counter-conditioning temperature change yields a huge change in COP. COP=273/(274−273)=273

Convergent Refrigeration increases (i.e., counter-conditions) the Approaching Temperature, simultaneously accelerating heat transfer and in some cases increasing the aforementioned energy rebate described by application of the Fan Replacement concept. And in most if not all cases, the underlying cost of improving the refrigerant supply temperature will be found to be large relative to the cost of increasing the Approaching Temperature according to these principles of Convergent Refrigeration. In other words, refrigerant lift (as seen by the underlying refrigerant supply system) may be cut with large and favorable consequences because the Approaching Temperature can be maintained within air movement costs covered by Convergent Refrigeration. In addition to delivering very large benefits overall, the economics of dramatically slashing background heating and cooling plant costs skyrocket when focus is placed on room by room heating and cooling. The optimum reductions rapidly cut total costs in half or better, especially when occupancy may be less than one or two shifts for five days out of seven rather than 24×7. The most attractive gains come from geothermal where year-around heating and cooling can be accomplished by Fan Replacement mechanisms that are also capable of delivering convergently counter-conditioned Convergent Refrigeration air flows, completely eliminating the costs of the vapor compression apparatus and refrigerants which still accompany geothermal use. Consider a geothermally supplied heat exchanger 72 in FIG. 6. Counter-conditioning convergent refrigeration practice enables use of this heat exchanger 72 as the heat source in the winter and as the heat sink in the summer Room by room Convergent Refrigeration delivers the least expensive year around HVAC solution.

The company Heat Pipe Technology, Inc. (HPT) provides the following formula to compute power required to drive an air flow through a heat pipe 100 like that depicted illustratively in FIG. 15. A range of standard and custom heat exchangers 72 based on this (or similar) heat pipe 100 technology can thus be suggested along with a selection of air speeds to be incorporated in engineering the desired result. This exercise is strictly confined to the demonstration of feasibility in replacing vapor compression with Convergent Refrigeration Air Flows. HPT suggests motor efficiency of 0.9 and fan efficiency of 0.75.

kW=CFM/(11674*Motor Eff*Fan Eff)

The common Roots® Blower provides exceptional efficiencies at the pressure ratios needed for Fan Replacement (as described above) and also for Convergent Refrigeration flows. Not only is volumetric efficiency exceptional at all but the lowest air flows, the compression efficiency is so well matched by expansion efficiency that the Roots® device is often selected as a vacuum pump for other applications.

As mentioned above, when using a pair of Roots® Blowers for the two rotary pumps 76, 78 operating at pressure ratios near 1.1, the efficiency of each blower or positive displacement pump is near 0.9. Thus, the efficiency of two rotary pumps 76, 78 operating in the Convergent Refrigeration context is 0.9*0.9=0.81. The Convergent Refrigeration context is more generally between about 1.2 and 1, however pressure ratios closer to 1.1 and below provide the most favorable efficiencies as can be readily confirmed by FIG. 11. When pressure changes are introduced to generate Convergent Refrigeration flows at pressure ratios near 1.2, and even more preferably near 1.1, the pumping losses are far smaller than vapor compression systems operating at pressure ratios near 4.0. The direct thermodynamic gains are enormous, as reflected in the COP ($T_{LOW}/(T_{HIGH}-T_{LOW})$). This thermodynamic verity stands regardless of gains through Fan Replacement. This formula establishes the benchmark for moving mass flows of air through an efficient heat exchanger 72, such as one fitted with one or more heat pipes 100 for example. It can be taken therefore as given that two gating pumps 76, 78 in sequence along a plenum 24 can move the same mass of air as a fan but with less energy. Further, by intentionally changing the pressure within the plenum 24 between the pumps 76, 78, thus counter-conditioning the same mass of air that is necessarily moved across a vapor compression heat exchanger 72, the energy otherwise wasted on excess refrigerant lift and free expansion can be reclaimed. Indeed, the vapor compression loop and compression apparatus can be totally eliminated.

The drawing shown as FIG. 6 can be used to document the concept of using compression to raise or lower the temperature on one side of a heat exchanger 72. Increasing the air flow temperature (Approaching Temperature) above the heat exchanger temperature causes heat to be rejected into the heat exchanger 72. Reducing the Approaching Temperature of the air flow below the heat exchanger temperature induces the flow of heat from the heat exchanger 72 and into the air flow. The heat exchanger 72 can, of course, be a conventional refrigerant loop like that shown in FIG. 8 and FIG. 13, or a heat pipe 100 cluster like that shown in FIG. 16, or any other commercially available heat exchanging device.

Figure 8:
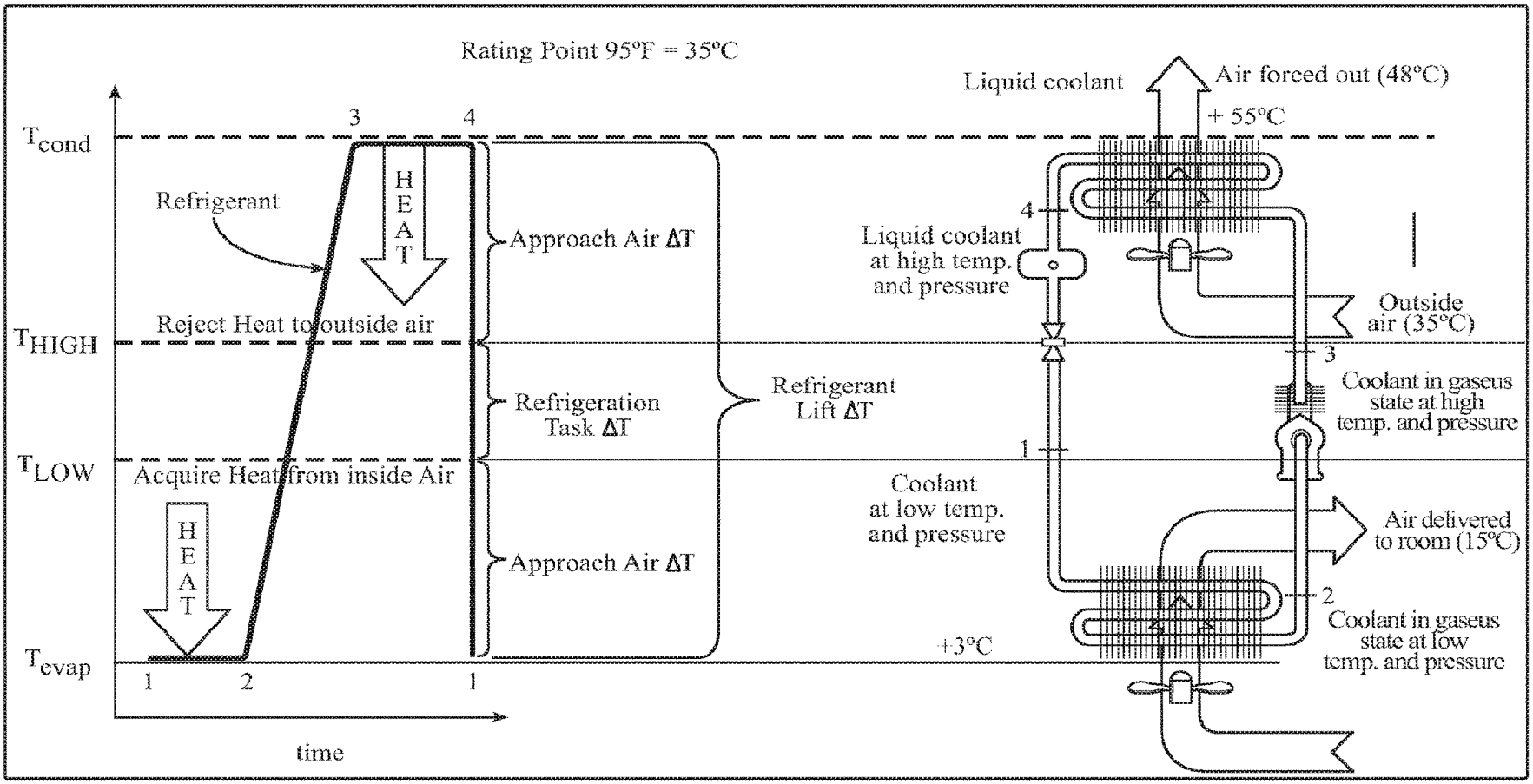
FIG. 8 PRIOR ART
FIG. 8 is a schematic diagram showing a temperature-time graph on the left-hand side and a corresponding diagram of a prior art closed-loop refrigeration system on the right-had side with locations 1-4 allowing correlation therebetween.
Figure 9:
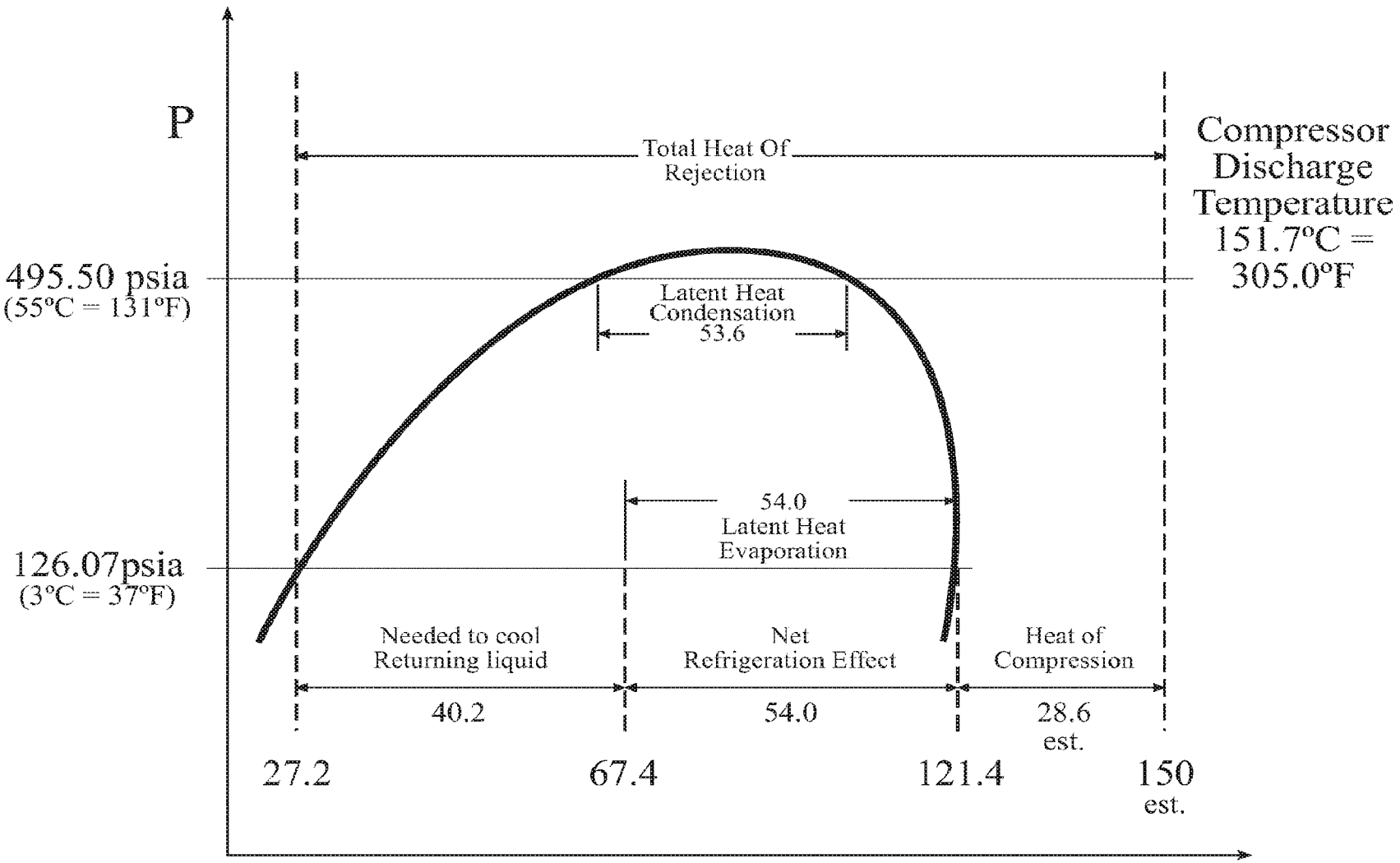
FIG. 9 is a Pressure-Enthalpy graph showing R410A at the 95° F. Rating Point.

As previously stated, all prior art vapor compression refrigeration schemes can be characterized as Divergent Refrigeration because the required excess refrigerant lift diverges from the refrigeration task. (FIG. 8.) Vapor compression systems of the prior art necessarily create the approach air temperature differential using excess (i.e., diverging) refrigerant lift as the only available means by which to cause heat to flow to and from the external air flows. Excess refrigerant lift in these prior art systems must be adequate to compel heat transfer through the heat exchanger 72 between the refrigerant loop and the external air flow. Excess refrigerant lift must be increased still further to assure the desired rate of heat flow into and out from the external air flows in balance with the capability of the refrigerant compressor.

Figure 10:
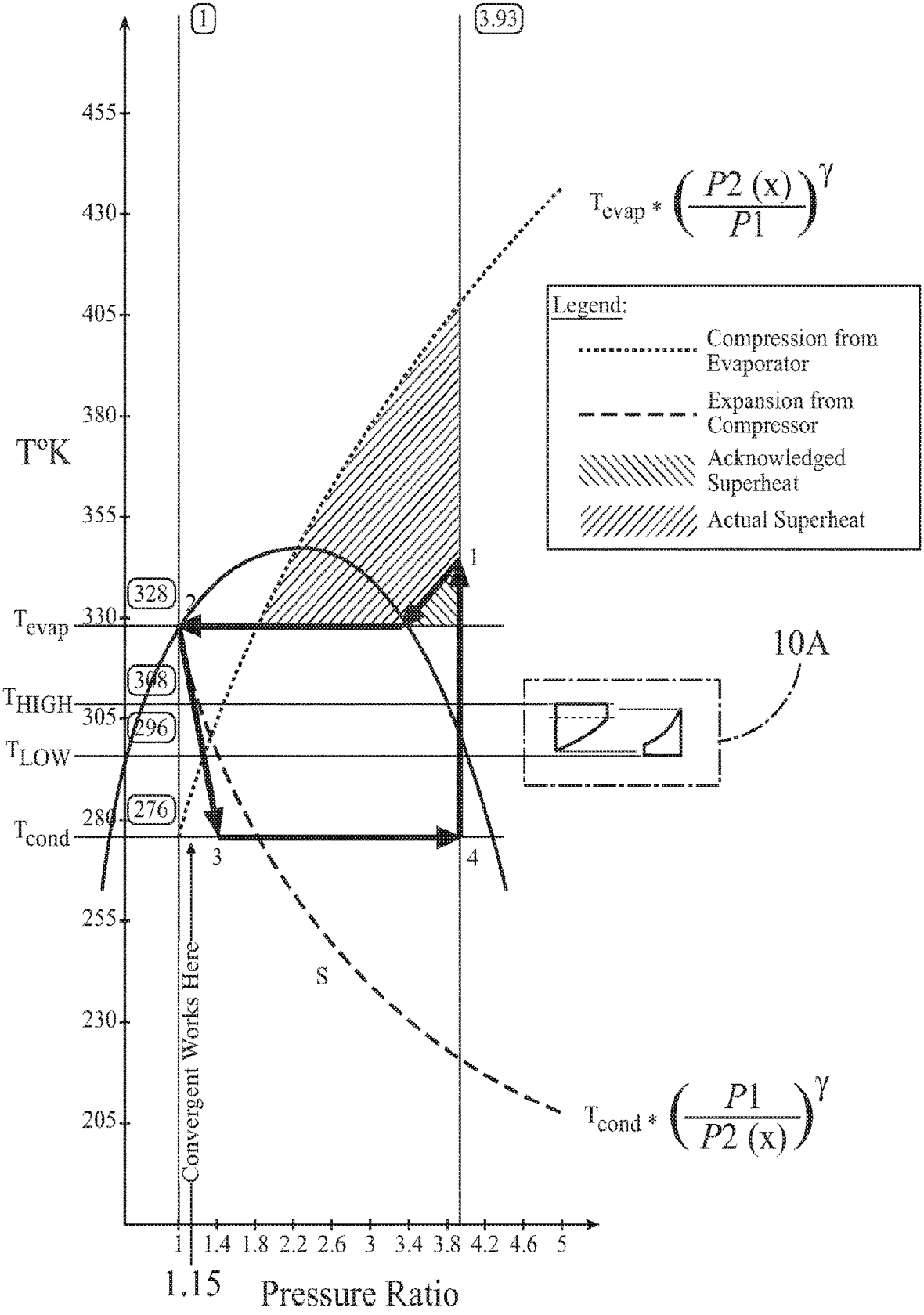
FIG. 10 is a Temperature-Pressure Ratio graph plotting changes in compressor and evaporator discharge temperatures as condenser and evaporator pressure ratios increase, overlaid with the corresponding Rankine Cycle T-s diagram.
Figure 14:
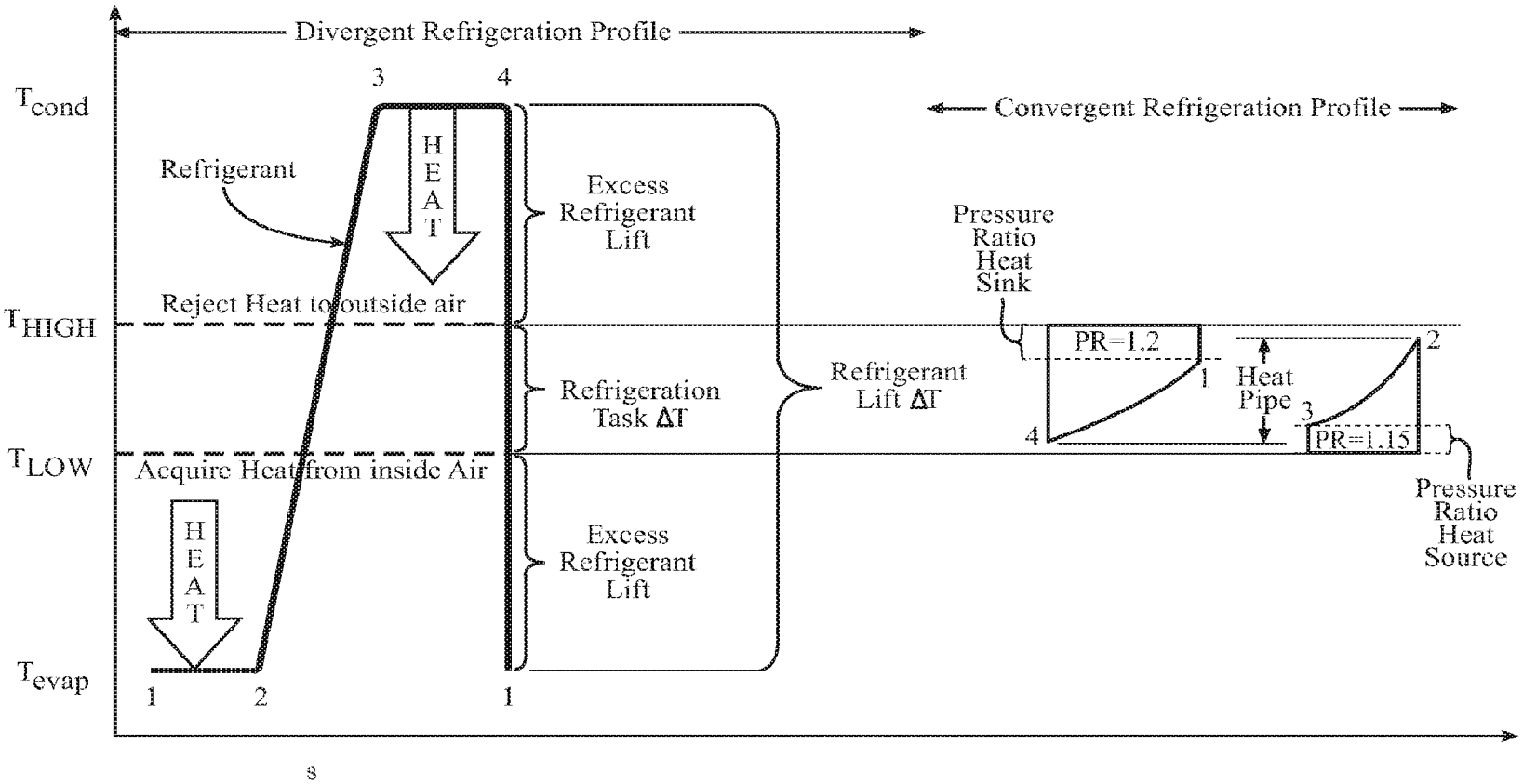
FIG. 14 shows the conventional vapor compression refrigerant temperatures beside a Ts diagram depicting the overlapping temperatures of two counter-conditioned convergent air flows like that of FIG. 10A describing a system configured as in FIG. 16.

The large temperature change characteristic for every prior art Divergent Refrigeration system including vapor-compression systems can be diagrammed as the Brayton Cycle on a Ts diagram taking into account the required excess refrigerant lift, i.e., between $T_{evap}$ and $T_{cond}$. Convergent Refrigeration, on the other hand, is performed between $T_{HIGH}$ and $T_{LOW}$. That is to say, Convergent Refrigeration can be diagrammed as a Brayton cycle on a Ts diagram operating within the confines of the refrigeration task as shown to scale in FIG. 10, with the functional detail magnified for easier viewing in FIG. 10A. Returning to Divergent vapor compression, the compression step from $P_{evap}$ to $P_{cond}$ is followed by heat rejection at constant pressure. This is exactly the same path followed by the vapor in every vapor compression system up to the point where condensation begins. Then liquid temperatures never fall below $T_{evap}$ and the latent heat of evaporation is offset by cooling the liquid and expansion losses. In vapor only systems, when there is no latent heat rejection, condensing the vapor to a liquid as in FIG. 9, the gas may be returned to its initial pressure. Because much of the heat produced by compression work has been rejected along the constant pressure curve, the gas expanding is cooler than it began as shown in FIG. 10. This cooler gas then acquires heat from its surroundings at the lower temperature at constant pressure. It is the mirror image of vapor-compression's most highly prized "superheat." The concept of Convergent Refrigeration may likewise enjoy the symmetrical advantages of sub-cooling as well. Convergent Refrigeration according to an aspect of this invention seeks to optimize the Brayton Cycle efficiencies by operating between the two working temperatures of the refrigeration task, i.e., between $T_{HIGH}$ and $T_{LOW}$ as shown in FIG. 14. Note especially that the temperature differentials needed to establish heat transfer are totally contained between the two working temperatures. Although this is not a necessary condition of Convergent Refrigeration it turns out that the best case thermodynamic solution does center the heat transfer temperature at the midpoint between the two working temperatures.

When the expansion work can be used to directly offset the compression work, as with a turbine, the net Work that must be added from an external source is reduced by the amount of energy recaptured during expansion. The resulting COP increases exponentially as pressure ratios fall within the aforementioned range between 1.2 and 1. No such possibility exists for prior art vapor compression systems because the low pressure region is constantly under suction from the compressor. As documented in the discussion of FIG. 9, above, the latest vapor compression refrigerants contribute no net latent heat in the condensation stage at common summertime temperatures in even temperate regions. It is therefore reasonable to conclude that prior art vapor compression systems can be justifiably replaced with air cycle refrigeration systems according to the principles of this present invention.

Anticipating a total ban on CFC and HCFC refrigerants in Europe, competitive life cycle costs for air cycle systems were certified in the late 1990s. The closed loop air cycle systems developed for trains at that time are still viable and continue to be re-adopted for Germany's most advanced bullet trains. When the expected ban on CFC/HCFC refrigerants was overwhelmed by political pressure, the wider adoption of air cycle refrigeration was blocked before the 20th century drew to a close. The less effective HCFC refrigerants, now widely mandated, still fail to provide life cycle cost competition against proven air cycle alternatives. Without question, HCFC refrigerants are more expensive than air used as a refrigerant. Of far greater consequence however, the newer refrigerants require higher pressures with resultant high rates of leaks and resultant uncontrolled maintenance discharge of harmful gases. More consequentially the new refrigerants dictate more expensive mechanical systems all delivering barely negligible increases in performance, if any at all. An unbiased review of HCFC's lesser capabilities will reveal them to be vulnerable to direct displacement in today's market by the environmentally friendly, less mechanically complex and more cost-effective air cycle refrigeration concepts described herein.

As mentioned earlier, FIG. 11 details the performance of closed loop air cycle systems. The trace of Compression Work necessarily follows the path of all adiabatic compressors, even blowers and fans, with losses increasing progressively for each. Note especially that the Compression Work shown in FIG. 11 tracks necessarily with R410A in the vapor phase. Given R410A's somewhat lower specific heat when compared to air, the mass flow for R410A is correspondingly higher regardless of latent heat benefits. Without the adiabatic energy recovery capabilities inherent in counter-conditioning mechanisms, no single sided adiabatic compression process can compete with Convergent Refrigeration and the concepts of Convergent Refrigeration flows detailed by the present invention.

The high pressure ratios required by new refrigerants are easily out-performed by low pressure Convergent Air Flows. Likewise, the high pressure ratios of closed loop air cycle refrigeration can be out-performed by the much lower pressure open-loop air cycle principles of this invention. Once it is recognized that present refrigeration systems already expend the energy needed to move the entire mass flow of air required for refrigeration and they already move the needed mass flow of air without exception necessarily on both sides of each and every single vapor compression refrigeration loop, there can be no reasonable argument against using air as the refrigerant, certainly no argument based on the heat capacity of air. That said, there is no justification for retaining the vapor compression refrigerant loop. In prior art configurations, fans and blowers move the needed mass flow of air on both sides (Zone 1/$T_{LOW}$/Heat Source and Zone 2/$T_{HIGH}$/Heat Sink) of the refrigeration paradigm. However, as has been demonstrated, fans and blowers of the prior art move all the needed air expensively, inefficiently, wastefully, without energy recovery and ignoring free expansion. Not only is the air that is already being moved through existing HVACR systems sufficient to refrigerate all the ambient air, that same air can be moved for a lower cost and refrigerated at the same time within the Convergent Refrigeration mechanisms described herein. In companionship with embodiments of the more basic Fan Replacement mechanisms, this set of Convergent Refrigeration tools will fundamentally disrupt all prior understandings of practical refrigeration.

When the Expansion Work is subtracted from the Compression Work, the COP as traced in FIG. 11 shows exponential increases in performance as pressure ratios are reduced, accelerating as Pressure Ratios drop toward 2.0, and accelerating much more dramatically as pressure ratios drop below the knee at ~=PR 1.5. The Net Work is radically reduced by recovering all the pressurization work as expansion work when the gas is returned to starting pressure. The relationship between heat flows and Net Work increases toward infinity as pressure ratios drop toward 1.0.

As a mnemonic device it is convenient to anchor Convergent Refrigeration performance in FIG. 11 with a "20:20:20" relationship between COP:PR:ΔT where ΔT is the difference between the two working temperatures, $T_{HIGH}$ and $T_{LOW}$. The 20:20:20 values are only approximate, but some orientation to the thermodynamic experience of Convergent Refrigeration is needed to reset common expectations. Using COP:PR:ΔT, COP near 20 results from a 20% (i.e., 1.2) pressure ratio delivering about a 20° C. temperature change. "20:20:20" Compare this to the well-known and fairly precise thermodynamic experience of vapor compression where a COP near 4 results from a pressure ratio near 400% needed to deliver an 8° C. temperature change. (More precisely, the values would be reported as 3.9:3.9:8.3.) Those of skill in the art will readily appreciate the distinctly different range of performance capabilities shown by 20:20:20 as compared with 4:400:8 of the prior art.

Compared to the COP of 3.93 NIST reported (above) for cooling only an 8.3° C. (15° F.) refrigeration task at the 95° F. Rating Point, a compelling case for disruptive technology can be made. Convergent Refrigeration therefore has the potential to usher in an entirely new order of energy efficiency within the HVACR industry.

As described in the Background section, ASHRAE has raised the standard for "room temperature" from 23° C. to 27° C. This allows the increase of evaporator temperature from 3° C. to 7° C. while maintaining the desired approach Air to Refrigerant Temperature Differential of 20° C. This artifice increases human discomfort while allowing the manufacturers to claim substantial improvements in performance By claiming that customers now suddenly tolerate the ASHRAE-stated higher room temperature, the manufacturers cut excess refrigerant lift to advertise increased performance But conventional wisdom suggests that the average person is ignorant of the manufacturer's surreptitious specification changes, and simply turns their thermostat down to a comfortable lower temperature thus negating the manufacturer's claimed efficiency improvements. The point is that the industry's efficiency claims are dubious. But a 1-Sided Convergent Refrigeration flow device like that depicted in FIG. 6, when located on the evaporator side of the refrigerant loop in FIG. 8, can easily raise the approach air temperature by 10° C. without raising room temperature and without increasing the cost of moving air. Counter-conditioning convergent air flows thus cut excess refrigerant lift without cutting human comfort. Refrigerant lift can be cut directly by the same 10° C. with a huge payoff in COP and operating costs for the vapor compression system if it is kept in place. Using proven positive displacement pumps 76, 78, whose efficiency at this pressure ratio (PR less than 20%, and more preferably not greater than 10%) exceeds 95%, will reduce the cost of moving the air while substantially reducing refrigeration costs on the other side of the heat exchanger 72.

Another Convergent Refrigeration flow can be grafted onto the condenser to deliver 2-Sided Convergent Refrigeration flow, like that schematically illustrated in FIG. 13, allowing the two phase vapor compression refrigerant temperatures to stay within their effective range even as outside temperatures rise above 55° C. That is to say, the Refrigeration System 104 black-boxed in the center of FIG. 13 could represent the device portrayed in the right-hand side of FIG. 8 as but one example. When any such vapor compression system is augmented by counter-conditioned convergent air flows replacing their fans, not only can the costs of running the vapor compression loop be cut by half or more, the raw cost of moving the air alone may be substantially reduced. At the pressure ratios needed (less than 20%, and more preferably not greater than 10%), the market already offers many proven commercial devices capable of moving mass flows in the 400-4000 SCFM range (1-10 Ton capacity) for a small fraction of the energy consumed by an equivalent fan. This is the basis of the concept of Fan Replacement.

Thus, not only can the expansion work of cooling be used to directly offset the compression work of heating, the energy spent creating excess refrigerant lift as well as temperature overshoot can be essentially eliminated. FIGS. 10 and 14 depict this capability of Convergent Refrigeration when two such refrigerated air flows are arranged back-to-back, so to speak, to feed and receive heat through a common (passive or active) heat exchanger 72. (See adjacent Ts diagrams on the right-hand side of the illustration operating between $T_{LOW}$ and $T_{HIGH}$.) The use of the term heat exchanger 72 in the preceding sentence is intended in its broadest possible sense including the 72/104/72 example of FIG. 13 and the 72/100/72 example of FIG. 16 and the 100/272 examples of FIGS. 18-23 to name but a few of the possibilities. Several exemplary embodiments of two Convergent Refrigeration systems arranged in the back-to-back configuration are described in detailed below.

Figure 10A:
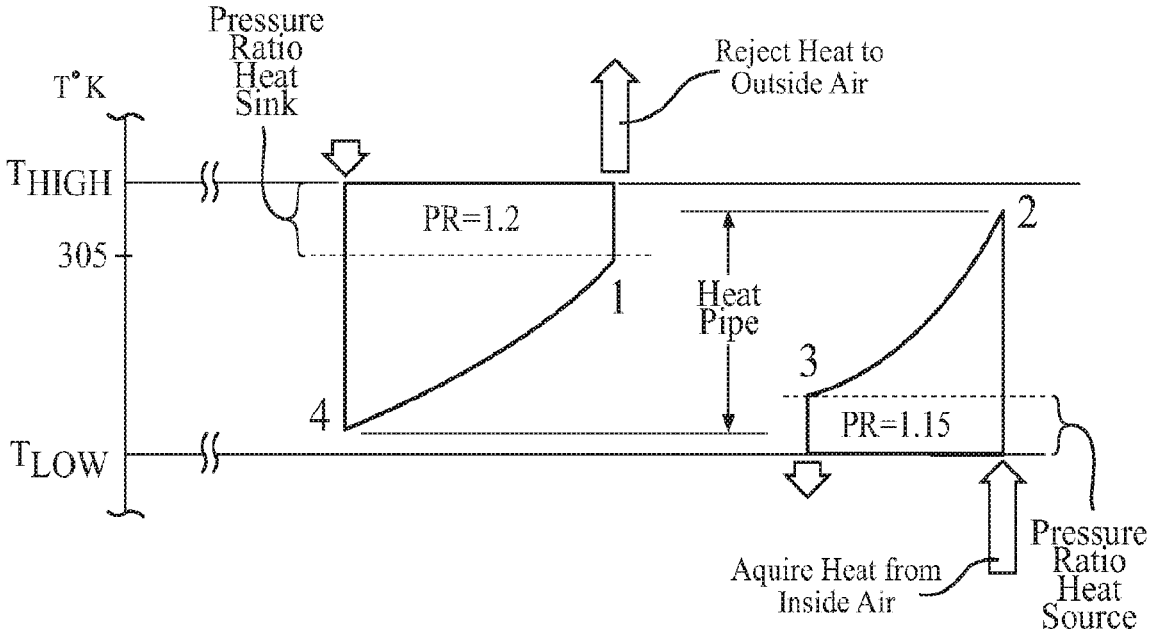
FIG. 10A is an enlarged view of the area bounded at 10A in FIG. 10 showing a Ts diagram depicting the overlapping temperatures of two counter-conditioned convergent air flows like that according to an embodiment of the present invention.

The right side of FIGS. 10 and 14, therefore, depict the overlapping temperature arrangement of two counter-conditioned convergent air flows like that produced by the back-to-back arrangement of FIG. 16. FIG. 10A provides an enlargement for easier viewing. Such an arrangement can replace the vapor compression loop and any analogous closed air cycle refrigeration loop. In the Refrigeration Task ΔT zone, two temperature controlled Convergent Refrigeration flows provide the offsetting temperatures needed to transfer heat in either direction using any air-to-air heat exchanger 72, such as a heat pipe. In refrigeration mode the unwanted heat is simply expelled outside (Zone 2) while the cooled air is released into the target space 22 of Zone 1.

The engineering specifications of a heat pipe 100 type of heat exchanger 72 (FIG. 15) will be used in the following embodiments to illustrate the behavior of counter-conditioned convergent air flows at temperatures certified by commercial parameters and advertised performance for heat pipes 100. Please refer now to FIG. 16, in which the Refrigeration System 104 of FIG. 13 is replaced with an array of heat pipes 100 which in effect form a single shared high-efficiency heat exchanger assembly 72 between the two back-to-back Convergent Refrigeration flow subsystems of this invention. Any air to air heat exchanger may be used, including pumped refrigerant fin and tube heat exchangers equivalent in characteristics to the vapor compression fin and tube heat exchangers they replace. Because every temperature change is working in the direction of the goal (Refrigeration Task ΔT) rather than away from the goal, Convergent Refrigeration inherently reduces the needed refrigerant lift. COPs well into double digits will be shown repeatedly, benefiting from the fact that a heat pipe 100 costs nothing to run. Combined with counter-conditioned convergent air flows, the heat pipe 100 eliminates vapor compression altogether, delivering a 90% reduction in air conditioning costs when compared to the commercially acknowledged cost of operating present systems. (Industry advertising systematically understates operating cost and overstates performance in other ways as well because they do not disclose the cost of moving the inside air.)

The optimum "end to end" temperature differential for a heat pipe 100 may be as low as 9° C. This is the total Approaching Temperature needed to secure heat transfer from one end of the heat pipe 100 to the other. At the same time, the cost of running the (prior art) compressor is eliminated altogether and the total refrigerant lift (20° C.+12° C.+20° C.=52° C., COP=5.3) needed to transfer heat on both sides of the working temperatures is reduced. Instead the ambient air temperature is moved only 4.5° C. beyond the midpoint between the two working temperatures. (6° C.+4.5° C.=10.5° C., COP=28.5) The ambient air temperature is moved twice in this example, but the COP is nonetheless dramatically reduced. The work on both sides is fully recognized in the embodiments detailed later.

The heat pipe 100 uses the energy of the heat to be moved to move the heat without any added cost of work. But more relevant to its speedy adoption, the heat pipe 100 can be tailored to match exactly the physical dimensions of a vapor compression fin-and-tube heat exchanger that it might replace. There is no cost for running the compressor and the refrigerants are inexpensive and benign. The heat pipe 100 directly replaces the (prior art) vapor compression loop while counter-conditioned convergent air flows will deliver exactly the same mass flow of environmental air for cooling and heating at common temperatures for less than the cost of running only the fans in a traditional vapor compression system. Thus, utilizing heat pipes 100 in combination with the heat exchanger 72 in a back-to-back arrangement like that shown in FIG. 16 will result in a dramatically increased COP at all temperatures.

Figure 18:
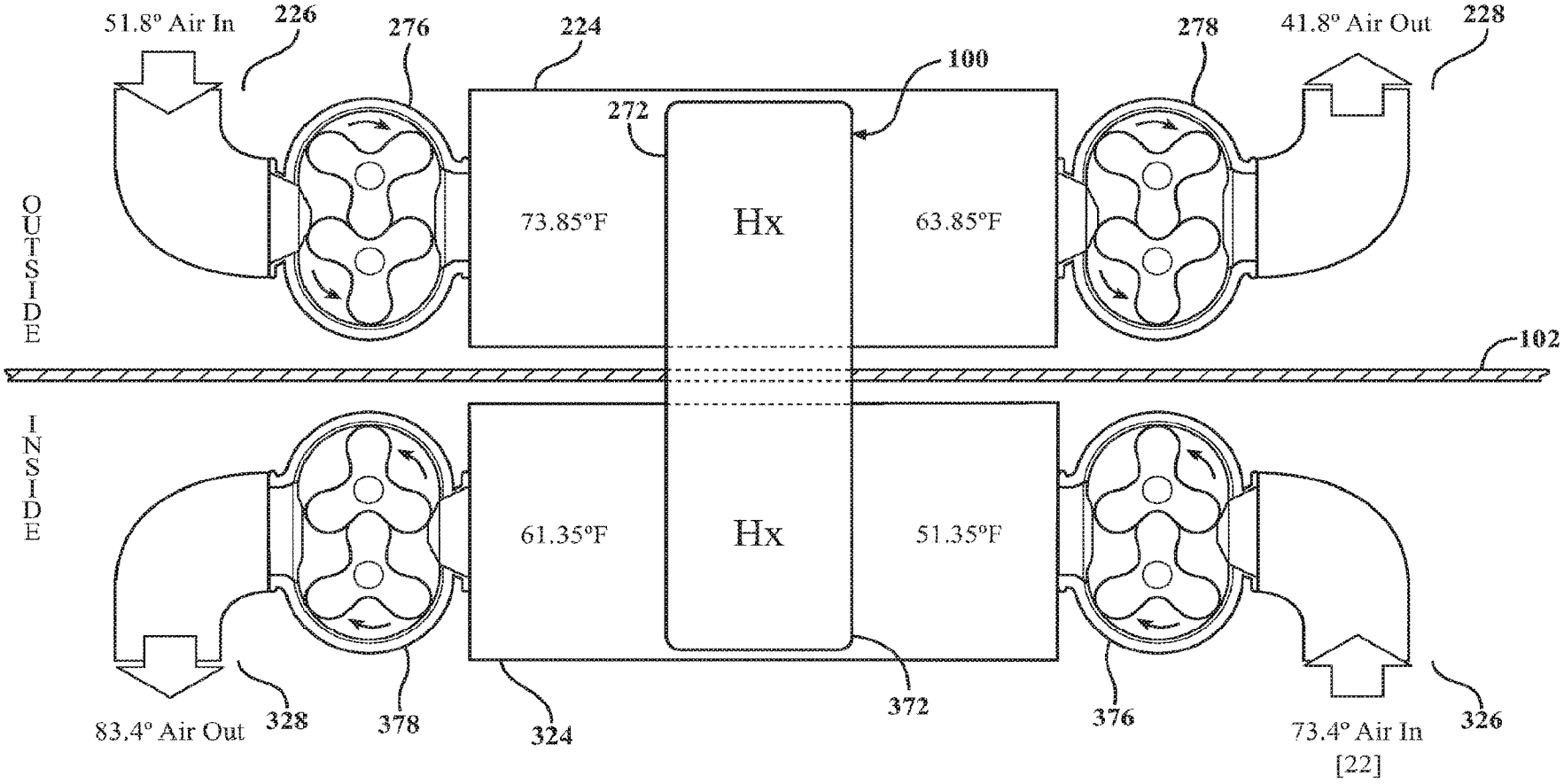
FIG. 18 is a simplified representation of a 2-sided Convergent Refrigeration flow configured as a Simple Heat Pump.

Because the physical implementation of counter-conditioned convergent air flows invites a wide variety of physical dimensions and engineering interpretations, the simple schematic of two Convergent Refrigeration flows arranged in back-to-back relationship is presented in FIG. 18 as an example to accommodate the many canonical methods and physical possibilities.

Figure 19:
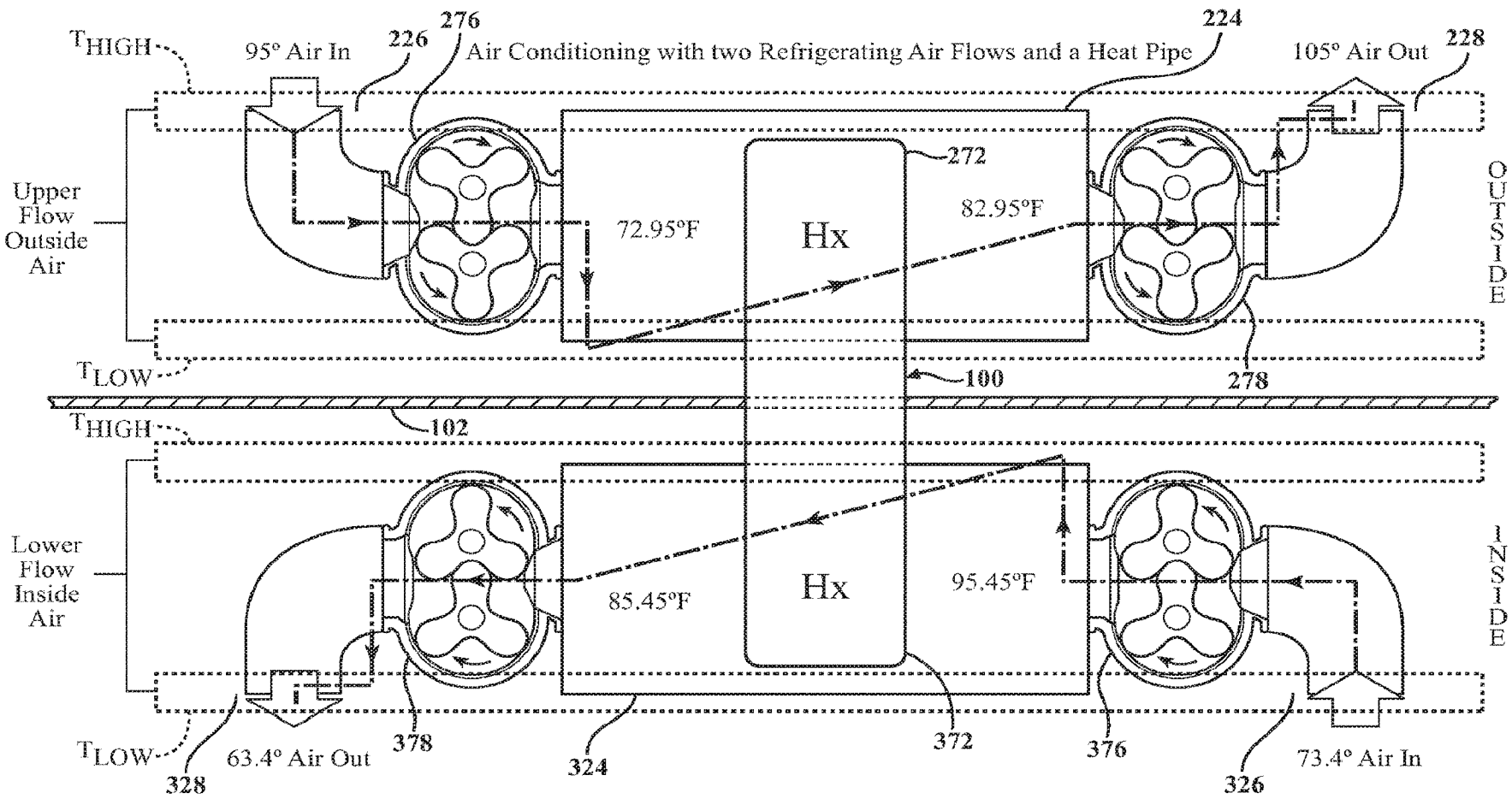
FIG. 19 is a representation of a 2-sided Convergent Refrigeration flow as in FIG. 18, but configured as a Simple Air Conditioner.

For consistency in the schematics which comprise FIGS. 18-23, the elongated upper section represents a gated plenum 224 for the circulation of outside air between pump 276 and 278, while the lower section defines recirculation of inside air through a plenum 324 gated on each end by rotary pump 376, 378, as from the vantage looking downward through the horizontal cross-section of an exterior wall. Zones 1 (Heat Source) and 2 (Heat Sink) as expressed in FIGS. 13 and 16 will correspond to either the outside or inside ambient air depending upon the direction of heat movement. (Heat flows from outside to inside in heating mode, and from inside toward outside in cooling mode.) The previously established reference numbers for the various system components are offset by 200 for elements of the upper/outside subsystem, whereas the previously established reference numbers for the various system components are offset by 300 when referring to elements of the lower/inside subsystem. Pumps 276, 278, 376, 378 are schematically represented in FIGS. 18-19 as simple Roots® blowers like that in FIG. 17, but of a 3-lobe variety. The two (back-to-back) Convergent Refrigeration flows are separated by a barrier 102 such as an insulated exterior building wall or any suitable partition.

The common heat exchanger 272/372 shown in FIGS. 18-23 represents schematically any suitable air-to-air heat exchanger, but for convenience is depicted in the form of a single simple heat pipe 100. In these schematic illustrations, air flows around the sides of the heat pipe 100. That is to say, the heat pipes 100 depicted in FIGS. 18-23 would not impede air flow through the respective plenums 224, 324. Only a single heat pipe 100 is shown for illustrative convenience in FIG. 18-23; in practice it is anticipated that multiple rows of heat pipes 100 will form the core of the heat exchanger 72 more like that depicted in FIG. 16, and perhaps with optional additions described below. In most residential split systems, the heat pipe 100 will utilize conventional fin and tube heat exchangers fed by pumped or gravity fed liquid refrigerant with a single boiling point. Effective heat pipes 100 can be engineered with temperature differences as small as 2° C. between the source and sink. A temperature differential of about 5° C. may be typical.

Commercial air-to-air heat exchangers 72 of this heat pipe 100 class use typical refrigerants like R134a circulating through the same fin-and-tube heat exchangers 72 employed by vapor compression systems. Such two phase refrigerants may even be pumped at very low cost while in the liquid phase. Not dependent on gravity, heat pipes 100 overcome limitations of elevation and distance. The direction of flow may be reversed easily to change over from Air Conditioning to Heat Pump operation, meeting day-night and/or seasonal demands Their boiling points may be controlled with specific pressure regulation, exactly as in vapor compression systems. But a crucial performance distinction for heat pipes 100 remains that heat is acquired at a higher temperature source and rejected into a lower temperature sink. No external energy is required to compress the vapor so that it will condense at a higher temperature. As graphically depicted in FIG. 15, a heat pipe 100 boils the refrigerant using heat from $T_{LOW}$. Vapor carries latent heat to condense and to reject heat into the now relatively lower temperature air stream of $T_{HIGH}$, provided by the counter-conditioned convergent refrigeration air flows. Many such combinations of counter-conditioned convergent air flows of the present invention, with heat pipes 100 and other air-to-air heat exchangers enable an entirely new range of refrigeration opportunities.

In the summer, for example, the warmer outside air is made cooler between the pumps 276, 278 surrounding the heat exchanger 272 while the cooler inside air is made warmer. Heat will naturally migrate into the outside counter-conditioned convergent air flow through any air-to-air heat exchanger 272, which may be a heat pipe 100 or any other suitable device. Reversing these relationships transforms the system from an air conditioner into a heat pump, moving heat from the colder outside air into the building in winter. Just as the relative pump speeds will be tuned for best efficiency as inside and outside temperature and humidity changes, the boiling point of the heat pump working fluid may be moved to the optimum temperature between counter-conditioned convergent air flows to follow both the size and the direction of the refrigeration task, reversing the direction of vapor and liquid flows to meet seasonal or even daily needs.

The heat demands of very cold temperatures have been addressed and satisfied by configurations like that of FIG. 5 which show the presence of an auxiliary heat source 62, optionally a fuel burning heat source. Such an auxiliary heat source 62 can be incorporated to augment the heat pump function of FIG. 18 for effective service in extremely cold temperatures.

It is contemplated that the outside 224 and inside 324 plenums will represent permanent ducting that remains fixed in place while the changeover from air conditioning to heating seasonal needs is delivered simply by changing relative pump or turbine speeds. That is to say, the transition from the inside space being Zone 1 (Heat Source) in the summer to Zone 2 (Heat Sink) in the winter may be accomplished without physical relocation of the outside 224 and inside 324 plenums. In this manner, daytime cooling is readily complimented with heating on cold nights.

Depending on proximity and climate variables, the driving pumps 276/378 and 278/376 may optionally share a common shaft. That is to say, in some contemplated configurations, inlet pump 276 is mechanically coupled with outlet pump 378. And likewise, inlet pump 376 and outlet pump 278 are mechanically coupled through a common drive shaft or other power transmission device. More typically, however, each pump will be separately powered and precisely controlled using DC motor-generators, like those depicted schematically at 68 in FIGS. 13 and 16.

Throughout FIGS. 18-23, arrows are positioned at inlets and outlets of the plenums 224, 324 to show exemplary directions of the counter-conditioned convergent air flows. It will be observed that a counter-flow configuration is proposed in each example, wherein the outside Convergent Refrigeration flow moves left-to-right and the inside Convergent Refrigeration flow flows right-to-left. Counter-flow of the two counter-conditioned convergent air flows is not a requirement, but does provide certain operating advantages such as when the driving pumps 276/378 and 278/376 are configured to share a common shaft and/or mechanically-linked drive train. The arrangement of any heat exchanger 72 ducts, pipes, and fins may be engineered for best performance in counter-flow heat transfer models.

For illustration, the temperature values shown in examples which follow have been taken from the commercially available engineering statements of Heat Pipe Technology, Inc. (HPT). Often demonstrating greater heat flux, the heat pipe 100 type of heat exchanger 72 can deliver temperature changes often exceeding 90% of the approach compared to 60% with prior art vapor compression. Not only will typical heat transfers be substantially higher with the same mass air flow, the total heat content will be greater because 1) the inside air flow is always "non-condensing" and 2) condensation in the outside flow will rarely occur due to significantly narrower A-RTD. In fact, there is considerable latitude to avoid condensation in the outside air stream altogether by simply moving the heat transfer temperature above the dew point of the outside air. The temperature of the inside air stream can be counter-conditioned to compensate accordingly. With the Sensible Heat Ratios of present (prior art) HVAC air conditioners running from 65% to 80%, latent heat losses due to cold water running down the drain amount to 0.30 Kw/ton. Except for the dehumidification of make-up air, this charge will be entirely avoidable in a Convergent Refrigeration system. Condensation in the outside air stream is totally avoidable, as is condensation in the inside air stream after accounting for the dehumidification of make-up air. This capability further improves the efficiency gained by evaporative cooling in the outside air stream. In fact, due to the high latent heat of water, it is certain that the best Convergent Refrigeration performance will be obtained by saturating the outer air stream to a dew point just above its cooler counter-conditioned target temperature.

FIG. 19 portrays exemplary operating temperatures for air conditioning applications. The outside air flow is shown above the inside air flow, as from the perspective looking downward through the cross-section of an exterior wall. Temperatures have been selected to show expected relationships at the 95° F. Rating Point. HPT is again the source for these heat pipe 100 performance parameters. The broken directional lines in FIG. 19 are intended to graphically represent the changes in temperature that occur as the working fluid air passes through pumps and around heat exchangers. FIG. 19 defines counter-conditioned convergent air flows precisely targeted to the temperatures needed to sustain heat transfer within HPT parameters while eliminating all excess refrigerant lift. All the temperature overshoot characteristic of a Brayton Cycle has been eliminated. The incoming air temperature has been selected to precisely conform to the exact approach air temperatures and relationships stipulated in engineering statements of HPT, ASHRAE, and NIST.

This configuration reduces ~90% of the acknowledged vapor compression energy cost. Convergent Refrigeration flows eliminate the vapor compression system altogether. Of course the Convergent Refrigeration energy budget would include the previously unreported cost of moving air through the inside heat exchanger 72. Even including these additional energy consumption parameters, however, the entire cost of refrigeration using two counter-conditioned convergent air flows back-to-back sharing a common heat exchanger 272 may fall below what the prior art would have incurred just to move the mass flows of air using fans or blowers.

As previously shown for temperatures at and above this rating point, the only usable portion of the R410A vapor compression cycle is vapor, not latent heat. And the energy needed to raise the vapor pressure to ratios of 4 and above causes extreme temperature overshoot. Vapor compression may have benefited from temperature overshoot by accelerating heat transfer, but temperature overshoot can be eliminated altogether by sustaining a precisely tuned Approaching Temperature. Accordingly, Convergent Refrigeration may be delivered within the energy budget previously required just for moving air.

Rather than use the above-mentioned 20:20:20 rule with both flows in the simple back-to-back air conditioning illustration of FIG. 19 and in the simple heat pump example of FIG. 18, it is possible to introduce even greater precision. Both back-to-back counter-conditioned convergent air flows are operating at a pressure ratio of 1.15. COP is 24.17. COP will rapidly increase at temperatures below the 95 F Rating Point. The refrigerating COP of the upper flow is mirrored by the slightly more efficient heat pump COP of the lower flow, i.e., 24.19, because of the slightly lower operating temperatures. The combined COP for moving the heat out of the lower flow and out of the building is COP=12.33.

As previously stated, the temperature relationships are chosen purposefully to meet the requirements of the 95 F Rating Point under the heat movement measurements published by HPT. The counter-conditioned convergent air flows here follow behaviors incidental to the choices made by HPT rather than the optimized values readily preferred in a working system. The stated values have also been validated computationally. These HPT numbers provide commercial certification of temperature relationships and deliverable technology capable of displacing vapor compression with counter-conditioned convergent air flows. Their physical dimensions provide a plug and play replacement for vapor compression heat exchangers 72 used around the world and their track record of performance and reliability is acknowledged by ASHRAE to be "second to none"!

As stated above, at any given time in a system utilizing two back-to-back counter-conditioned convergent air flows sharing a common heat exchanger 100, one half or subsystem operates in heat pump mode (the supplier of heat, the heat source) while its partner operates as the heat sink. The air conditioning example shown in FIG. 19 employs the inside (lower) counter-conditioned convergent air flow subsystem to raise the temperature of $T_{LOW}$ high enough to reject heat into its portion of the heat pipes 372. Its partner, the outside (upper) counter-conditioned convergent air flow sub-system reduces the temperature of $T_{HIGH}$ sufficiently to accept heat from its portion of the heat pipes 272. The upper air flow is operating in heat sink mode. The examples of FIGS. 18 and 19 thus show how the composite pair of back-to-back Convergent Refrigeration flows act together to provide a room or building with heat from the outside when the outside temperatures fall below the desired inside temperature and air conditioning when the locations of $T_{HIGH}$ and $T_{LOW}$ are reversed. Remember: refrigeration always applies work to move heat from the lower temperature source to the higher temperature sink.

Returning again to FIG. 18, the superimposed operating temperatures are shown under heat pump operating conditions. The outside air flow within the plenum 224, upstream of the heat exchanger 272, is above the temperature of the inside air flow within its plenum 324 upstream of its heat exchanger 372. The temperatures selected are symmetrical with respect to FIG. 19. The heat pump of FIG. 18 duplicates the same relationships as seen in the cooling example of FIG. 19 but with the heat now flowing downward into the cooler lower counter-conditioned convergent air flow rather than upward from the lower flow. The outside temperature is now 21.6° F. below the inside target space temperature of 73.4° F. (23° C.) as it was 21.6° F. above the inside target space temperature at the 95° F. Rating Point shown in FIG. 19. The same efficiencies are present here with combined COP better than 12.33 because of lower operating temperatures over all.

It can be seen, therefore, that heating (FIG. 18) and cooling (FIG. 19) can be delivered by the principles of Convergent Refrigeration (i.e., counter-conditioned convergent air flows) at about the same cost previously incurred just for blowing air across high and low-side heat exchangers in prior art vapor compression systems. In one respect, the cost to heat and cool using the Convergent Refrigeration scheme would even be considered zero if one follows the industry standard practice of ignoring the cost of moving the inside air (fans/blowers) for vapor compression systems. This claim is readily deliverable with Convergent Refrigeration as long as pump efficiencies remain at or above ~90%, which efficiencies are readily attainable using commercial equipment like the Dresser Roots® blowers in the pressure ratio context (less than ~1.2, and more preferably less than ~1.1) of this invention.

Figure 20:
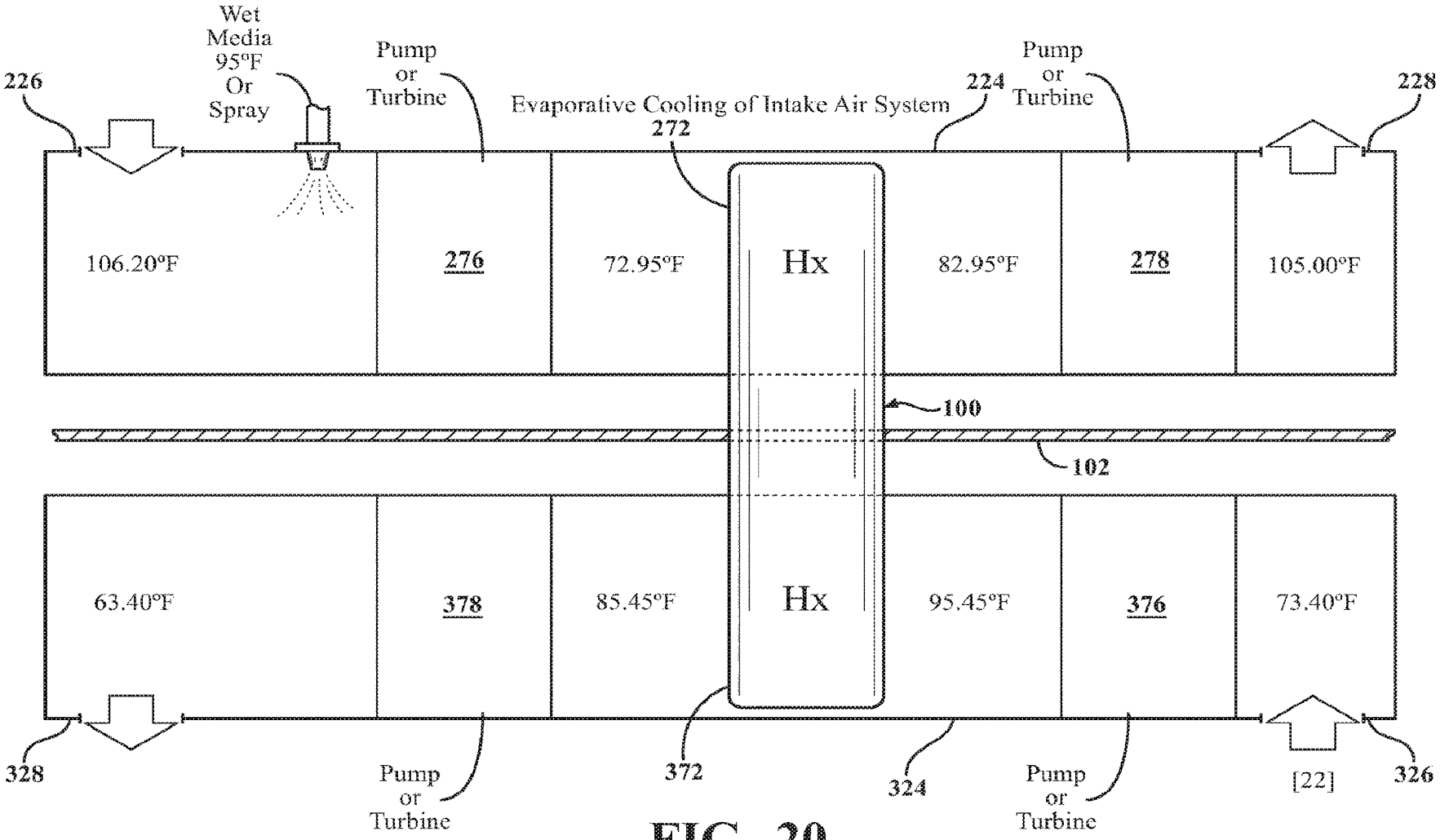
FIG. 20 is a representation of a 2-sided Convergent Refrigeration flow as in FIG. 19, showing the further addition of evaporative water cooling ahead of the first outside pump.

FIG. 20, which is an even more simplified depiction of the back-to-back Convergent Refrigeration scheme of FIGS. 18-19, shows the addition of evaporative water cooling ahead of the first outside pump 276. As shown in this example, evaporative cooling will add another 11.2° F. to the capability of cooling without changing counter-conditioned convergent air flow energy performance so long as the mass air flow between the pumps 276, 278 remains non-condensing. HPT certified data is used here again for the measures of evaporative cooling. The increment of improvement naturally depends on relative humidity. The essential relationship is determined by the heat exchanger 72 target temperature. As long as the incoming temperature-humidity combination maintains a dew point above the heat exchanger 72 target temperature (72.95° F. with a wet bulb temperature roughly 84.5° F.), it will be non-condensing. The performance gain achieved with evaporative water cooling duplicates the published HPT data. HPT data is used to validate and incorporate the viability of HPT products within this disclosure of Convergent Refrigeration. Use of published HPT data is not meant to suggest any optimization within counter-conditioned convergent air flows. At outside temperatures below 106.2° F., the introduction of evaporative water cooling into the outside air stream can take the outside counter-conditioned convergent air flow well below the 10% pressure ratio where COPs well above 30 are readily apparent. As stated previously, there is wide latitude to adjust the heat pipe's "single boiling point" temperature, hence the heat transfer temperature target between two counter-conditioned convergent air flows. Great efficiencies will be enjoyed over a much wider range of temperatures and humidities.

Figure 21:
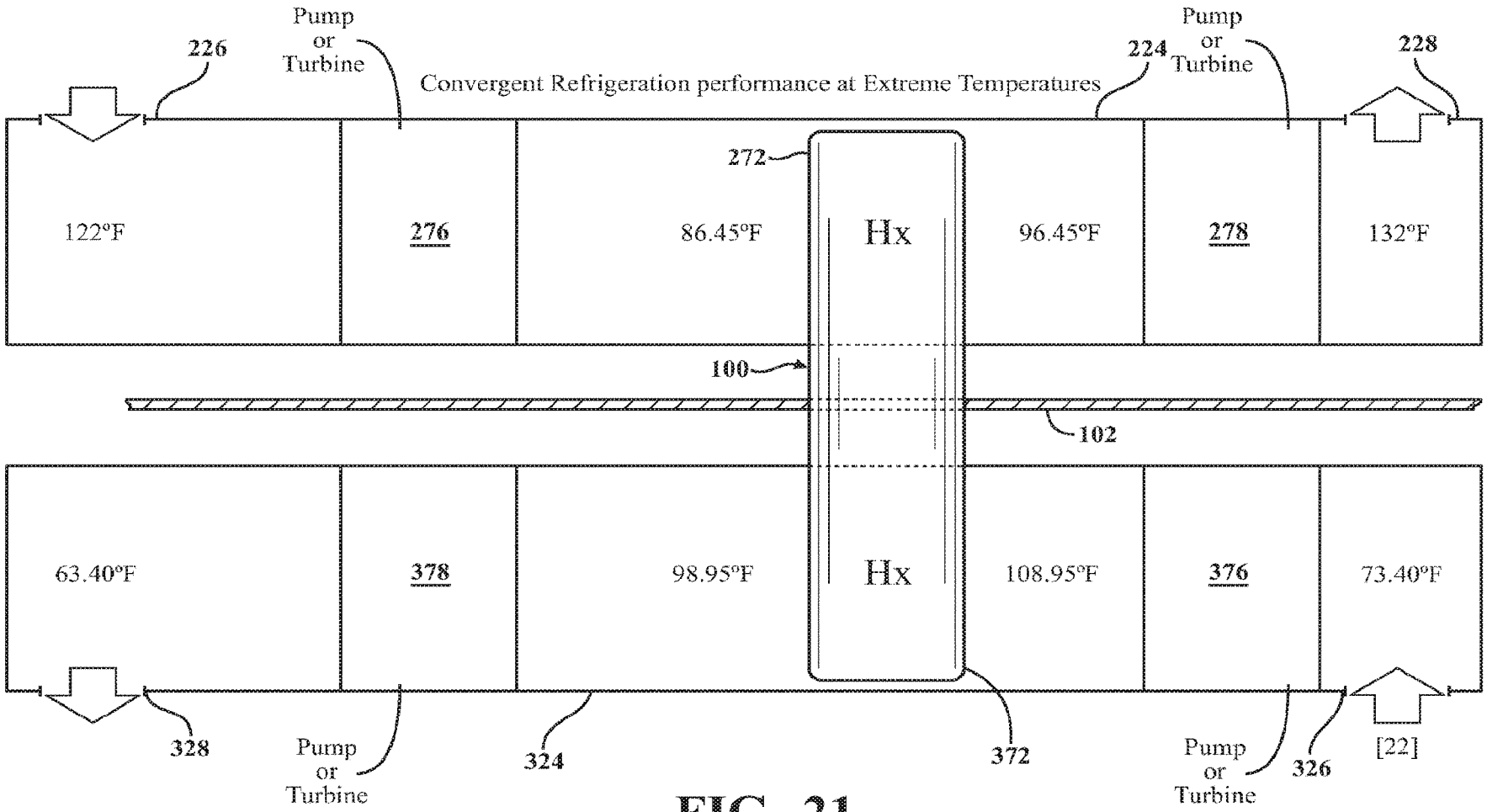
FIG. 21 is a representation of a 2-sided Convergent Refrigeration flow as in FIG. 19, configured for extreme high temperature operating conditions.

FIG. 21 explores what it takes to cool temperatures of extreme hot climates, like the Saudi Arabian desert for example, to the older cooler room temperature of 23° C. (73.4° F.). Recalling that this temperature was enjoyed more or less globally before ASHRAE's alteration of the testing standard to create the appearance of improved technical performance without improving the technology or mechanical capabilities even slightly, one might want to deliver the same level of comfort still sought by many who prefer and might readily afford the older cooler room temperature. The depiction in FIG. 21 preserves exactly the same HPT operating temperature differences respected in all other scenarios relied on in this disclosure.

Both inside and outside air flows are refrigerated by the same temperature change, 35.55° F.=19.75° C., somewhat less than needed to fit the 20:20:20 rule introduced above. It is noteworthy that refrigeration can be delivered under these extreme circumstances by increasing the pressure ratio to only 1.25 from the 1.15 needed at the 95° F. Rating point described in FIG. 19. In other words, Convergent Refrigeration can deliver the same comfort level under desert conditions with only a relatively small increase in energy expense. Both inside and outside Convergent Refrigeration flows correspondingly deliver COPs of 15 with the total system COP of 7.84 at these elevated temperatures. By comparison, NIST reports a COP near 2 for both R410A and R22 at the same outside temperature while allowing the inside temperature of 80° F.

Performance will be increased by provisions for dehumidification, make-up air, and exhaust when compared to the standard operating mode of Convergent Refrigeration.

These three new capabilities detailed below far exceed the best possibilities of vapor compression alternatives.

Figure 22:
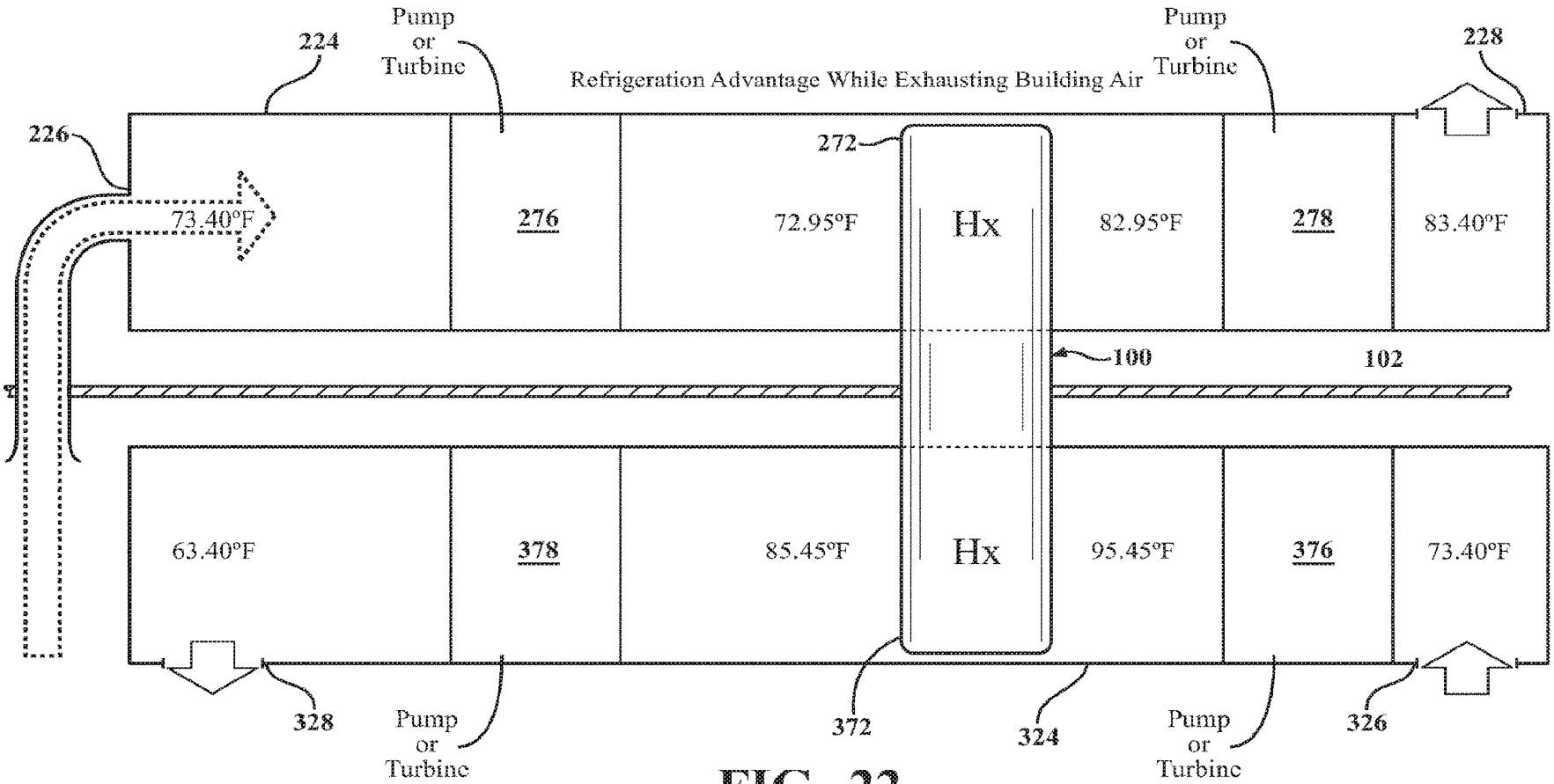
FIG. 22 is a representation of a 2-sided Convergent Refrigeration flow as in FIG. 19, and further configured for refrigeration while exhausting air from the target space.

In FIG. 22 the inside air is simply exhausted. Only negligible work is needed to meet the target heat pipe 100 temperature in the upper flow, which is less than half a degree Fahrenheit. COP in the lower flow will remain as it was at 25.19 indicating a total system COP at that level.

Figure 23:
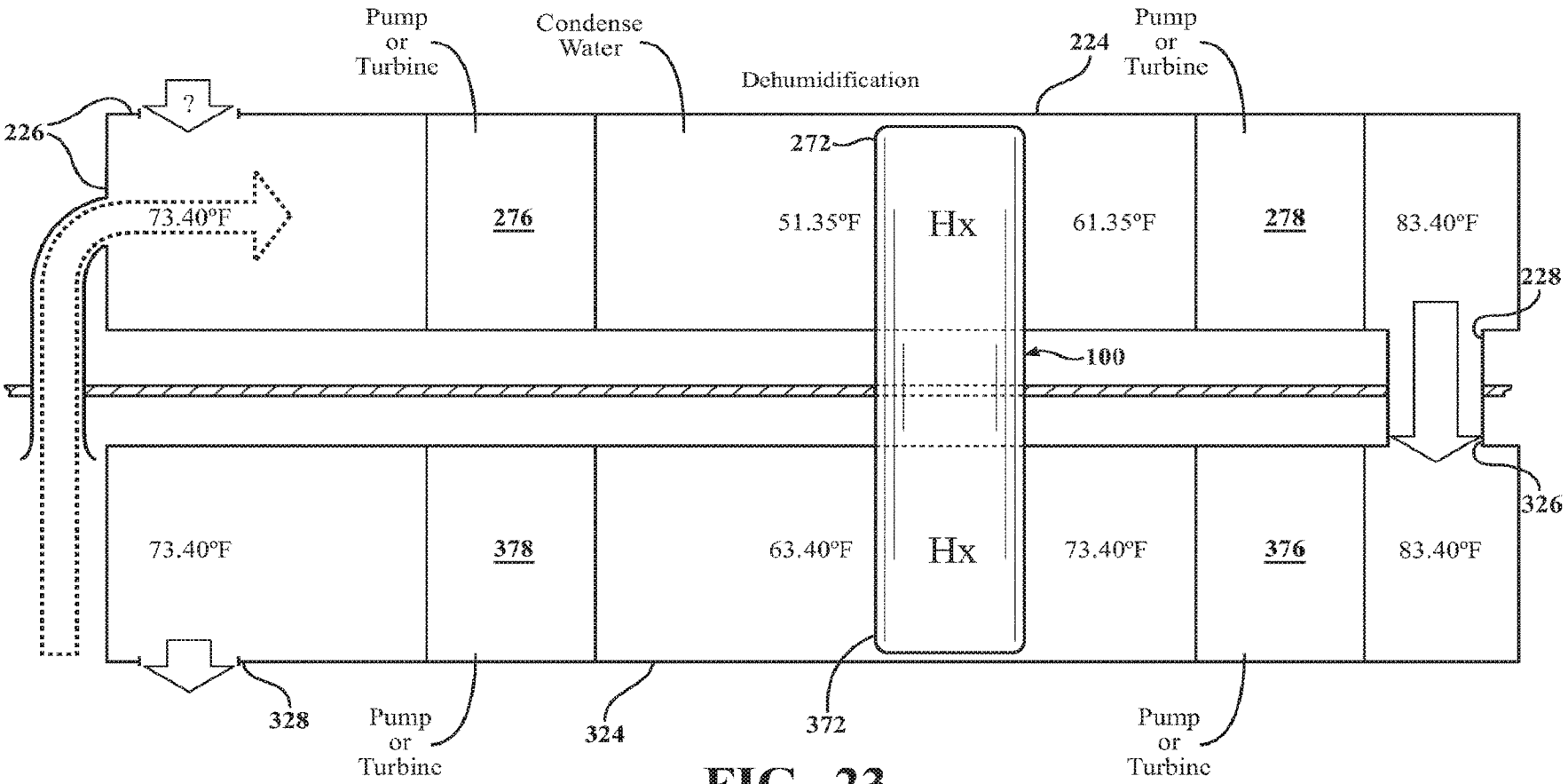
FIG. 23 is another representation of a 2-sided Convergent Refrigeration flow as in FIG. 19, configured for dehumidification of the target space.

In FIG. 23 the entire mass of building (or room) air is initially fed through the upper Convergent Refrigeration flow for the purpose of dehumidification rather than affecting a temperature change. In this case the upper flow exit feeds directly into the lower flow. NOTE: choice of the upper flow path as primary for dehumidification is merely suggestive that only one path need be equipped to deal with water; evaporative cooling, and condensation. Other arrangements will be chosen depending on climate and the physical routing of ducts, their intake locations and their exhaust locations.

The process for providing and dehumidifying make-up air is understood and adequately documented in the engineering of wrap-around heat pipes 100 by HPT. Although it is not detailed here, the effusive endorsement of heat pipes by ASHRAE was previously noted. The anticipated blending of outside makeup air to be dehumidified, as indicated by the direction arrow containing the "?" symbol in the upper left corner, will increase energy use. The heat exchanger 272 target temperature of 51.35° F. is below the best evaporator inlet temperatures recorded by NIST in the Domanski and Payne (2002) study previously mentioned. Clearly this target temperature meets the ASHRAE specifications for testing at the 95° F. Rating Point. Cooling work must be done in the upper path sufficient to assure that the target temperature chosen for the desired exit humidity level has been met. Because no external heat rejection occurs in the process as depicted, heat will accumulate from the latent heat of condensation.

In summary, Convergent Refrigeration (also referred to herein as counter-conditioned convergent air flow) provides an entirely new set of mechanisms and methods for minimizing heat transfer in refrigeration, delivering unprecedented high COPs with unprecedented low pressure air cycle refrigeration. In both cooling and heating applications, Convergent Refrigeration replaces the energy intensive and environmentally harmful vapor compression technology of the 20th Century with a clean, low-cost alternative. The prior art's performance mnemonic 4:400:8 becomes the new and substantially more attractive mnemonic 20:20:20 (COP:PR:ΔT)

By incorporating proven passive heat pipe 100 technology, Convergent Refrigeration uses as its refrigerant exactly the same mass flow of air required by vapor compression technology. Of the most profound importance to certify the feasibility of counter-conditioned convergent air flows, vapor compression systems demand much more than just the same mass air flow. The necessary heat capacity of circulated air has been demonstrated by vapor compression systems to provide adequate mass flow to hold and move requisite heat to and from the source (Zone 1) to the sink (Zone 2). Convergent Refrigeration uses the same mass flow of air as circulated by prior art vapor compression systems, but uses that air as its refrigerant. By moving the air across the heat exchanger 272, 372 within a plenum 224, 234 that is gated at each end with a rotary pump 276, 278, 376, 378, the air can be transformed for use as a refrigerant and thereby accomplish the purposes of this invention.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A method for transferring heat between two discrete air plenums, said method comprising the steps of:

providing a heat source plenum configured to move heat source air from a source inlet toward a source outlet, the heat source air entering the source inlet at a source working temperature, trapping the heat source air between the source inlet and source outlet, counter-conditioning the trapped heat source air by proactively increasing its air pressure to increase its source working temperature, transferring heat from the counter-conditioned heat source air to an inter-plenum heat exchanger, and providing a heat sink plenum configured to move heat sink air from a sink inlet toward a sink outlet, the heat sink air entering the sink inlet at a sink working temperature, trapping the heat sink air between the sink inlet and sink outlet, counter-conditioning the trapped heat sink air by proactively decreasing its air pressure to decrease its sink working temperature, transferring heat from the inter-plenum heat exchanger to the counter-conditioned heat sink air.

2. The method of claim 1, wherein the heat source air enters the source inlet at an incoming source pressure, the heat sink air enters the sink inlet at an incoming sink pressure, further including the steps of returning the trapped heat source air to the incoming source pressure prior to discharging through the source outlet, and returning the trapped heat sink air to the incoming sink pressure prior to discharging through the sink outlet.

3. The method of claim 2, wherein at least one of said steps of returning the trapped heat source air and returning the trapped heat sink air further includes harvesting work in response to changes in the volume of air.

4. The method of claim 1, further including the steps of inlet gating the heat source plenum at an upstream location, outlet gating the heat source plenum at a downstream location, inlet gating the heat sink plenum at an upstream location, and outlet gating the sink plenum at a downstream location.

5. The method of claim 4, wherein at least one of said steps of inlet gating the heat source plenum and inlet gating the heat sink plenum includes limiting the inflow of air with a first pump, and at least one of said steps of outlet gating the heat source plenum and outlet gating the heat sink plenum includes limiting the outflow of air with a second pump.

6. The method of claim 4, wherein said step of inlet gating the heat source plenum includes limiting the inflow of heat source air with a first source pump, said step of outlet gating the heat source plenum includes limiting the outflow of heat source air with a second source pump, said step of inlet gating the heat sink plenum includes limiting the inflow of heat sink air with a first sink pump, said step of outlet gating the heat sink plenum includes limiting the outflow of heat sink air with a second sink pump, and wherein said step of counter-conditioning the trapped heat source air includes manipulating the first source pump relative to the second source pump, and said step of counter-conditioning the trapped heat sink air includes manipulating the first sink pump relative to the second sink pump.

7. The method of claim 6, wherein at least one of the first source pump and second source pump and first sink pump and second sink pump includes dual meshing rotors.

8. The method of claim 4, wherein one of said steps of inlet gating and outlet gating includes limiting the flow of air with a Venturi.

9. The method of claim 8, wherein the Venturi is a regulated variable flow Venturi.

10. The method of claim 4, wherein one of said steps of inlet gating and outlet gating includes limiting the flow of air with a sonic nozzle.

11. The method of claim 10, wherein the sonic nozzle is a regulated variable flow Sonic Nozzle.

12. The method of claim 1, wherein the heat source air enters the source inlet at an incoming source pressure, the heat sink air enters the sink inlet at an incoming sink pressure, and wherein said step of counter-conditioning the trapped heat source air includes increasing the pressure of the heat source air by 10-20% relative to the incoming source pressure, and said step of counter-conditioning the trapped heat sink air includes decreasing the pressure of the heat sink air by 10-20% relative to the incoming sink pressure.

13. The method of claim 1, further including the step of evaporative water cooling the heat sink air.

14. The method of claim 1, wherein a heat-emitting electronic device is in direct thermal contact with air in the heat source plenum.

15. A method for dehumidifying air comprising the steps of:

providing a heat sink plenum configured to move heat sink air from a sink inlet toward a sink outlet, the heat sink air entering the sink inlet having a sink working temperature, trapping the heat sink air between the sink inlet and sink outlet, counter-conditioning the trapped heat sink air by proactively decreasing its air pressure to decrease its sink working temperature, transferring heat from an inter-plenum heat exchanger to the counter-conditioned heat sink air, discharging the heat sink air through the sink outlet, providing a heat source plenum configured to move heat source air from a source inlet toward a source outlet, directly connecting the source inlet to the sink outlet to provide the discharged heat sink air as the heat source air, the heat source air entering the source inlet having a source working temperature, trapping the heat source air between the source inlet and source outlet, counter-conditioning the trapped heat source air by proactively decreasing the pressure of the heat source air to decrease its source working temperature, transferring heat from the counter-conditioned heat source air to the inter-plenum heat exchanger, and condensing water from one of the counter-conditioned heat source air and heat sink air.

* * * * *